US007151351B2

(12) United States Patent
Piechowiak et al.

(10) Patent No.: US 7,151,351 B2
(45) Date of Patent: Dec. 19, 2006

(54) METHOD, SYSTEM AND APPARATUS FOR OPENING DOORS

(75) Inventors: John Piechowiak, Franklin Square, NY (US); James H. St. Pierre, Commack, NY (US); Peter Wolfe, Totowa, NJ (US); Donald Pastor, Northport, NY (US); Erick Dobis, Woodhaven, NY (US)

(73) Assignee: The Chamberlain Group, Inc., Elmhurst, IL (US)

( * ) Notice: Subject to any disclaimer, the term of this patent is extended or adjusted under 35 U.S.C. 154(b) by 80 days.

(21) Appl. No.: 10/730,742
(22) Filed: Dec. 8, 2003

(65) Prior Publication Data

US 2005/0269984 A1 Dec. 8, 2005

Related U.S. Application Data

(63) Continuation-in-part of application No. PCT/US02/18441, filed on Jun. 5, 2002, which is a continuation of application No. 09/875,799, filed on Jun. 6, 2001, now Pat. No. 6,624,605.

(51) Int. Cl.
*E05F 15/16* (2006.01)

(52) U.S. Cl. ..... 318/466

(58) Field of Classification Search ..... 318/264–267, 318/286, 466–469; 388/907.5; 340/825, 340/825.69, 825.72
See application file for complete search history.

(56) References Cited

U.S. PATENT DOCUMENTS

| | | | | |
|---|---|---|---|---|
| 4,305,060 | A * | 12/1981 | Apple et al. | 340/825.65 |
| 4,360,801 | A * | 11/1982 | Duhame | 340/521 |
| 4,750,118 | A * | 6/1988 | Heitschel et al. | 700/90 |
| 5,070,442 | A * | 12/1991 | Syron-Townson et al. | 700/17 |
| 5,793,300 | A * | 8/1998 | Suman et al. | 340/825.22 |
| 5,903,226 | A * | 5/1999 | Suman et al. | 340/825.69 |
| 6,005,508 | A * | 12/1999 | Tsui | 341/173 |
| 6,308,083 | B1 * | 10/2001 | King | 455/556.1 |
| 6,667,684 | B1 * | 12/2003 | Waggamon et al. | 340/5.71 |
| 6,958,936 | B1 * | 10/2005 | Quader et al. | 365/185.17 |

* cited by examiner

*Primary Examiner*—Bentsu Ro
(74) *Attorney, Agent, or Firm*—Fitch, Even, Tabin & Flannery

(57) ABSTRACT

An improved garage door opener is disclosed. The garage opener has a motor drive unit for opening and closing a garage door. The motor drive unit has a microcontroller. Connected to the motor drive unit is a wall console that is located inside the garage. The wall console also has a microcontroller. The microcontroller of the motor drive unit is connected to the microcontroller of the wall console by means of a digital data bus.

7 Claims, 45 Drawing Sheets

OVER VIEW OF SYSTEM

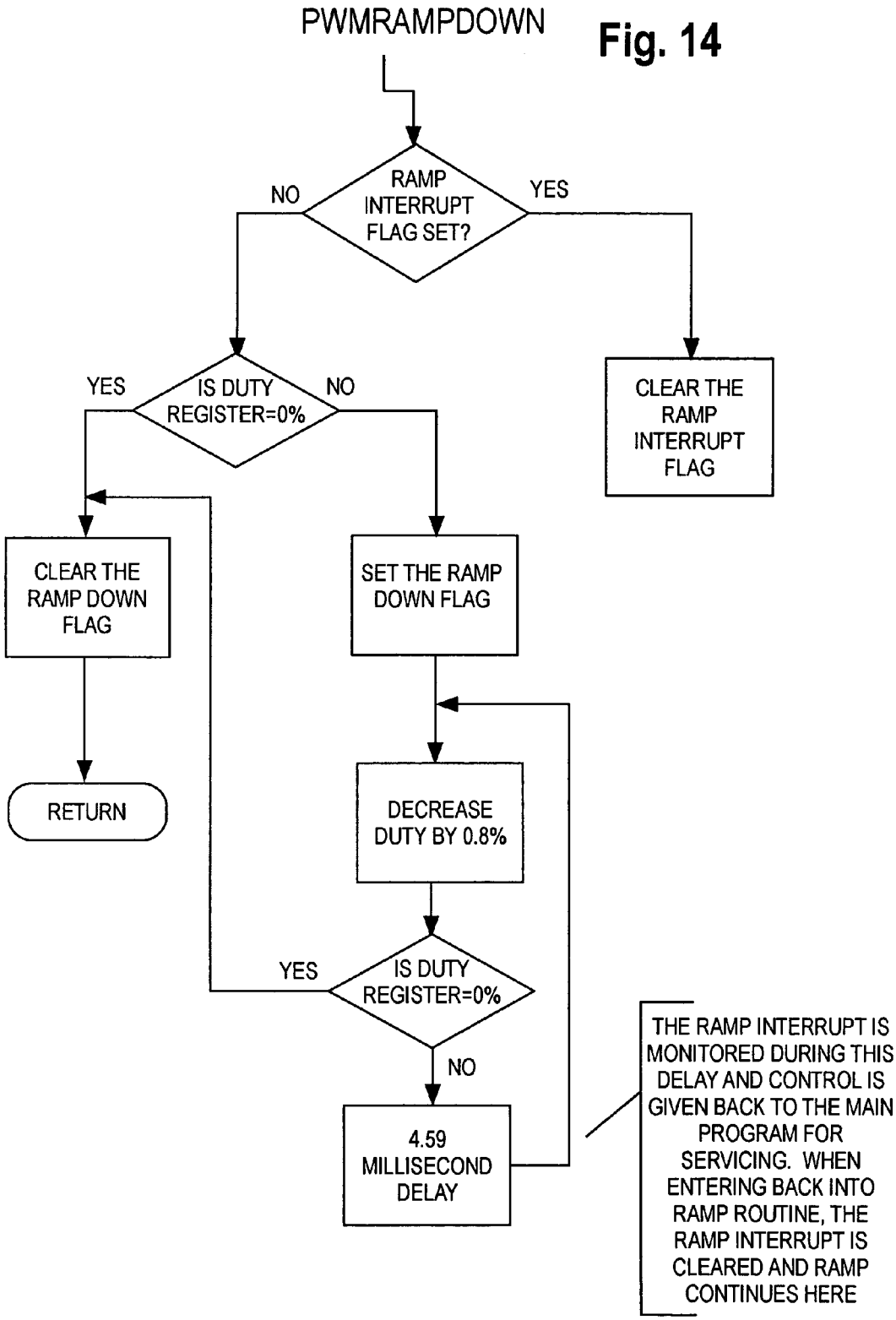
PWMRAMPDOWN
Fig. 14
RAMP INTERRUPT FLAG SET?
NO
YES
CLEAR THE RAMP INTERRUPT FLAG
IS DUTY REGISTER=0%
YES
NO
CLEAR THE RAMP DOWN FLAG
SET THE RAMP DOWN FLAG
RETURN
DECREASE DUTY BY 0.8%
IS DUTY REGISTER=0%
YES
NO
4.59 MILLISECOND DELAY
THE RAMP INTERRUPT IS MONITORED DURING THIS DELAY AND CONTROL IS GIVEN BACK TO THE MAIN PROGRAM FOR SERVICING. WHEN ENTERING BACK INTO RAMP ROUTINE, THE RAMP INTERRUPT IS CLEARED AND RAMP CONTINUES HERE

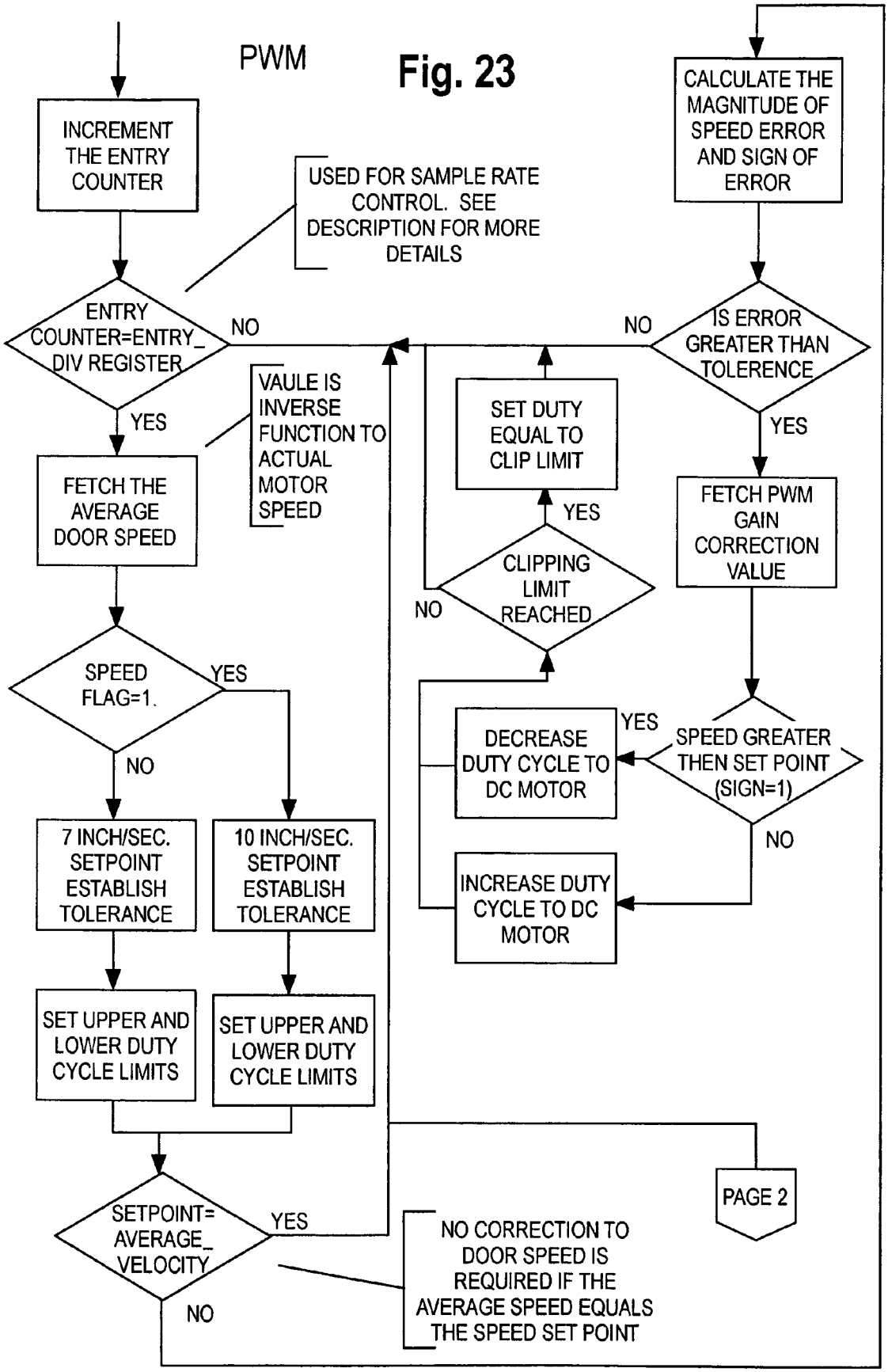
PWM
Fig. 23
INCREMENT THE ENTRY COUNTER
USED FOR SAMPLE RATE CONTROL. SEE DESCRIPTION FOR MORE DETAILS
ENTRY COUNTER=ENTRY_ DIV REGISTER
NO
YES
VAULE IS INVERSE FUNCTION TO ACTUAL MOTOR SPEED
FETCH THE AVERAGE DOOR SPEED
SPEED FLAG=1.
YES
NO
7 INCH/SEC. SETPOINT ESTABLISH TOLERANCE
10 INCH/SEC. SETPOINT ESTABLISH TOLERANCE
SET UPPER AND LOWER DUTY CYCLE LIMITS
SET UPPER AND LOWER DUTY CYCLE LIMITS
SETPOINT= AVERAGE_ VELOCITY
YES
NO
NO CORRECTION TO DOOR SPEED IS REQUIRED IF THE AVERAGE SPEED EQUALS THE SPEED SET POINT
PAGE 2
CALCULATE THE MAGNITUDE OF SPEED ERROR AND SIGN OF ERROR
IS ERROR GREATER THAN TOLERENCE
NO
YES
FETCH PWM GAIN CORRECTION VALUE
SPEED GREATER THEN SET POINT (SIGN=1)
YES
NO
DECREASE DUTY CYCLE TO DC MOTOR
INCREASE DUTY CYCLE TO DC MOTOR
CLIPPING LIMIT REACHED
YES
NO
SET DUTY EQUAL TO CLIP LIMIT

METHOD, SYSTEM AND APPARATUS FOR OPENING DOORS

This application is a continuation in part of PCT Application Serial No. PCT/US02/18441 filed Jun. 5, 2002, which is a continuation of and claims the benefit of U.S. patent application Ser. No. 09/875,799 field Jun. 6, 2001, now U.S. Pat. No. 6,624,605, the disclosures of which are incorporated herein by reference.

FIELD OF THE INVENTION

The present invention is directed to improvements in the area of powered door opening systems, methods and apparatus. The present invention has particular application for opening and closing garage doors.

BACKGROUND OF THE INVENTION

Mechanized door openers have become very prevalent in homes and many commercial establishments. These devices are designed to open the door upon receipt of a signal from a keyboard, horn, pressure of tires or footsteps on a sensor etc. Garage doors are a major market for many of these devices. Garage door openers have become ubiquitous in many communities. There are a number of problems with garage door openers, however. One of the problems with garage door openers is the issue of security. Until recently, many garage door openers had a limited number of security codes and as a result, there was a risk that someone other that the home owner could open the garage by using the same manufacturer's transmitter. In addition, the security code was typically permanently installed in the garage door opener and lost transmitters could give unauthorized persons access to the premises.

A second issue with respect to garage door openers is the issue of injury to persons and property in the closing of the doors. Government standards require that there be at least two method of determining whether there is an obstruction in the path of travel. One common approach is the use of a light beam that passes from one side of the opening to the other. If an object or person is present in the path of travel, the light beam is broken and the downward travel of the door is halted. Insofar as the second means of determining whether there is an obstruction present, there are a number of approaches on the market. On approach that has been used is to ascertain whether the speed of the closing door has changed. These methods measure the speed and compare it to a base figure obtained from previous unobstructed closings. If the closure is taking longer the opener concludes there is an obstruction and terminates closure. Other approaches are also currently available.

Garage door opener setup is another area that can create problems for the installer. Once the garage door opener is installed on the door then the door opener must be adjusted so that the door reaches the ground surface on closing thus eliminating any gaps to permit ingress of vermin, cold air, and debris. Similarly, adjustment is also necessary to make sure (1) that the garage door will reverse its direction upon contact with a person or an obstruction; and (2) that the garage door is not damaged on closing because it is hitting the ground. Also needed to be adjusted after installation is the force of closure. Too great a closing force can injure a person or damage the door upon closing.

OBJECTS OF THE INVENTION

It is an object of the present invention to provide a system for opening and closing doors particularly garage doors.

It is an object of the invention to provide a garage door opener that has a motor speed ramping function to provide a gradual increase in motor speed from stop to full opening speed of travel, or lifting speed to provide smooth opening of the door and a then slower or ramp down soft stop to prevent damage to the door and or the opener as the door is raised.

It is another object of the invention to provide a garage door opener that has a motor speed ramping function to provide a gradual increase in motor speed from stop to full closing speed of travel, to provide smooth safe movement of the door to overcome inertia, and then to provide a "soft stop" door closure.

It is an object of the present invention to provide improved security for communication between the motor control unit and a handheld RF operational control unit and/or the RF linked operational control unit that is mounted on a structure.

It is an object of the present invention to provide a garage door opener with an indoor panel functioning both as a control unit and a diagnostic information unit.

It is another object of the invention to provide a garage door opener with an indoor control panel designed in a modular fashion to provide control for two or more garage door openers.

It is a further object of the invention to provide a garage door opener with a keyless entry panel that will control two or more individual openers even when the openers are placed in the vacation mode.

It is a still further object of the invention to provide a garage door opener with an indoor control panel that connects to "off the shelf" motion sensors that cause an opener's built in lights to illuminate when motion is sensed.

It is an object of the invention to provide a garage door opener that has an improved means to control motor power thereby controlling motor speed, utilizing a pulse width modulation technique.

It is an object of the invention to provide a garage door opener that has an improved means of controlling door movement for the purpose of detecting any obstructions, a "locked" door condition, and sensitivity of impact, utilizing a Hall pulse circuit integral with the motor.

It is another object of the invention to provide a garage door opener that has an improved means of detecting garage door out of balance conditions by utilizing an analog-to-digital technique to monitor the changes in motor current and extrapolating out of tolerance torque of the motor.

It is a further object of the invention to provide a garage door opener that has both an audible and visual signal to provide a warning when an out of balance garage door condition exists.

It is a further object of the invention to provide a garage door opener that has a provision for connection to a PC computer's communication port to monitor both operational and fault data while the garage door is in motion. The data includes as a minimum, instantaneous door speed, average door speed, duty cycle of the pulse width modulation circuit, motor torque, and fault indications.

It is a further object of the invention to provide a garage door opener that has a provision for connecting to an external microprocessor memory programmer for the purpose of directly installing the operational microcode software.

SUMMARY OF THE INVENTION

The present invention is directed to an improved garage door opener. More and more homes these days are provided with two or three garage doors. Garage door openers operate a single garage door. In applications where there is more than one garage door, the homeowner has to install multiple garage door openers and their respective control panels. With traditional garage door openers, each door opener had to have separate wiring extending from each garage door opener to their respective wall panel located in the garage. Running the wiring for this arrangement was time consuming and required running the wire from each opener to its respective control panel usually along one or more walls to the wall panel. In the present invention a second garage door opener can be wired directly to a first garage door opener and the second wall mounted control panel can be connected directly to the wall panel for the first garage door opener.

The garage door of the present invention is provided with a first microcontroller in the wall panel and a second micro controller in the drive unit. Each microcontroller has a digital serial data bus and is connected by preferably three wires because of the volume of date that is transferred from microcontroller to microcontroller. A first wire is typically a return ground wire. The second wire is used for data transfer. The third wire is for a clock. In accordance with the present invention, there may be multiple up to three drive units, i.e., openers, or wall units that may be connected together. This permits the homeowner to locate the wall units at more than one location in the garage for additional convenience.

The garage door opener of the present invention also permits the door speed to vary during operation. One of the issues with many current garage door openers is the amount of time it takes the door to open and close. The present invention permits the door to open and close rapidly until a preselected distance from the end of travel is reached. For example, the garage door of the present invention operates downwardly at a higher rate of travel until a selected point is reached. At that point, the control logic signals the motor to ramp down to slow the door so that the door does not impact the floor of the garage with a great force thereby risking damage to the door. Similarly, when the door is rising, the door initially ramps up to a higher rate of speed until a preselected distance from the end of door travel is reached. When that preselected distance is reached the control logic signals the motor to slow the door so that the door does not damage the garage door opener. For downward travel the preselected point for slowing the door can be any distance from the floor, however, a distance of about 18" has been found satisfactory. For the travel of the door when it is opening, any distance may be selected. Usually about 12" from the termination point has been satisfactory. The microcontroller of the present invention controls the motor speeds and constantly calculates where the door is and compares it to a figure in memory. When the appropriate location is reached, the microcontroller signals the motor to slow down by changing the duty cycle of the pulse width modulation circuit.

The drive unit of the garage door opener of the present invention is provided with a Hall Effect sensor internal to the motor. The microcontroller counts the Hall generated pulses which indicate the revolutions of the belt's drive gear thereby knowing where the door is. This permits the microcontroller to learn when to stop the door and when to slow it down if there is a problem with the speed of the door, i.e., if there is binding of the door in the tracks, an obstruction present, a drop in the line voltage or if there is a mechanical problem such as a broken spring, wheel, etc.

The garage door opener of the present invention may also have a drive motor with an improved self-locking mechanism. The method of the present invention utilizes a motor that can cause the door to open at a rate in excess of 14 inches per second and at the same time provide a self-locking torque to keep the door from being forced open when the door has reached the end of travel and the power to the motor is removed. If the light beam is impeded the microcontroller will cause the door to cease its downward travel and reverse its direction of travel. Power to the motor will remain on until the door reaches its fully opened position.

In another embodiment of the present invention the outdoor keypad of the opener may be provided with a switch to turn on or off the light in the opener in the garage.

In a still further embodiment of the invention the door speed changes are measured based on an algorithm that utilizes the door's velocity and door acceleration/deceleration. This algorithm dynamically adapts to the door's movement and can distinguish between a door obstruction and normal door movement such that only a soft (small) force is applied to an obstruction until the door is first stopped and reversed. This force is automatically adjusted to accommodate all types of doors. In this manner, this embodiment provides for a unique safety feature should a child or animal get caught under a closing door. This calculation is made approximately every 1/10 of an inch of door travel during operation and compared to the tolerance window. The tolerance window that is created is also updated preferably about every 1/10 of an inch of door travel. If there is an obstruction, the number will be outside the tolerance window and the opener will cease or reverse movement of the door depending on direction.

In another embodiment, there may be an outdoor keypad usually placed on the outside wall of the garage or other structure. This outdoor keypad is able to control two doors. There is a user password that preferably has eight digits instead of the usual four digits. Typically, there are three different passwords, a primary, a secondary and an override. The primary password enables a person to change the settings on the keypad. The override password is used to override the vacation lock.

In still another embodiment of the invention, the door speed is maintained by the pulse width modulation circuit during low and high line input voltages and tolerance values of the electronic circuit components. This is accomplished via the "closed loop" feedback system of the unique motor drive and software sensing of the door's velocity.

BRIEF DESCRIPTION OF THE DRAWINGS

FIG. 14 is a schematic showing the smooth ramping down of the door from current speed to a complete stop.

FIGS. 23 and 24 are schematics showing the main door speed control loop

DETAILED DESCRIPTION OF THE INVENTION

Figure 1:
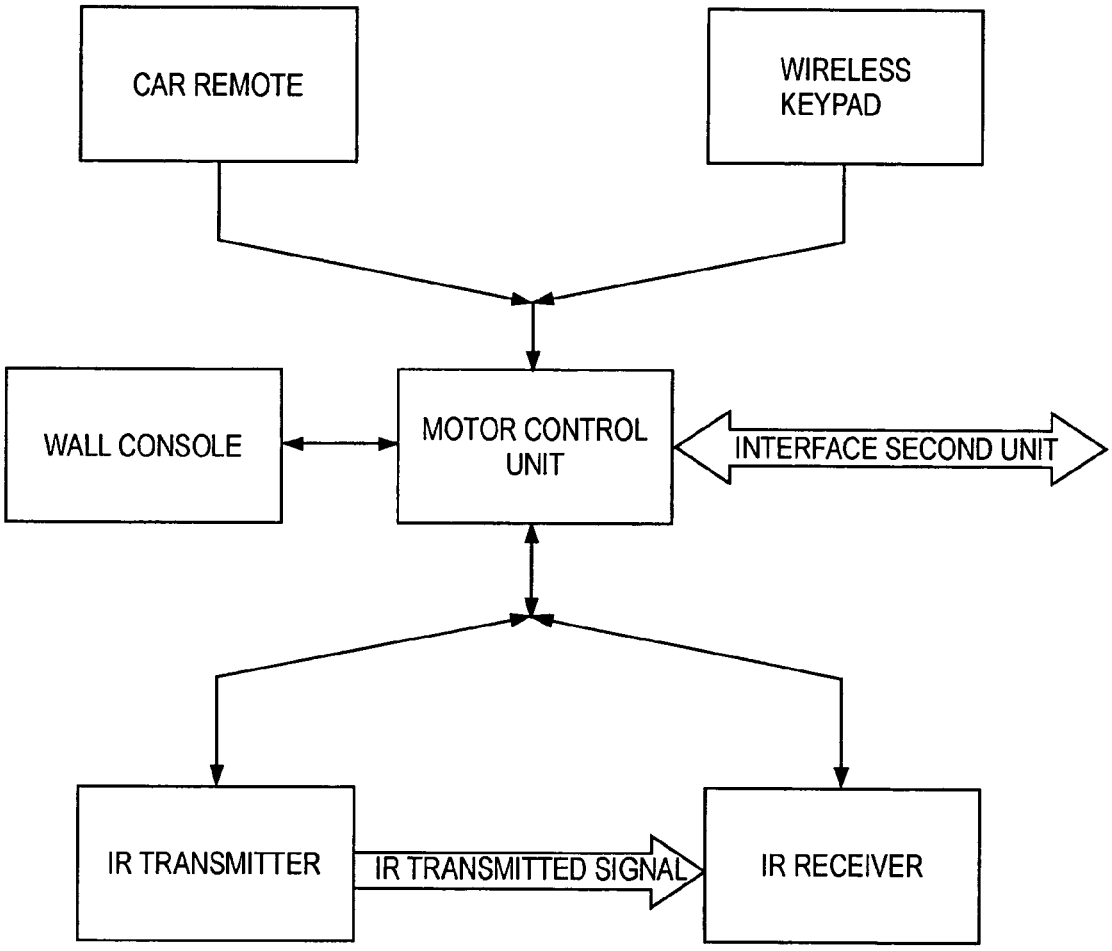
FIG. 1 is an example of a door system used to operate a door in accordance with the present invention.

The present application relates primarily to overhead doors i.e., doors that are raised to open them as opposed to doors that swing open and shut. Doors that have particular applicability for the present invention are garage door that ride on a track. The preferred doors of the present invention are typically provided with a plurality of rollers that are attached on either side of a door. The rollers ride in tracks that guide the door as it is opened and closed. These tracks are attached to the frame of the structure. The doors are raised and lowered by a mechanical garage door opener. An example of an apparatus for opening and closing a garage door is shown in co-pending U.S. patent application Ser. No. 09/875,794, filed Jun. 6, 2001, U.S. patent application Ser. No. 09/875,799, filed Jun. 6, 2001, and U.S. Design patent application Ser. No. 29/143,216 filed Jun. 6, 2001, the disclosures of which are incorporated herein by reference. It will be appreciated by those skilled in the art that the present invention can be used with other types of garage door openers or with other mechanisms for opening an overhead door, such as a security door and others.

The operation of the garage door of the present invention is described with respect to the preferred embodiment as follows:

The garage door opener of the present invention has a motor control unit that operates the motor for raising or lowering the door. The motor control unit has a microcontroller, preferably a "PIC" microcontroller, one or more control switches and a photo detector. The photo detector may detect breaks in a beam of any type of light including visible, infrared, etc. The motor control unit may also be provided with a motor speed sensor, a light device, and/or a sound device. The motor control unit receives control data and initiates a corresponding motor, light and/sound action.

One of the sources of data for the motor control unit is the operational control unit or wall console. This unit is typically mounted on a wall of the structure that has a door to be opened. This wall unit is preferably hardwired to the motor control unit. The wall unit has a microcontroller, preferably a "PIC" microcontroller, one or more panel switches, one or more indicator means and a connection for a motion detector.

Another source of data for the motor control unit is the wireless keypad. The keypad has a microcontroller, preferably a "PIC" microcontroller. The keypad may also have keypad switches and a panel light.

Control Panel and Program Set Up

Upon first power-up of the garage door opener system it will preferably be non-initialized and in the Manual/Learn mode. Non-initialized is the condition where the opener has no stored travel or force values. The lights will flash and remain on for a period of time such as 5 minutes and in a preferred embodiment, the audible alarm will sound. In addition, the Wall Unit "Safety" LED will momentarily flashon and then turn off. All adjustments are performed using the three program buttons located on the head unit.

Initializing Door Travel

Before the door travel can be adjusted, it is necessary to move the belt trolley to a position so that the door arm can be attached to the door. The trolley can be moved manually by depressing either the "+" or "−" buttons on the head unit. The "+" button moves the door towards the closed (down) position and the "−" button moves the door towards the open (home) position. Either button must be held down for preferably about ½ second for the system to react.

The door may continue moving until the buttons are released. If the door encounters a binding or obstruction condition, which stops its travel, the system will turn off power to the motor. This condition must be corrected before the door can be manually moved again.

Once the door arm is attached to the door in its maximum closed position activate the system by depressing the "UP/DOWN" button on the Wall Unit. The door will start in the up direction until the "Home" Switch is reached.

The Wall Unit "UP/DOWN" switch is the method of activating the door when the opener is in a non-initialized state. Once the door stops, double check its travel by again activating the Wall Unit "UP/DOWN" switch. The door should return to its initial down starting position. Holding down either the "+" or "−" button will no longer move the door. When depressing the "+ or −" buttons the door travel will be changed by preferably about 3/16 inch for each depression of the button, and this change will take place on the next door movement cycle.

The opener has now learned its travel. If travel or force adjustments must be made, please refer to the next section.

The system may be reset into its original Non-Initialized state by:

Re-Initializing Door Travel

Momentarily remove power to the unit by pulling out the AC line cord, and then reinsert the line cord into the AC supply with the "PROG" button held depressed. The audible alarm will sound and then release the "PROG" button. When this is complete, the system is now reset and ready to repeat the initialization procedure.

Force Adjustments

All adjustments can be preformed from the three program buttons located on the unit.

Adjusting the Force

Force adjustments control the amount of power needed to open and close the door. The opener is designed to stop the door in the up direction if anything interferes with its travel. Likewise, the door will reverse and return to the home position if anything interferes when it is moving in the down direction. This includes binding or an unbalanced condition.

It should be noted that the force should not be set too light because this could lead to unnecessary stops or reversals.

In order to program the new garage door opener's open and close force limits it is necessary to enter program menu. The program menus settings are as follows. The audible alarm will sound with each step with each depression of the PROG button.

First Depression: Up Force adjustment

Second Depression: Down Force Adjustment

Third Depression: Car Remote Transmitter programming

Forth Depression: Exit program mode (alarm will sound twice)

Up Force Adjustment: Depress the PROG button once to enter this mode and then depress either the "+" or "−" buttons for adjustment. To complete the operation, depress the PROG three more times to store the value and exit the adjustment mode.

Down Force Adjustment: Depress the PROG button twice to enter this mode and then depress either the "+" or "−" buttons for adjustment. To complete the operation, depress the PROG two more times to store the value and exit the adjustment mode.

The opener should be run through a complete cycle, open/close after each adjustment.

Wall Unit

The Wall unit indicates difficulties during use of the garage door opener as well as controlling the opening and closing of the garage door.

Programming Car Remote

The garage door opener is usually provided with two start-of-the-art Car Remote Transmitters. Each transmitter has the ability to operate up to three drive units.

Depress the PROG button located on the head unit three times to enter this mode and then depress the "+" button to enter the LEARN mode.

Depress any Car Remote Transmitter button twice. Pause in-between presses.

To complete the operation, depress the PROG button once.

Initiate door travel by depressing the button just programmed. Hold the button depressed until door begins to move. If door does not function, re-program the button carefully following the instructions above. If door still does not function, call the customer service line.

Operation of the Garage Door Opener

The garage door opener can be activated (operated) using the following acc

Wall Unit

Car Remote Transmitter

Wireless Keypad (Optional)

Motion Sensor (Optional—Only turns on lights)

Operating the Garage Door Opener Via the Car Remote Transmitter

Depress the button that has been previously "programmed" and hold until door begins to move and then release button.

If necessary the garage door may be stopped and restarted via your "programmed" Car Remote Transmitter button.

Operating Your Garage Door Opener Via the Wall Unit

Depress and hold the main motor control button on the Wall Unit until door begins to move.

Release the main motor control button. The opener may be stopped and restarted via this main motor control button.

Audible Alarm (System Enunciator)

The garage door opener may have an integrated safety enunciator, which will sound whenever the system encounters impedance to door movement. Depress the enunciator button on the Wall Unit to stop the enunciator from sounding.

Vacation Lock Mode

The garage door opener may have the capability to be put in a vacation lock mode. When activated, the vacation lock mode disables the Wall Unit and Car Remote Transmitters from opening the door. The only means of opening the door is via the optional Wireless Keypad (when supplied), or by disabling the vacation lock using the VACATION LOCK button located on the Wall Unit.

To initiate vacation lock, depress the VACATION LOCK button located on the Wall Unit.

The VACATION LOCK LED will illuminate when in use.

To disable the vacation lock, depress the VACATION LOCK until the VACATION LOCK LED is extinguished.

Light On/Off

The garage door opener preferably has an internal light fixture, which can be manually operated via the Wall Unit. Normally the lights will automatically illuminate whenever the opener is activated to either open or close the door. The lights stay on for preferably about 5 minutes. The LIGHT button, located on the Wall Unit will override the automated feature.

Depressing the LIGHT ON/OFF button on Wall Unit will toggle the internal lights located on the drive unit. When the lights have been manually turned on the automatic light timer is disabled. To turn the lights off, depress the LIGHT ON/OFF button AGAIN.

Optional Motion Sensor

The garage door opener can interface with a motion sensor by plugging in the male telephone jack into the correct female socket located on the Wall Unit. The corresponding Wall Unit socket is marked via a motion sensor icon. After the connections are made the motion sensor is now active; any movement in front of the sensor will turn on the lights in the drive unit. The system resets after preferably about 5 minutes, but will stay on if movement is present.

I. Door Opener (GDO) System 1.0 Functional Requirements

The GDO system (FIG. 1) is preferably used to operate a garage doors with the following requirements:

- The system may operate 1 or 2 or more doors independently of each other using either one indoor control panel or one outdoor keypad control panel or any one of a number of car remote control units.
- The opening speed of the doors being controlled should operate at speeds of travel in excess of preferably about 14 inches per second of travel.
- The system should operate a light and a sound device for each door connected to the system.
- The light device may be activated for each door movement and remain active for a minimum of preferably about 4–5 minutes.
- The sound device may be activated to indicate a failure with the door movement and preferably remain active until an operator interaction.
- The system should monitor the door movement and prevent any door movement should the door encounter any obstruction or should a speed change indicate a door binding condition.
- The system shall monitor the door run count vs. time and prevent excessive motor operation within a preset time period.

The following specifications typically apply to the system of the present invention but are not limited thereto:

1. No door operation should take place without an operator action.
2. A setup procedure is normally needed after initial installation before proper door operation can be realized.
3. No Door Motor action should be taken at power up.
4. The Wall Unit should communicate with the Drive Unit using a bi-directional serial bus.
5. Both the handhold RF linked Operational Control unit and the RF linked Operational Control unit should incorporate a secure data transmission link to the Motor Control unit.
6. The system should provide for configuration of preferably 2 Wall Units and 2 Drive Units.

II. Motor Control Unit (MCU) Operating Specifications 1.0 The Motor Control Unit shall receive control data and initiate a corresponding motor, light or sound action.

2.0 Software Operating Requirements

A "PIC" micro controller shall perform the interfacing and control functions between an "HCS500" decoder device, an Indoor console panel and all the Sensors, Switches, Lights, Indicators and Motor relay needed for proper door operations.

3.0 The Following Preferred Specifications Apply:

1. The "PIC" micro controller has internal non-volatile memory.
2. The "PIC" micro controller has No Sleep mode.
3. No operator interaction routine is needed for the "PIC" micro controller at power up.
4. A LIGHT device shall be incorporated in the Motor Control unit.
4. Linking each RF Operational Control unit to the Motor Controller shall require a "LEARN" procedure to be completed for each RF transmitter unit.
5. Pwr down shall not effect any Transmitter "LEARNED" code, Travel or Door Force setting data held in memory.
6. No Door Motor action shall be taken at power up.

4.0 Hardware Configuration

1.) A "PIC" micro controller
2.) A set of control switches
3.) A Photo Detector.
4.) A motor speed sensor
5.) A light device
6.) A sound device 5.0 I/O Configuration

TABLE 5.1

| Inputs (qty) | Purpose |
|---|---|
| 1. Travel Limit SW (1) | active LO signal indicating the door in the full back position. |
| 2. Program Button (1) | used to place Controller into program mode. |
| 3. Plus (+) Button (1) | used in conjunction with program button |
| 4. Minus (–) Button (1) | used in conjunction with program button |
| 5. Infrared Det (1) | Active LO signal indicating the presence of an obstruction in the path of the door. |
| 6. Speed Sensor (1) | pulses indicating the speed of the door motor. |
| 7. Address SW (2) | used to set Controller "Talk/Listen" serial data address. |
| 8. Current Sensor (1) | monitors motor current usage for door balance detection. |

TABLE 5.2

| Outputs (qty) | Purpose |
|---|---|
| 1. Motor Relay (1) | signal controlling the direction of the door motor. |
| 2. PWM Control (1) | signal controlling the motor speed voltage |
| 3. Light Relay (1) | signal controlling the power to an incandescent light. |
| 4. Sound Relay (1) | signal controlling the power to a sound device. |

TABLE 5.3

| Bi-directional (qty) | Purpose |
|---|---|
| 1. Serial Data (1) | Send/Receive serial data from the Indoor Console. |
| 2. Clock Signal (1) | Sync signal used in conjunction with Serial Data. |
| 3. Serial Data (1) | receive serial data from the HCS500 decoder. |
| 4. Clock Signal (1) | sync signal used in conjunction with Serial Data. |

6.0. Button Operation

Operator interaction is required to initialize the software program for proper operation.

6.1 Program Button

This button is used to toggle the software through the three operational adjustment modes.

Mode Function

1. Force up adjustment
2. Force down adjustment
3. Remote Transmitter Learn/Un-Learn command initiation 6.2 Plus (+) Button In mode 4 this button is used to adjust the door position forward. One depression shall equal preferably about 0.1 inches of total door travel.

If the button is held depress for preferably about 2 seconds, the door will start moving forward until the button is released.

In mode 1 and 2 (section 6.1), this button shall increment the corresponding adjustment. In mode 3 this button shall initiate the Learn command.

6.2 Minus (−) Button

In mode 4 this button is used to adjust the door position back. One depression shall equal preferably about 0.1 inches of travel.

If the button is held depress for preferably about 2 second, the door will start moving back until the button is released.

In mode 1 and 2 (section 6.1), this button shall decrement the corresponding adjustment. In mode 3 this button shall initiate the Un-Learn command.

7.0 Door Travel, Door Force and System Failures 7.1 Door Travel 7.1.1 Full Door travel speed shall be defined at preferably about 14"/sec. Half Door travel speed shall be defined at preferably about 7"/sec.

7.1.2 Door travel shall be monitored using a Hall device sensor at a rate of preferably about 32 times for 3.14" of door travel (once every 0.1"). One (1) monitoring interval is defined as 1/32 of 3.14" door travel.

7.1.3 Door motor control voltage is adjusted to maintain speed to within preferably about 5% of target.

A door speed deviation factor of preferably about +5% & −5% has been incorporated in the speed checking routine.

7.1.4 From initial door start to preferably about 1.07" of travel, an average speed value shall be calculated and shall be used to calculate an "out of speed" door condition.

7.2 Door Force

The operator force adjustment factor for both forward door travel and reverse door travel shall be in increments of preferably about 1% of door speed travel.

7.2.1 The reverse door travel adjustment factor is defined as the UP Force.

The forward door travel adjustment factor is defined as the Down Force.

7.2.2 Door speed Tolerance is defined as the sum of door speed deviation factor plus either the UP Force factor or the Down Force factor.

$$\text{Tolerance}=\text{Speed Deviation}+\text{Force Factor}$$

This Tolerance is calculated at motor start and is depended on the door direction.

7.3 System Failure 7.3.1 Door Speed Failures (Obstructions & Lock Door)

An "in tolerance" condition is defined as door travel which is within the Door travel tolerance define in section 7.2.2 for one (1) monitoring interval. An "out of tolerance" condition is defined as door travel which is not within the Door travel tolerance define in section 5 for one (1) monitoring interval.

7.3.2 At Door start up is defined as the period FROM the time power is applied to the door drive motor TO the time the door has traveled one monitoring interval. At motor power up time a failure situation is triggered if no speed pulse is detected within 64 milliseconds of applied voltage. This situation is classified as a "Lock door" condition.

7.3.3 After this door start up time, up to two (2) continuous "out of tolerance" conditions can be recorded before a door failure situation is triggered. After the second monitoring interval, a door error conditions will occur if only one (1) additional monitoring interval is "out of tolerance". From the end of door start up time to normal door shut time only one (1) "out of tolerance" conditions can be recorded before a door failure situation is triggered.

7.3.4 Secondary Failure

A signal from an IR detector shall be checked at every monitoring interval define in section 7.2.1. Should this signal indicate an un-safe condition an IR failure situation shall be triggered.

8.0 Terminal Handshaking and Data Transfer 8.0 This section describes the method for terminal handshaking and data transfer among the terminals connected to the Garage Door Opener System.

Figure 2:
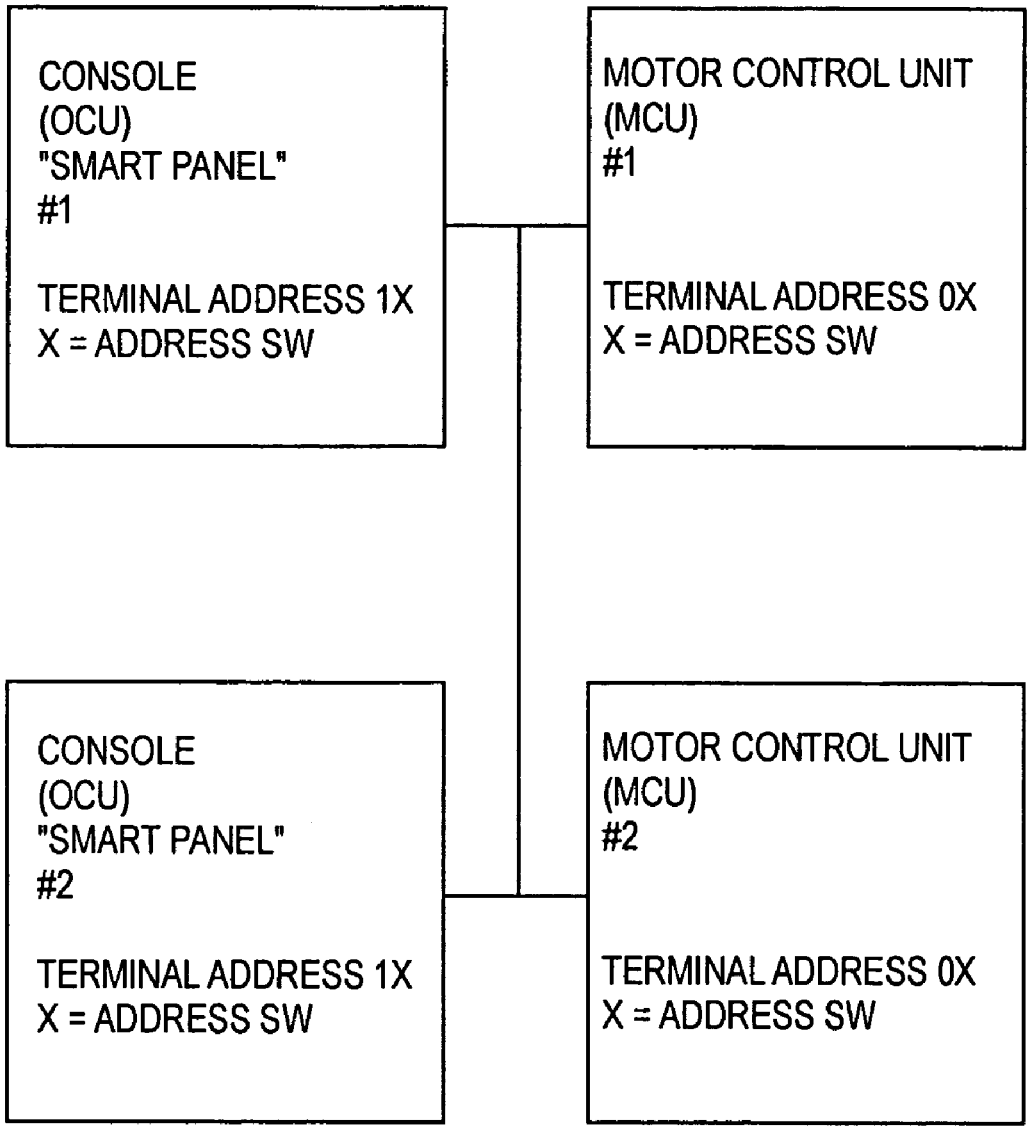
FIG. 2 shows a schematic for terminal handshaking and data transfer among terminals connected on a bus.

A "terminal" shall be defined as any unit connected to the common data bus of the Garage Door Opener System. (FIG. 2)

A "common data bus" ("bus") shall consist of one wire to carry data ("data line") and one wire to carry a synchronous clock signal ("clock line") among the terminals connected on the bus.

8.1 Standby 8.1 In a standby condition the data line shall be at a low voltage level and the clock line shall be at a high level.

Any terminal connected to the bus shall force the data line to a low level using its internal circuitry.

Any terminal connected to the bus shall allow the clock line to remain at a hi impedance state using its internal circuitry. An external circuit shall keep the clock line at a high level.

8.2 Bus Request 8.2.1 If any terminal connected to the bus initiates a request to send data to any other terminal on the bus the terminal initiating the request shall bring the clock line to a low level.

8.2.2 The terminal initiating the request shall wait for the other terminals on the bus to acknowledge the request. The request is acknowledged by the other terminals bring there data line to a hi impedance state. An external circuit shall bring the data line to a high level if all the other terminals acknowledge by bring there data line to a high impedance state.

8.2.3 Once all the terminal acknowledgments are recognized, the terminal initiating the request shall proceed to transfer data to the terminals connected on the bus.

8.3 Data Transfer 8.3.1 The terminal initiating the request shall set the data line to the level that reflects the level of the first bit of data needed to be transferred. The terminal initiating the request shall next set the clock line to a high level for 50 us which will signal all the other terminals that a valid data bit condition is present on the data line. The terminal initiating the request shall then bring the clock line back to a low level for 50 us. (FIG. 2)

8.3.2 Step 8.3.1 shall be repeated until all data bit are transferred to all other terminals on the bus.

8.4. Serial Data Layout 8.4.1 Eight (8) data bits may be used in the terminal data transfer. Two (2) data bits (bit 0,1) may be assigned for terminal addressing and preferably about six (6) data bits (bits 2–7) shall be assigned for data information.

8.4.2 Preferably two (2) motor controller units (MCU) and two (2) operational control units (OCU) can be connected to the Garage Door Opener System bus.

8.4.3 Terminal addressing shall be assigned as follows:

The motor controller units . . .

bit 1 shall always equal 0 bit 0 shall be either 0 or 1 (depending on the address switch position set on the MCU circuit card).

(Address=1×).

The operational control units. . .

bit 1 shall always equal 1 bit 0 shall be either 0 or 1 (depending on the address switch position set on the OCU circuit card).

(Address=0×).

TABLE 8.1

| Terminal | MCU 1 | MCU 2 | OCU 1 | OCU 2 |
|---|---|---|---|---|
| Address* (Bit 1, 0) | 00 | 01 | 10 | 11 |

(*w/address sw set for 4 terminal operation)

| Value(h) | Command |
|---|---|
| Received* Data Word Assignments (Bits 2–7) | |
| 1 | no assignment |
| 2 | on/off door action |
| 3 | toggle Lock function |
| 4 | sound off command |
| 5 | light on command |

TABLE 8.1-continued

| Send* Data Word Assignments (Bits 2–7) | |
|---|---|
| 1 | activate Safety led |
| 2 | unused |
| 4 | activate Photo |
| 8 | activate LoBattery |
| 10 | activate Lock |
| 12 | activate Sound Off |

(*note: MCU)

9.0 MCU Software

The MCU software described in this section will be loaded into a MicroChip PIC16F73 device. This device has 4K(×12) bytes of user program memory.

9.1 Program Routines

| Main | Purpose |
|---|---|
| 1. Init | load/set all program operating parameters |
| 2. Main Loop | program flow control |
| 3. Motor | main motor control service routine |
| 4. Light | control light on/off timing |
| 5. Sound | control sound on/off timing |
| 6. Console Listen | used to take data from OCU |
| 7. Console Talk | used to send data to OCU |
| 8. Remote(HSC500) Listen | used to take data from HSC500 |
| 9. Remote(HSC500) Talk | used to send data to HSC500 |
| 10. Motor_On | turns motor on |
| 11. Motor_Off | turns motor off |
| 12. Spd_Delta | controls motor high/low speed |
| 13. Reverse (travel) | door directional control |
| 14. Button | takes data from operational buttons |
| 15. PWM | controls motor drive voltage |
| 16. ADC | monitor motor current |

| SubRoutines | Purpose |
|---|---|
| 1. Time delays | controls time delays within routines |
| 2. ComInit | prepares data for console |
| 3. RemInit | prepares data for HSC500 |
| 4. Process data | translates data rec'd from console or HSC500 |
| 5. Dev_force | calculates motor deviation spec |
| 6. Force_tol | adjust motor force tolerance |
| 7. New_Position | tracks door position |
| 8. USART | controls data output for cpu |

Figure 3:
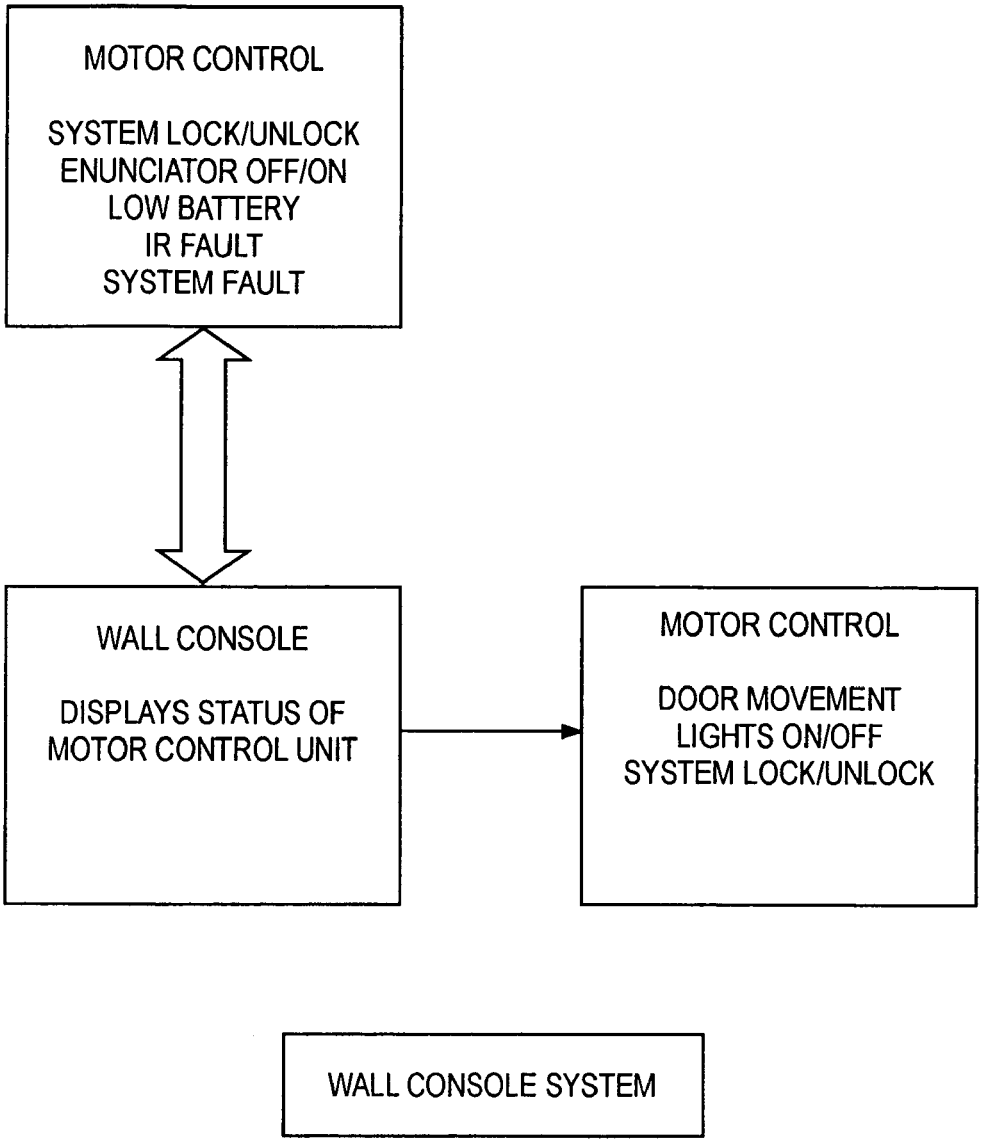
FIG. 3 is a schematic showing the Hardwired Operational Control Unit.

III Operational Control Unit, Wall Console (OCU) Specifications 1.0 The Hardwired Operational Control (FIG. 3) Unit shall allow an operator to send commands to the Motor Control Units (MCU). The following specifications apply for an single OCU. Should a double OCU unit replace the single unit then this specifications apply for each OCU section of the double OCU.

2.0 Software Operating Requirements

A "PIC" micro controller shall perform the interfacing and control between the Motor Controller and the console panel switches, indicators and an optional motion detector.

3.0 The Following specifications apply:

3.1 The console has no internal non-volatile memory.

3.2 The console has No Sleep mode.

3.3 No operator interaction routine is needed for the "PIC" console at initial power up.

4.0 Hardware Configuration
1.) A "PIC" micro controller
2.) Panel switches
3.) Indictor
4.) Motion detector 5.0. I/O Configuration

TABLE 5.1

| Inputs (qty) | Purpose |
|---|---|
| 1. Up/Down Button (1) | Used to signal a door movement. |
| 2. Lock Button (1) | Used to disable (lock) the Motor Controller. |
| 3. Sound Button (1) | Used to disable the sound device. |
| 4. Light Button (1) | Used to turn toggle door light. |
| 5. Motion Sig | Used to detect area motion. |
| 6. Address SW (1) | Used to set Console Talk/Listen serial data address. |

TABLE 5.2

| Outputs (qty) | Purpose |
|---|---|
| 1. Lock LED (1) | Used to indicate to Lock status. |
| 2. Fault LED (1) | Used to indicate to door operational fault. |
| 3. LO Bat LED (1) | Used to indicate to a LO battery condition. |

TABLE 5.3

| Bi-directional (qty) | Purpose |
|---|---|
| 1. Serial Data (1) | Send/Receive serial data from the Motor Controller. |
| 2. Clock Signal (1) | Sync signal used in conjunction with Serial Data. |

6.0. Button Operation 6.1 Up/Down Button
This button shall send a door operation command to the MCU. The operation command shall toggle the current door movement (stop/run).

6.2 Light Button
This button shall turn the MCU light on.

6.3 Lock Button
This button shall prevent any door action.

6.4 Sound Button
This button shall turn the MCU sound device off.

7.0 OCU Software
The OCU software described in this section will be loaded into a MicroChip # PIC16C55 device. This device has 512(×12) bytes of user program memory.

7.1 Program Routines

| | Purpose |
|---|---|
| Main | |
| 1. Init | load/set all program operating parameters |
| 2. Main Loop | program flow control |
| 3. Listen | used to take data from MCU |
| 4. Talk | used to send data to MCU |
| 5. Display | used to translate rec'd data to LED |
| SubRoutines | |
| 1. Time delays | controls time delays within routines |
| 2. Com Init | prepares data for console |

IV Remote Operational Control Unit, Keypad (ROCU)

Figure 4:
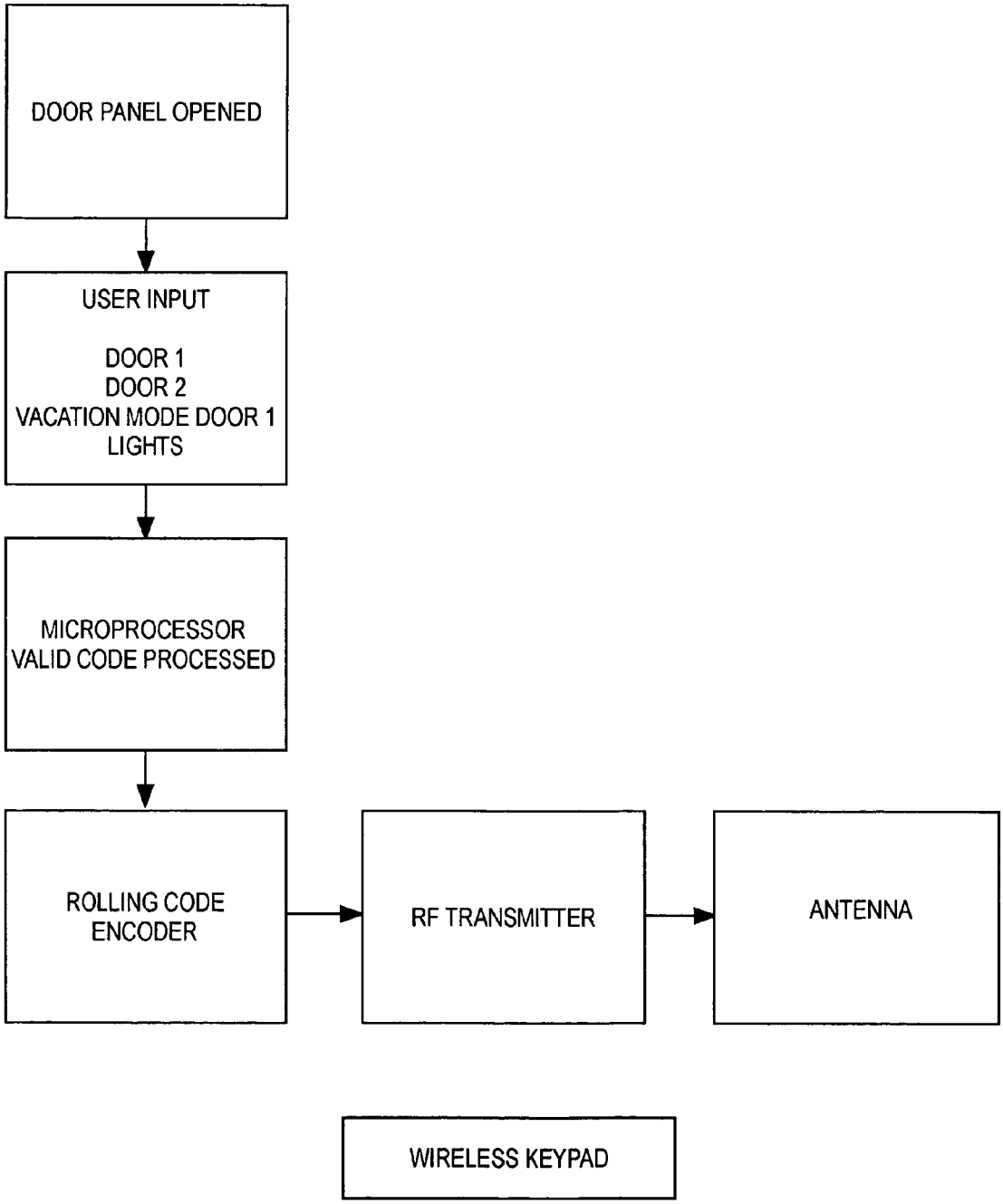
FIG. 4 is a schematic showing the RF Linked Operational Control Unit that allows an operator to send commands to the Motor Control Unit (MCU).

1.0 The RF Linked Operational Control (FIG. 4) Unit shall allow an operator to send commands to the Motor Control Units (MCU).

2.0 Software Operating Requirements

A "PIC" micro controller shall perform the interfacing between an 12 button keypad, a LED device and a data transmitting circuit needed to send keypad information to the Door Motor Controller.

2.1 The Following Specifications Apply:

2.1.1 The Keypad micro controller shall contain all the software needed to interface with the operation of a HCS201 encoder device.

2.1.2 The Keypad encoder shall contain a Serial # code and a Manufacture's ID code used for secure transmitter/receiver link operation.

2.1.3 The Keypad micro controller shall contain non-volatile memory. All operational access codes shall be retained on power down.

2.1.4 The Keypad micro controller shall self activates into a "Sleep" mode (refer section 5.0) after 10 seconds of keypad inactivity (only after initial access code programming is complete, refer section 6.0). The micro controller shall return to a "Wake" mode by the operation of the any keypad button and shall be indicated by an active LED device.

2.1.5 A blinking LED device shall indicate a Keypad micro controller without any valid access code programming. A constant on LED device shall indicate a Keypad micro controller with a valid access code.

3.0 Hardware Configuration
1.) A "PIC" micro controller
2.) Keypad switches
3.) Panel Light 4.0. I/O Configuration

TABLE 4.1

| Inputs (qty) | Purpose |
|---|---|
| 1. Row switches (4) | Used to determine depressed switch identity. |

TABLE 4.2

| Outputs (qty) | Purpose |
|---|---|
| 1. Column signal (4) | Used in conjunction with Row switches. |
| 2. Operational Light (1) | Used to indicate keypad status. |
| 3. Serial Data (1) | Send/Receive serial data from the "HCS201" encoder. (refer to section 9.0 for details) |
| 4. Clock Signal (1) | Sync signal used in conjunction with Serial Data. |

5.0 Sleep/Wake Operation

The ROCU shall operate in two (2) modes.

5.1 Mode 1 shall be defined as "sleep". The ROCU shall draw minimum current and shall not respond to any keypress operation. Mode 1 shall only be activated after a period of no keypress activity for preferably about 10 seconds regardless of the ROCU panel door position.

5.2 Mode 2 shall be activated with the operation of the any ROCU keypress. Mode 2 shall be defined as "wake". The Rocu shall operate at normal current draw and shall respond to any/all keypress operations.

6.0 Code Programming

The ROCU shall require an initialization routine for proper operation.

This routine consists of the entry of an "owner/operator" password which is stored in non-volatile memory.

A password shall be defined as preferably a set of one (1) to a maximum of eight (8) numeric digits entered consecutively followed by the depression of the "light" key.

7.0 Button (Keys) Operation & Lights Keys 7.1 "Light" key:

This key will initiate a "turn light on" command to the MCU if depressed prior to any other key.

This key will terminate a password code programming sequence if depressed as the final key in the sequence.

7.2 Numeric (0–9) Keys

These keys are used to enter the password code.

7.3 The "R" and "L" Keys

This key shall initial a "door movement command" if depressed following the depression of a set of numeric keys*.

(*Note: The set of numeric keys depressed must match a store set of numeric keys held in memory.)

8.0 ROCU Software (Keypad)

The ROCU software described in this section will be loaded into a MicroChip # PIC16F84 device. This device has 2 K (×12) bytes of user program memory.

8.1 Program Routines

| | Purpose |
|---|---|
| Main | |
| 1. Init | load/set all program operating parameters |
| 2. Main Loop | program flow control |
| 3. Keypress | used to translate keypress to ROCU commands |
| 4. Talk | used to send data to HSC200 |
| 5. Save | used to save password info to memory |
| 6. Retrieve | used to retrieve password info from memory |
| SubRoutines | |
| 1. Time delays | controls time delays within routines |
| 2. Validation | handles password validation |

EXAMPLE

Figure 5:
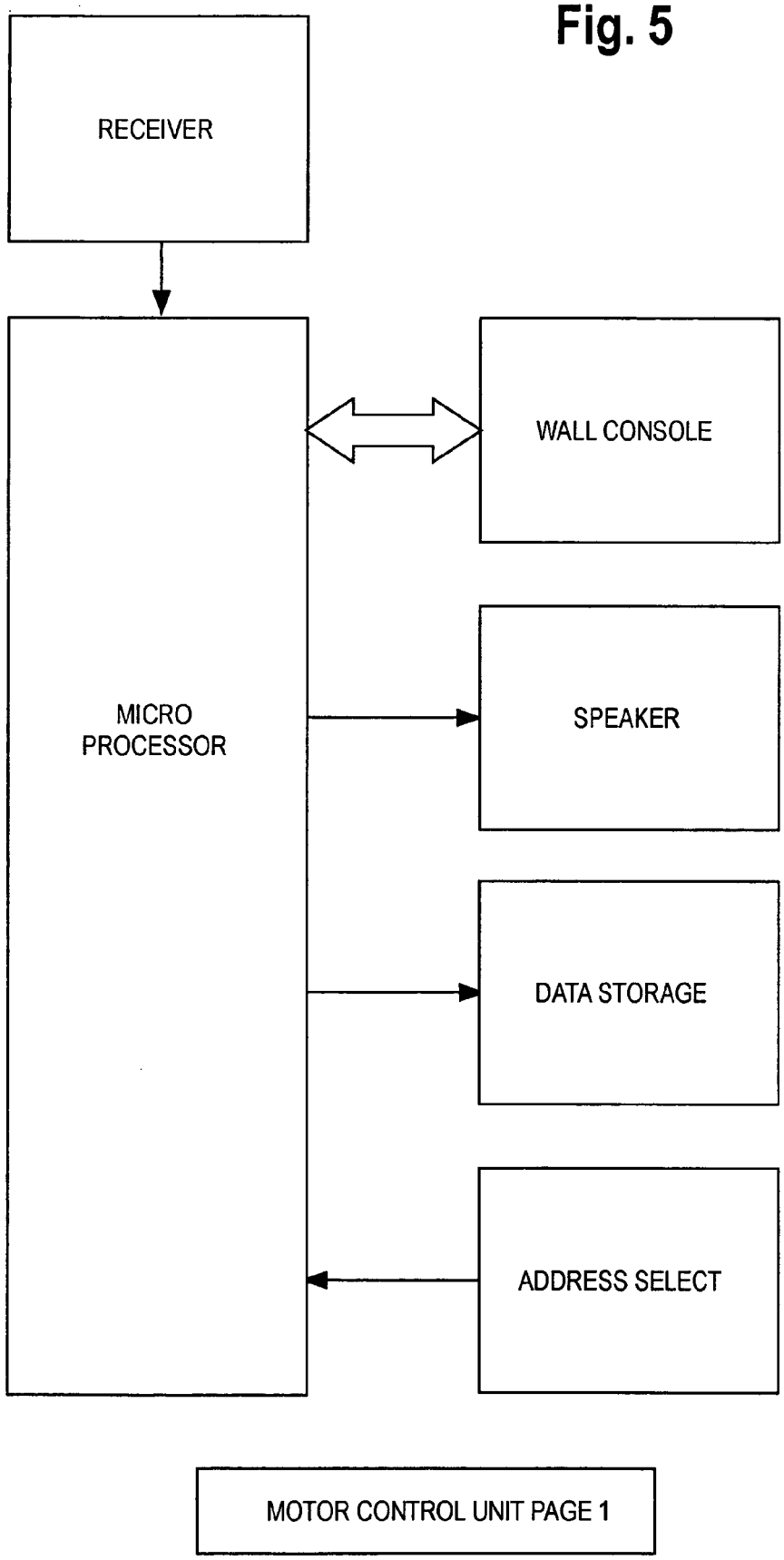
FIGS. 5 and 6 are schematics of the Motor Control Unit operational program.
Figure 6:
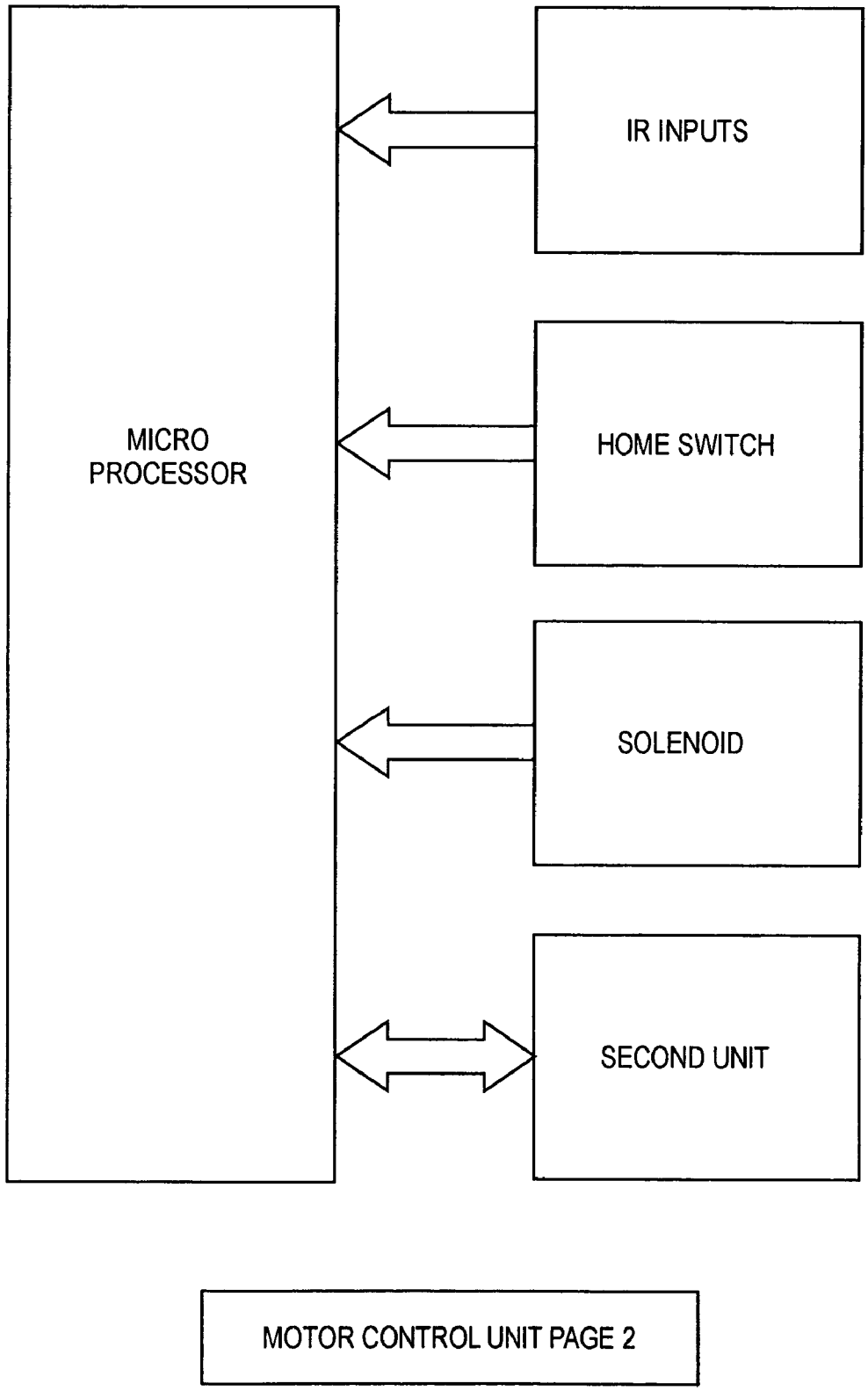
Figure 7:
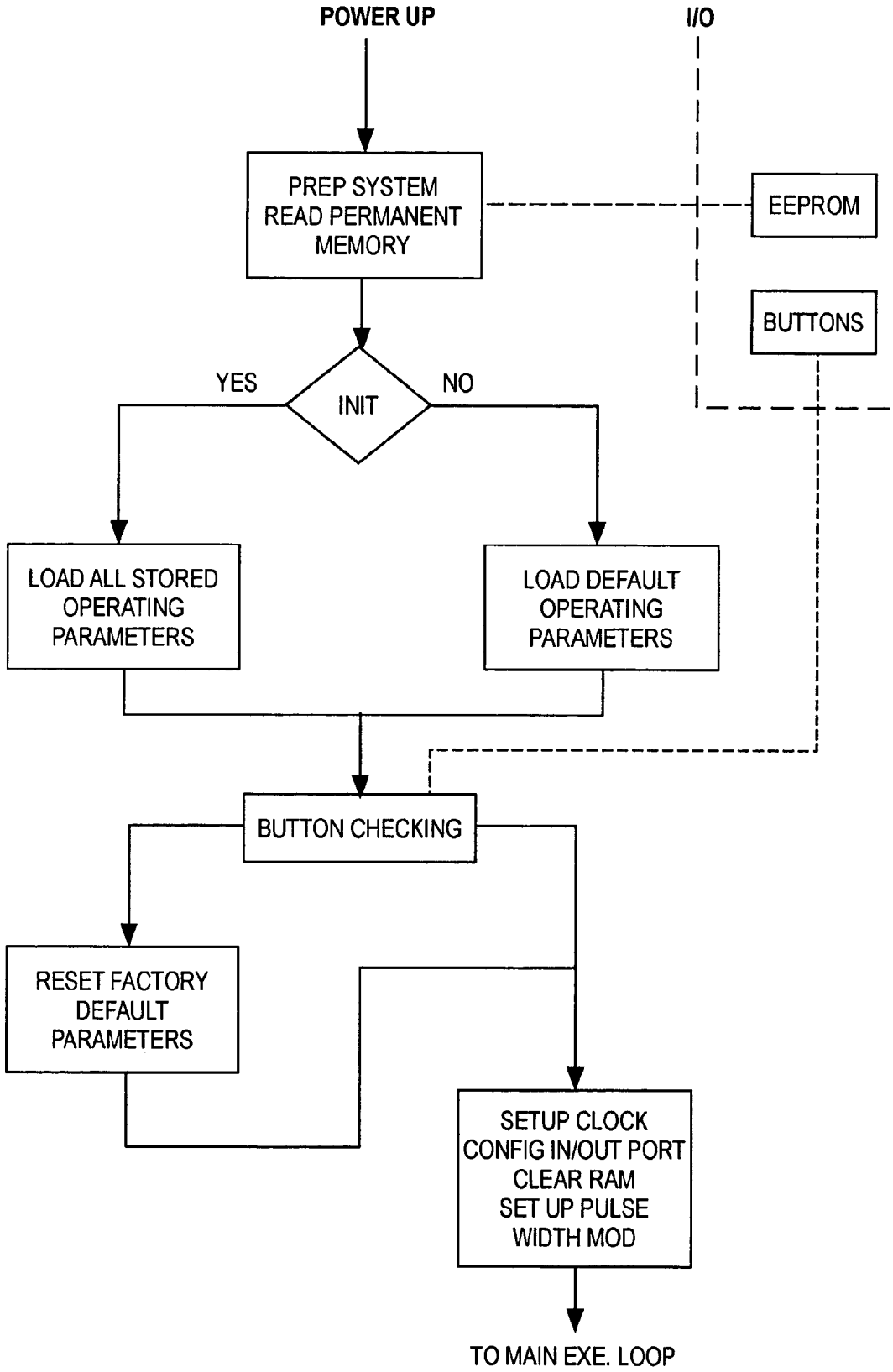
FIG. 7 is a schematic drawing of the software startup routine which sets up the operational parameters.
Figure 8:
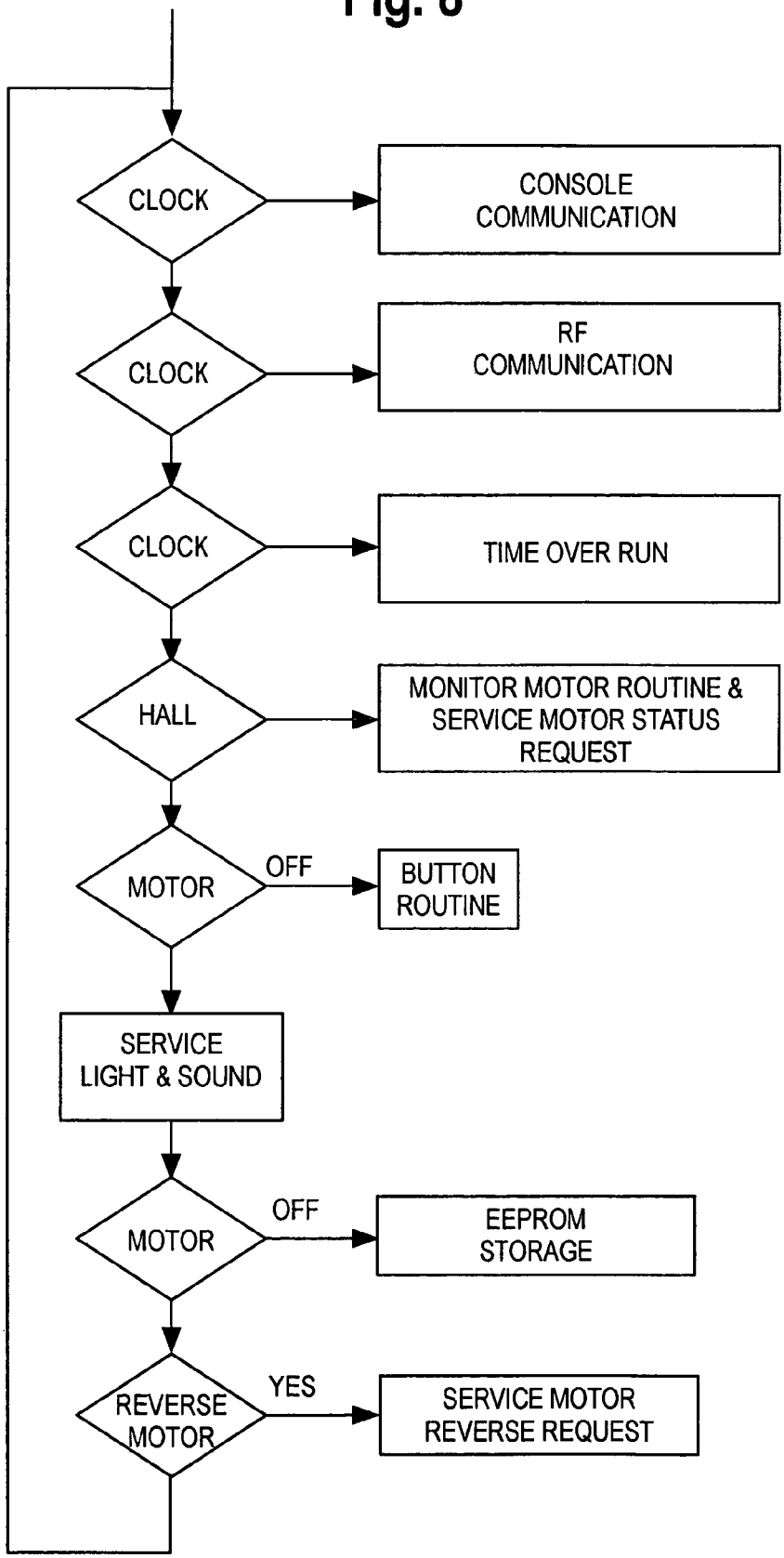
FIG. 8 shows the Main Executive loop that controls the door operations.

FIGS. 5 and 6 are schematics of the Motor Control Unit operational program. The Motor Control Unit (MCU) operational program is comprised of one main executive loop routine which controls the operations of the GDO system by handing off various control task to numerous specialized routines. FIG. 7 is a schematic drawing of the Init which is a software startup routine which sets up the operational parameters. FIG. 8 shows the Main Block which is Main Executive loop that controls the door operations.

Figure 9:
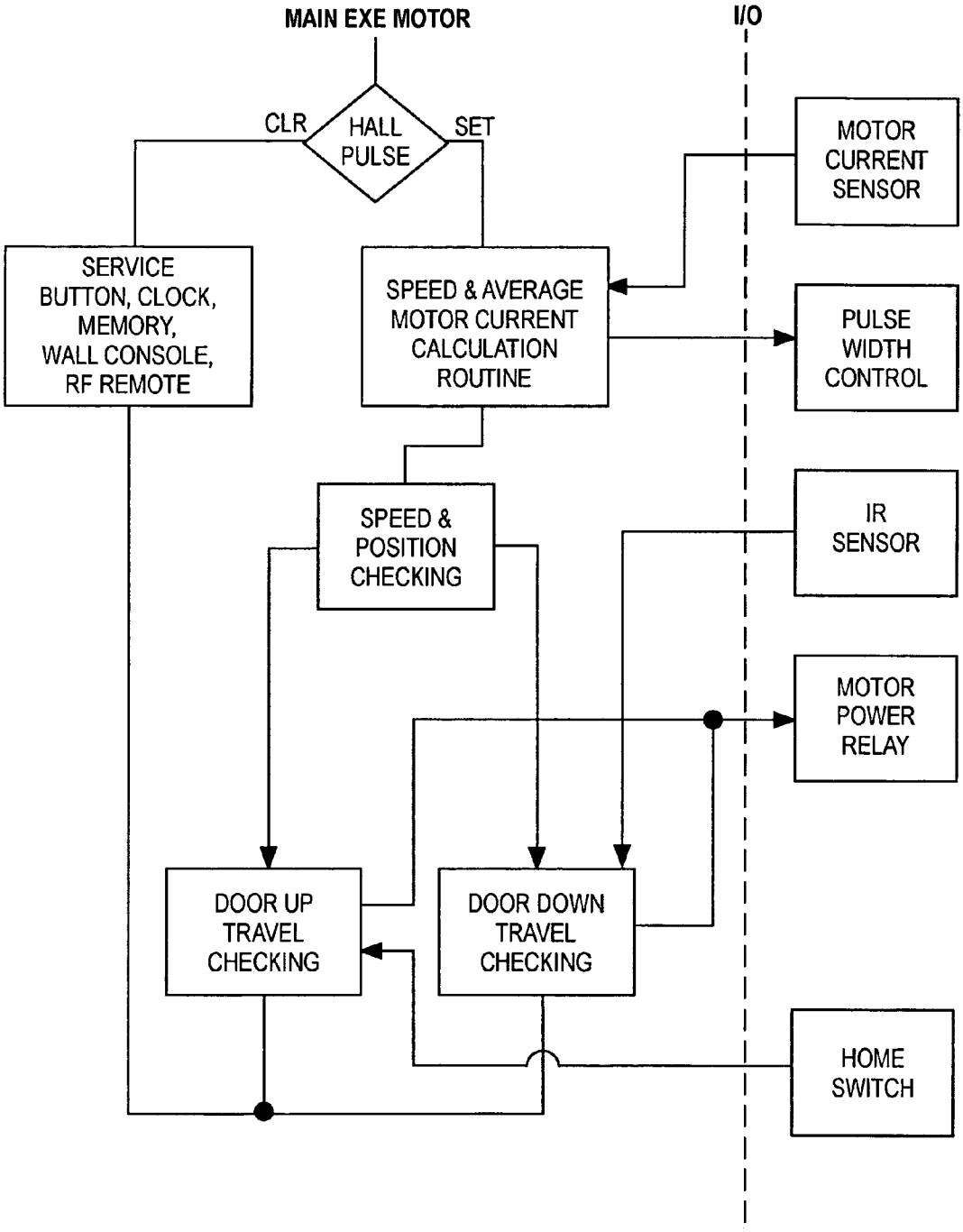
FIG. 9 shows the Motor Control Routine which controls motor related activity of the present invention.
Figure 10:
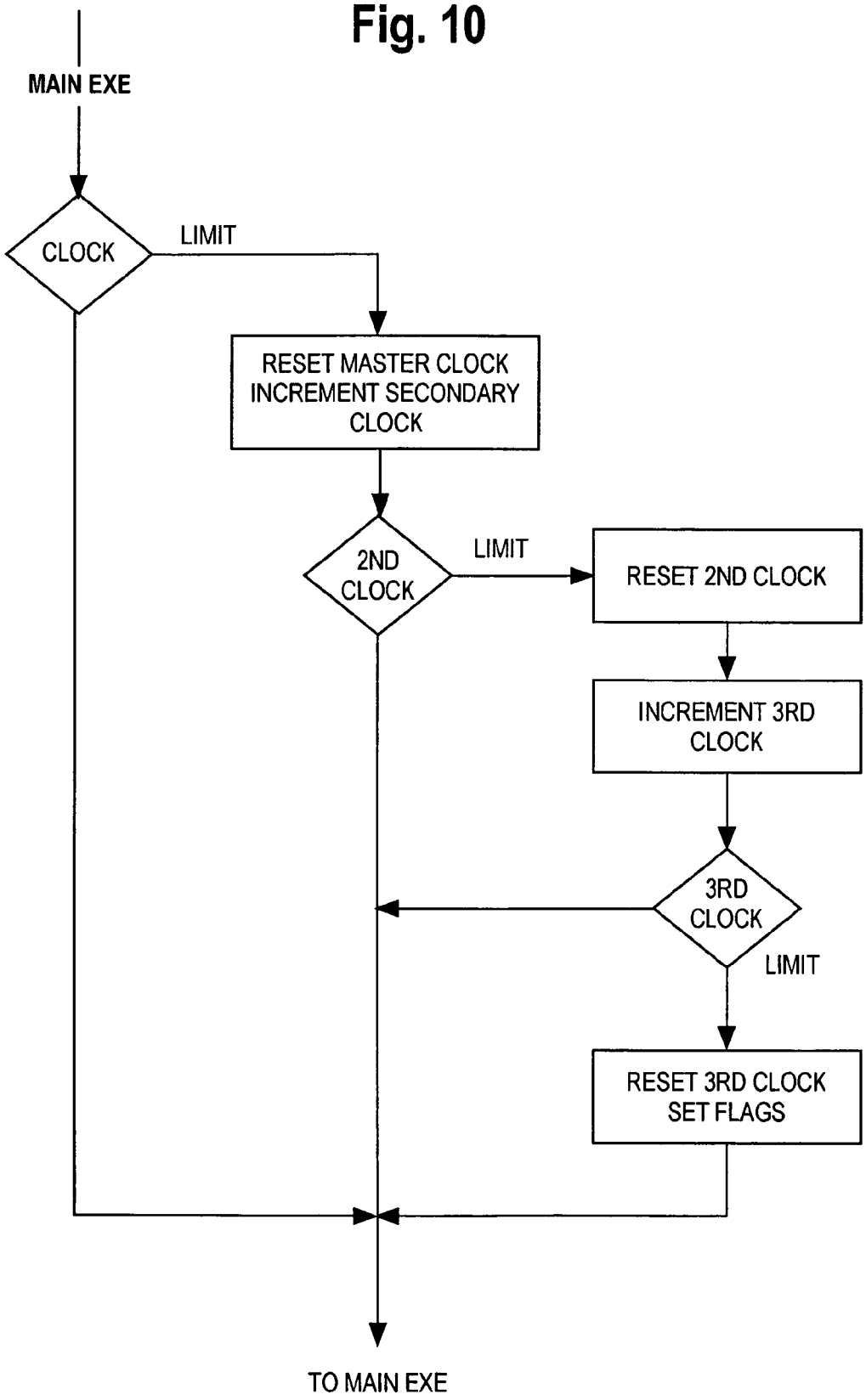
FIG. 10 is a more detailed view of the Service BUTTON, CLOCK, MEMORY, WALL CONSOLE RF REMOTE portion of FIG. 9.
Figure 11:
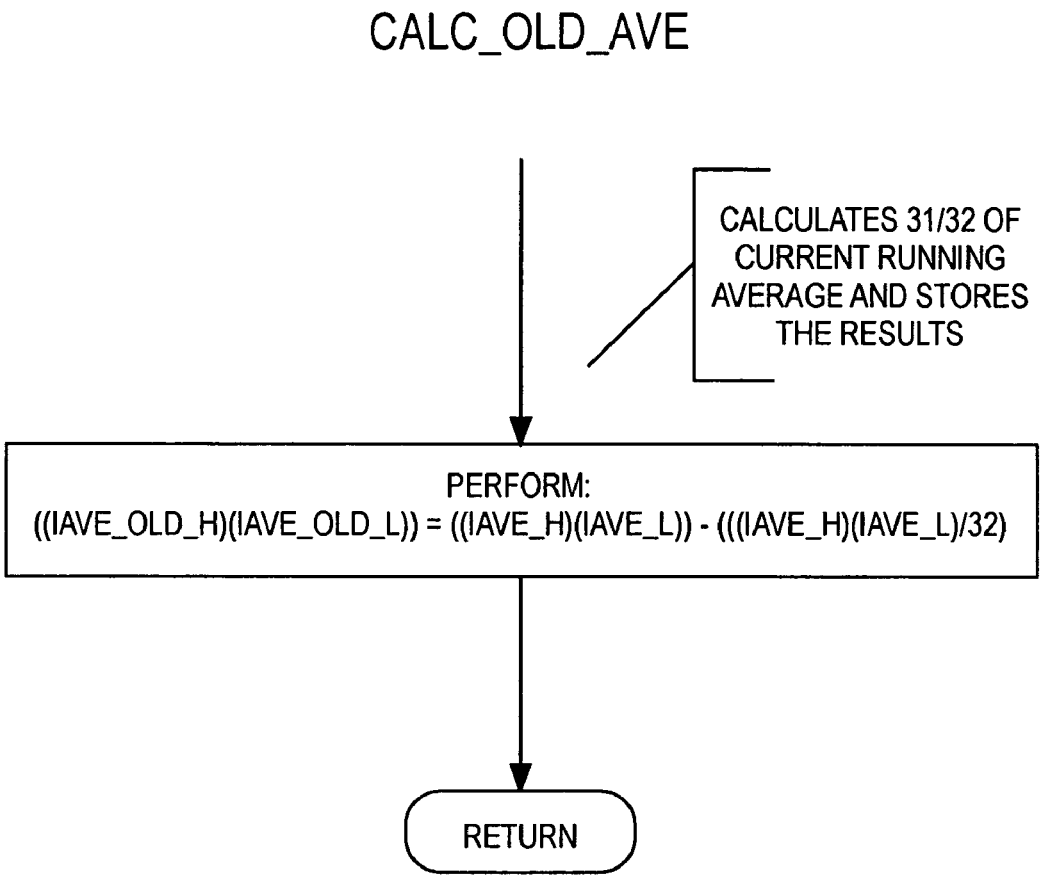
FIG. 11 is a schematic showing the calculation of the old average motor current for use in balanced door detection.
Figure 12:
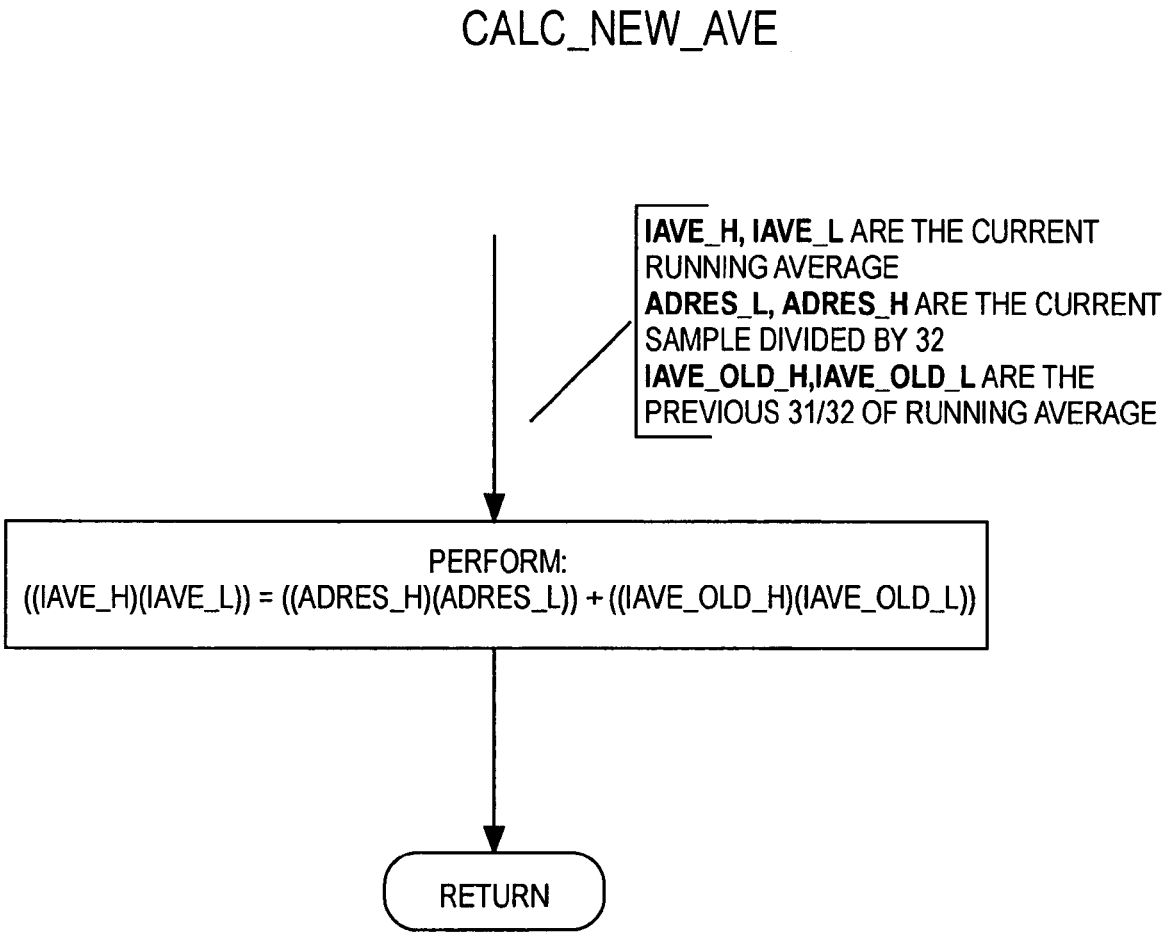
FIG. 12 is a schematic showing the calculation of the new average motor current for use in balanced door detection.
Figure 13:
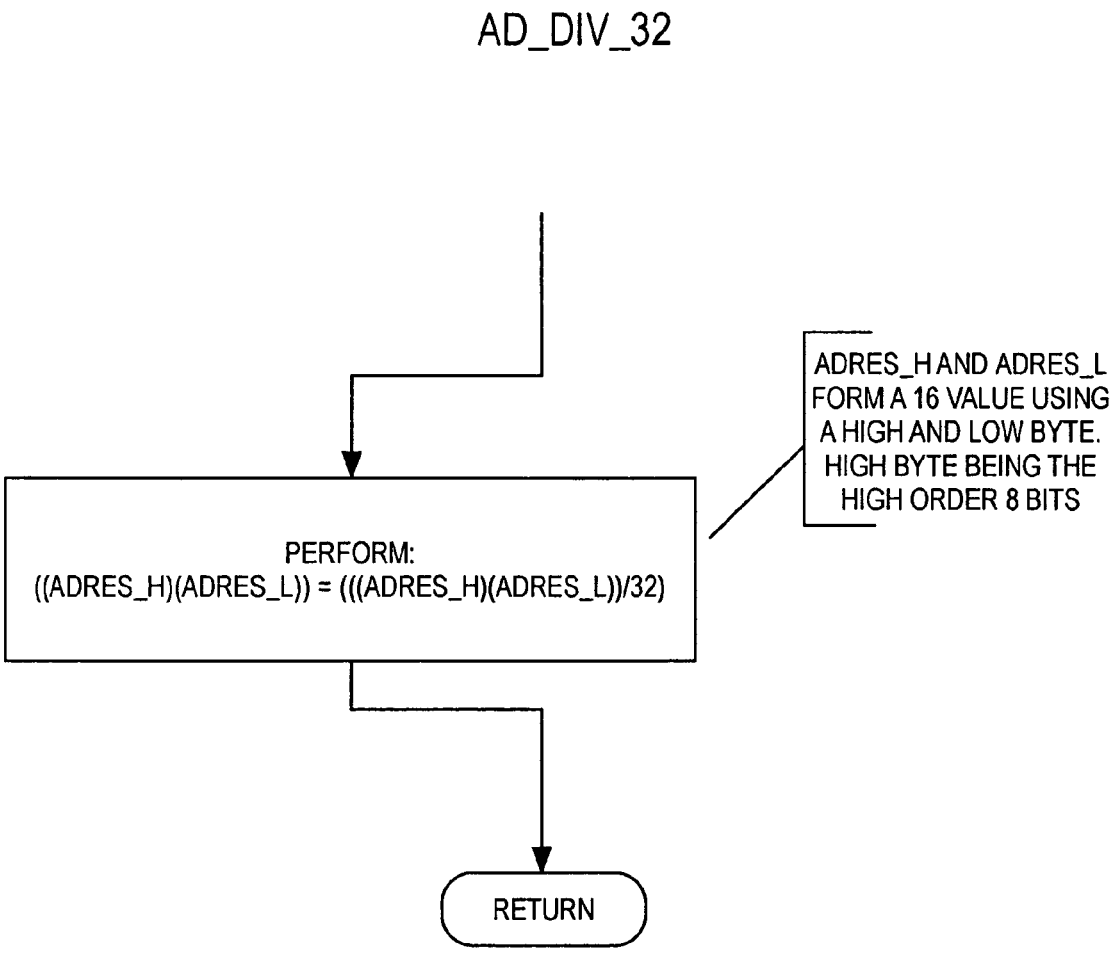
FIG. 13 is a schematic showing the scaling of motor current data for use in balanced door detection.

FIG. 9 shows the Motor Block which is the Motor Control Routine which controls motor related activity of the present invention. FIG. 10, MCLOCK, is a more detailed view of the Service BUTTON, CLOCK, MEMORY, WALL CONSOLE RF REMOTE portion of FIG. 9. FIG. 11 is a schematic showing the Calc_Old_Ave (Calculating the Old Motor Current Average). FIG. 12 is a schematic showing the Calc_New_Ave (Calculating the New Motor Current Average). These calculate average motor current for use in balanced door detection. This is used as part of a series of equations. FIG. 13 is a schematic showing ad_div_32 (A/D Result Divide by 32) which scales the motor current data for use in balanced door detection.

Figure 15:
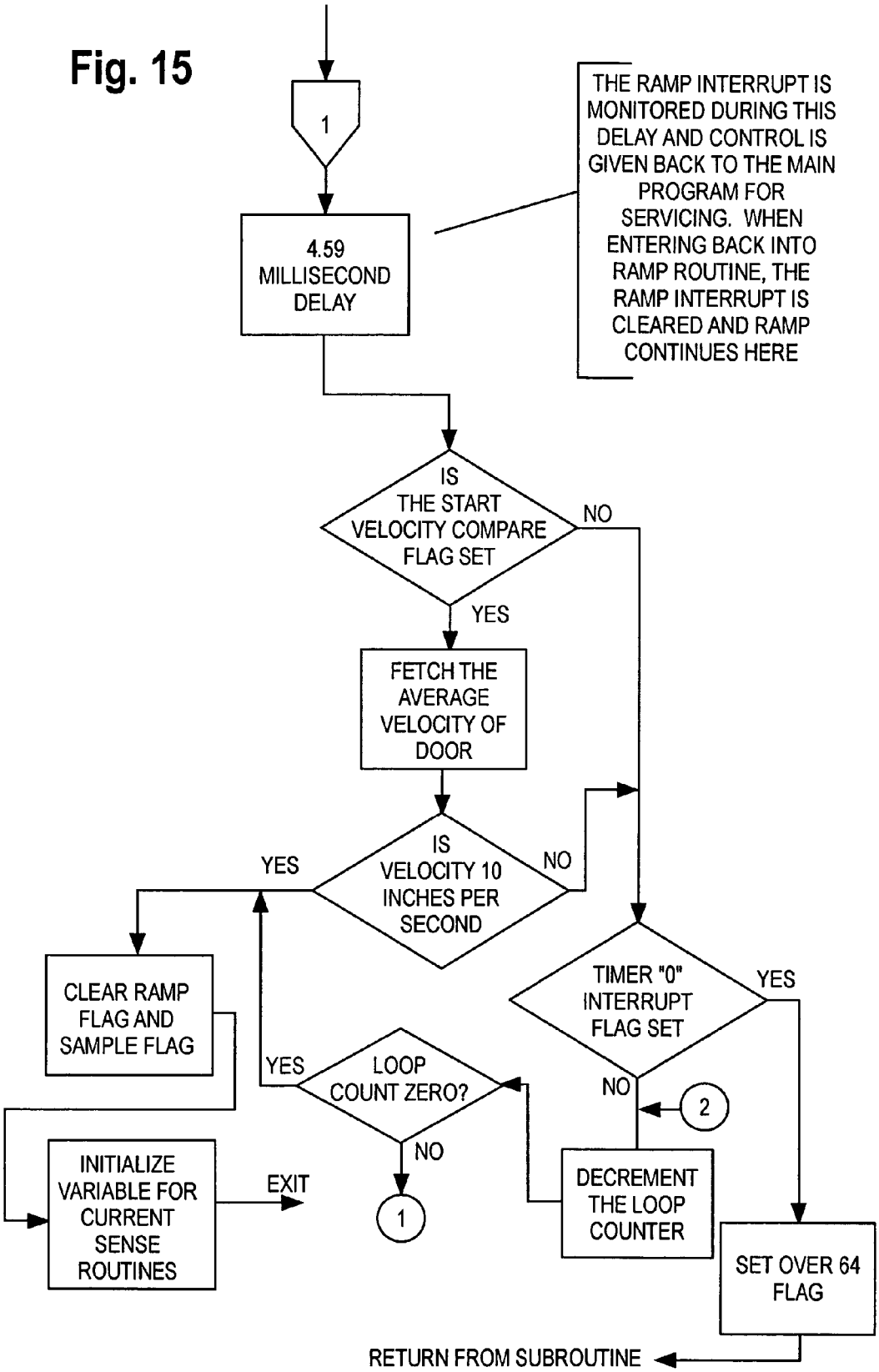
FIG. 15 is a schematic showing the smooth ramping up of the door to a target maximum speed.
Figure 16:
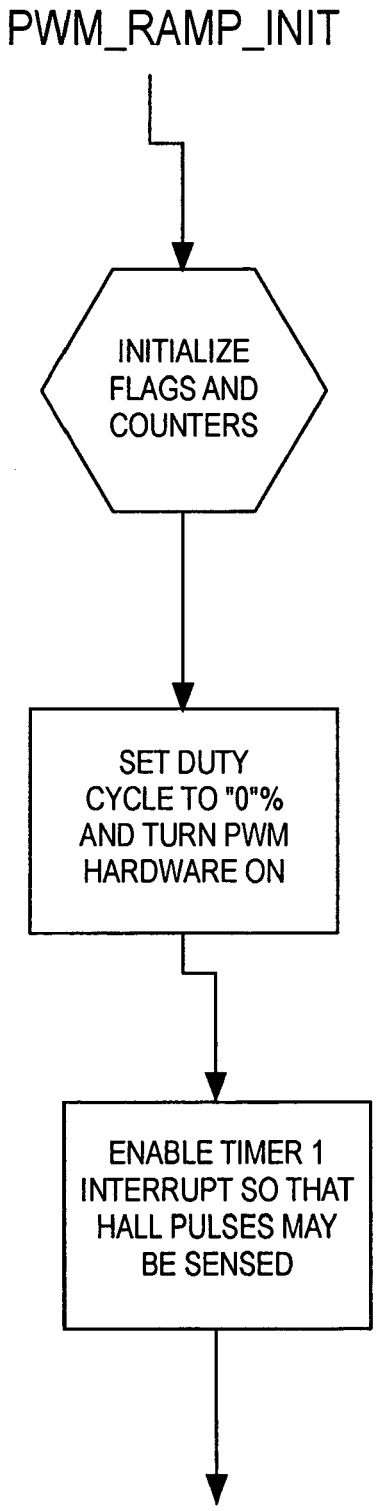
FIG. 16 is a schematic showing the pulse width ramp initialization for the preparation of the system for ramp of door speed.
Figure 17:
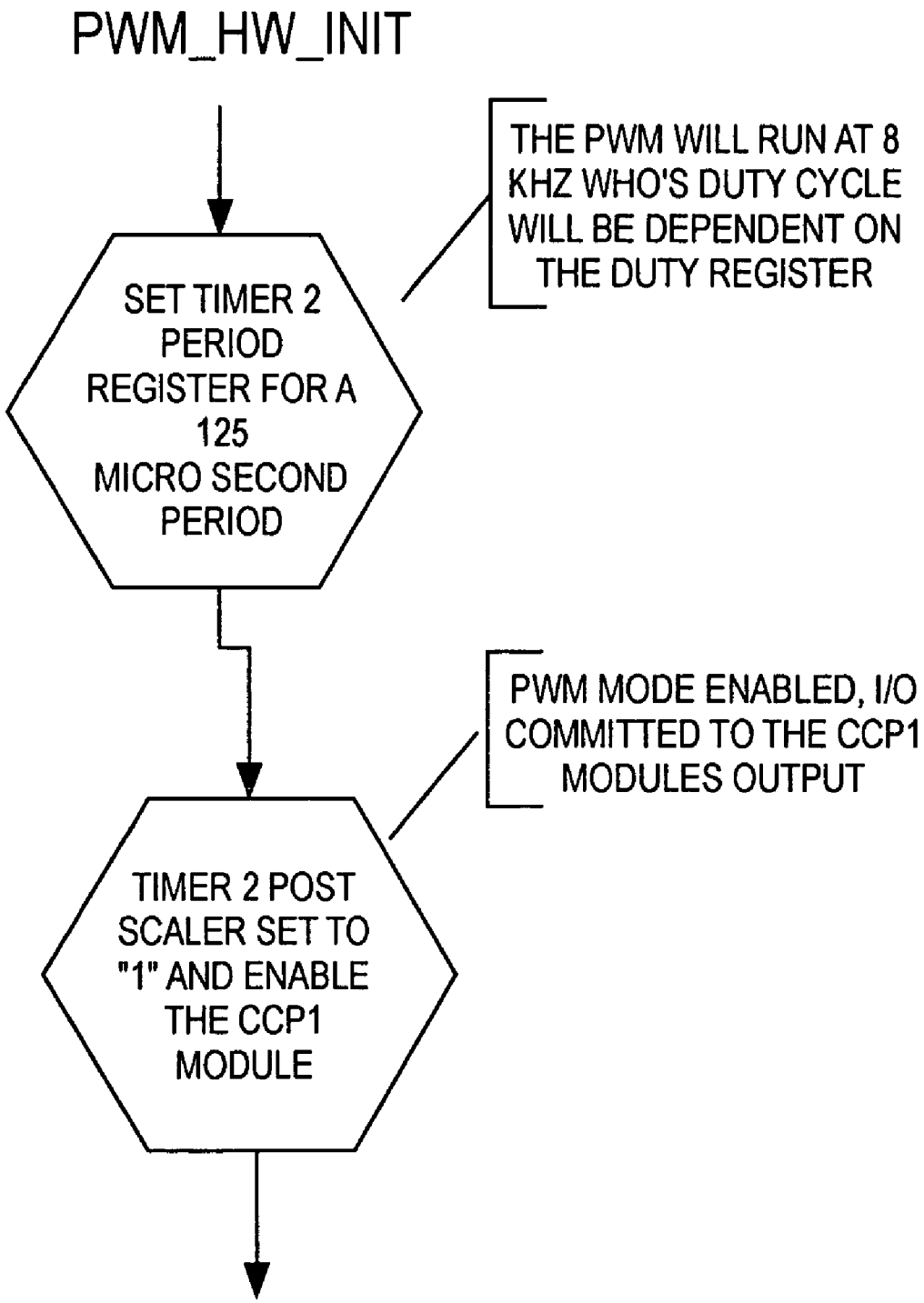
FIG. 17 shows the pulse width modulator hardware initialization to prepare the system for speed control.
Figure 18:
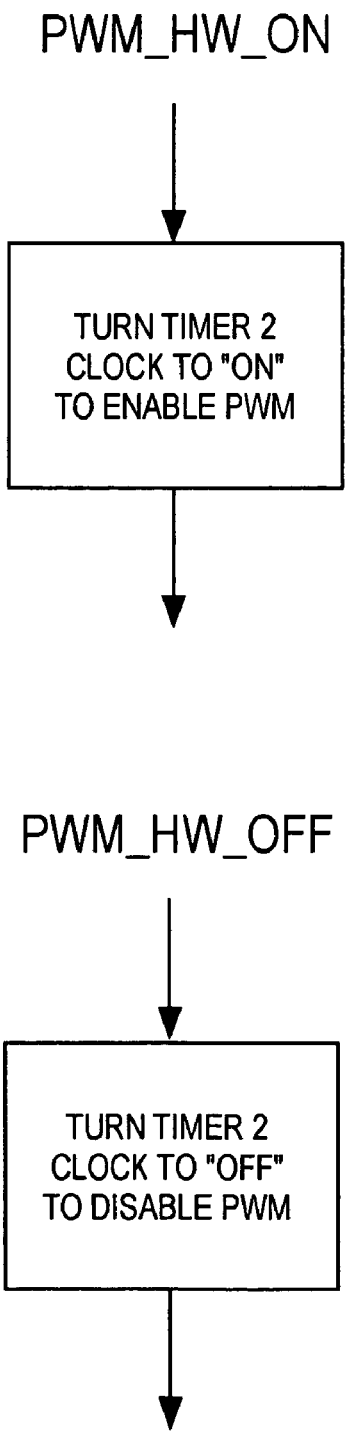
FIG. 18 is a schematic showing the turning of the pulse width modulator "ON" and "OFF" to motor driver.

FIG. 14 is a schematic showing the pwmramp dowm (Motor Speed Ramp Down) which smoothly slows door down from current speed to complete stop. FIG. 15 is a schematic showing the pwmramp (Pulse Width Modulator Ramp—Door Speed Ramp-up) which smoothly speeds up the door to the target speed of 10 inches per second. FIG. 16 is a schematic showing the pwm_ramp_init (Pulse Width Modulator Ramp—Initialization) which prepares the system for ramp up of door speed. FIG. 17 shows pwm_hw_init (Pulse Width Modulator Hardware Initialization) which prepares the system for door speed control. FIG. 18 is a schematic showing pwm_hw_on (Pulse Width Modulation Hardware On) which turns the pulse width modulator "ON" and "OFF" to the motor driver.

Figure 19:
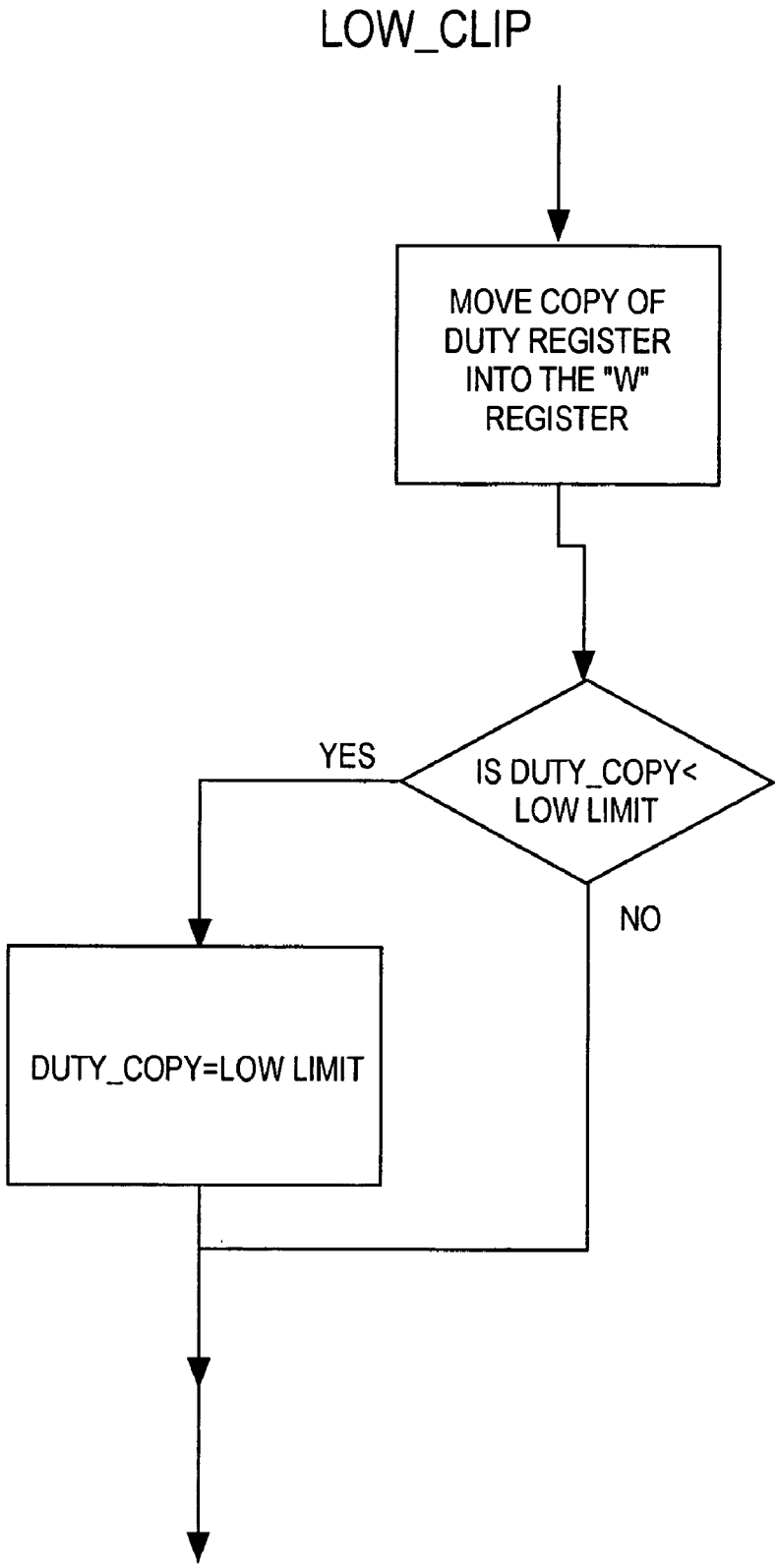
FIG. 19 is a schematic showing the setting of the minimum DUTY cycle correction while controlling door speed.
Figure 20:
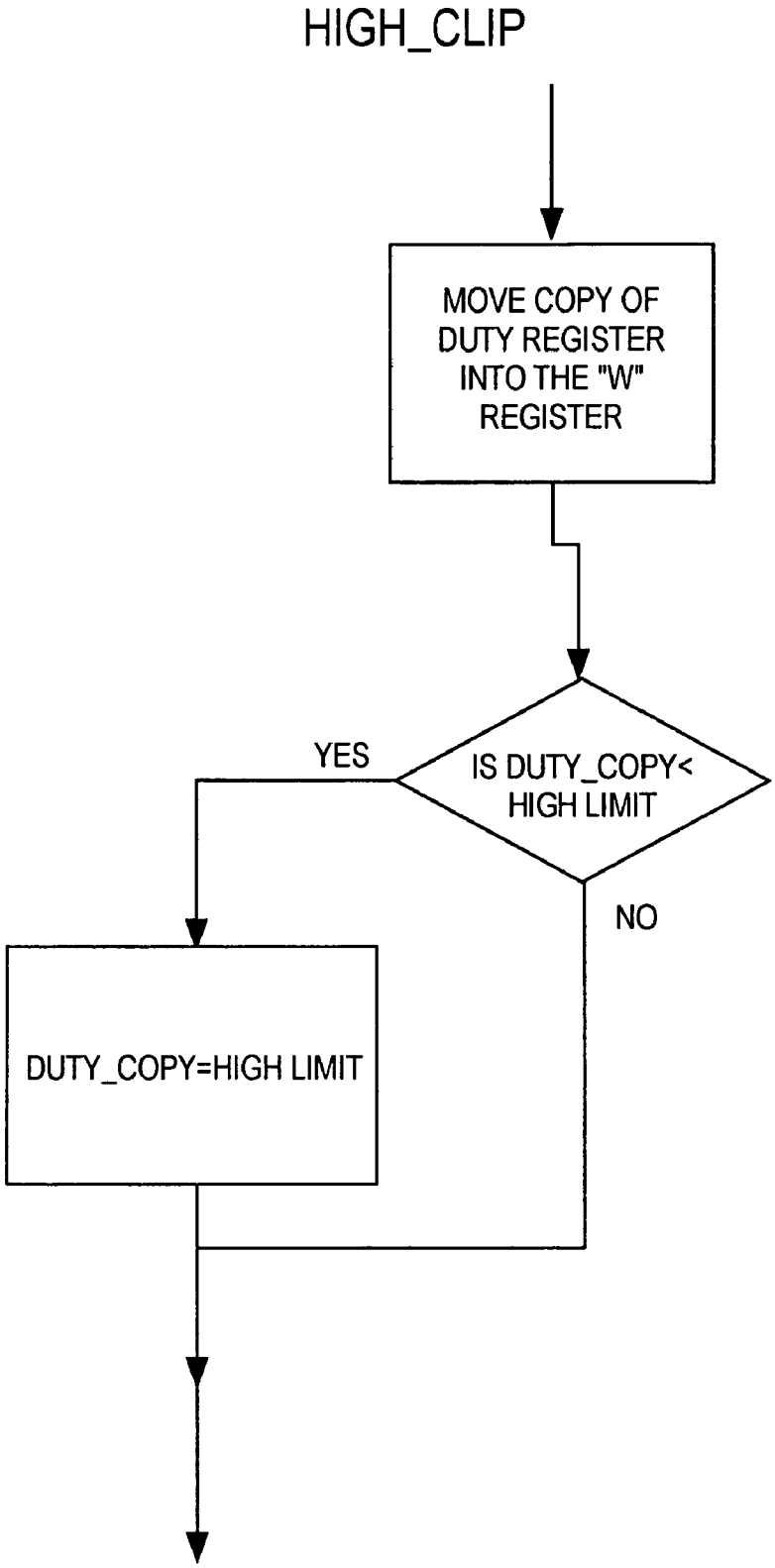
FIG. 20 is a schematic showing the setting of the maximum DUTY cycle correction while controlling door speed.

FIG. 19 is a schematic showing the low_clip (Low Clipping Duty Cycle Minimum Value) which sets of the minimum DUTY cycle correction while controlling door speed. FIG. 20 is a schematic showing the high_clip (High Clipping Duty Cycle Maximum Value) which sets the maximum DUTY cycle correction while controlling door speed.

Figure 21:
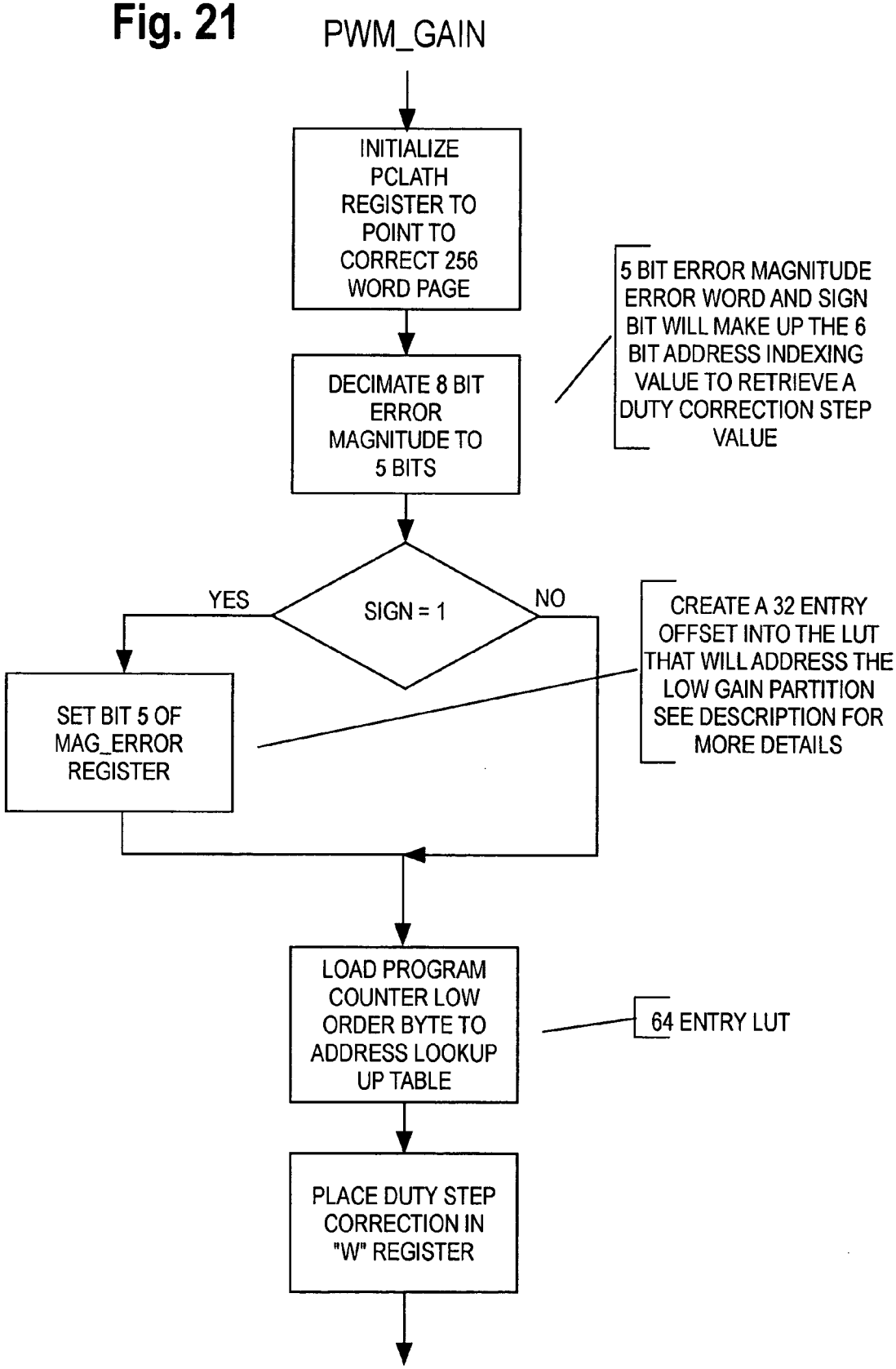
FIG. 21 is a schematic showing the routine for determining the rate at which the door speed can be corrected based on the magnitude of speed error from the target system speed.
Figure 22:
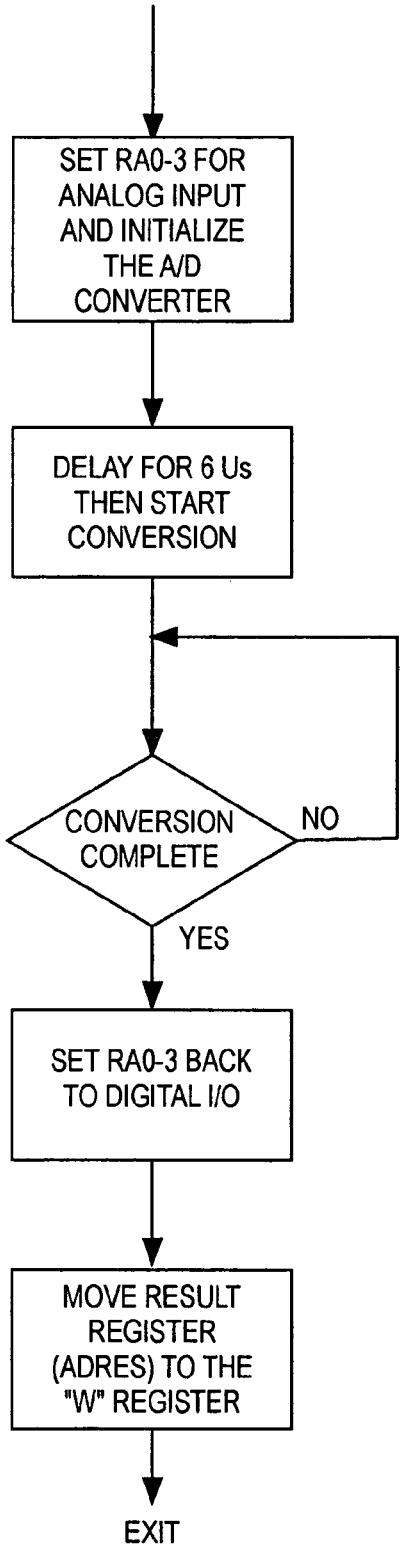
FIG. 22 is a schematic showing the acquisition of motor current by performing an analog to digital conversion.

FIG. 21 is a schematic showing the pwm_gain (Pulse Width Modulation Gain—For Speed Error vs. Corrective Force Determination). This routine determines the rate at which the door speed can be corrected based on the magnitude of speed error from the target system speed. This provides for smoother door operation by preventing oscillation in door movement. FIG. 22 is a schematic showing the ADC (Analog to Digital Conversion—Motor Current Data Acquisition) which acquires motor current by performing and analog to digital conversion. The resolution is preferably 8 bits wide.

Figure 24:
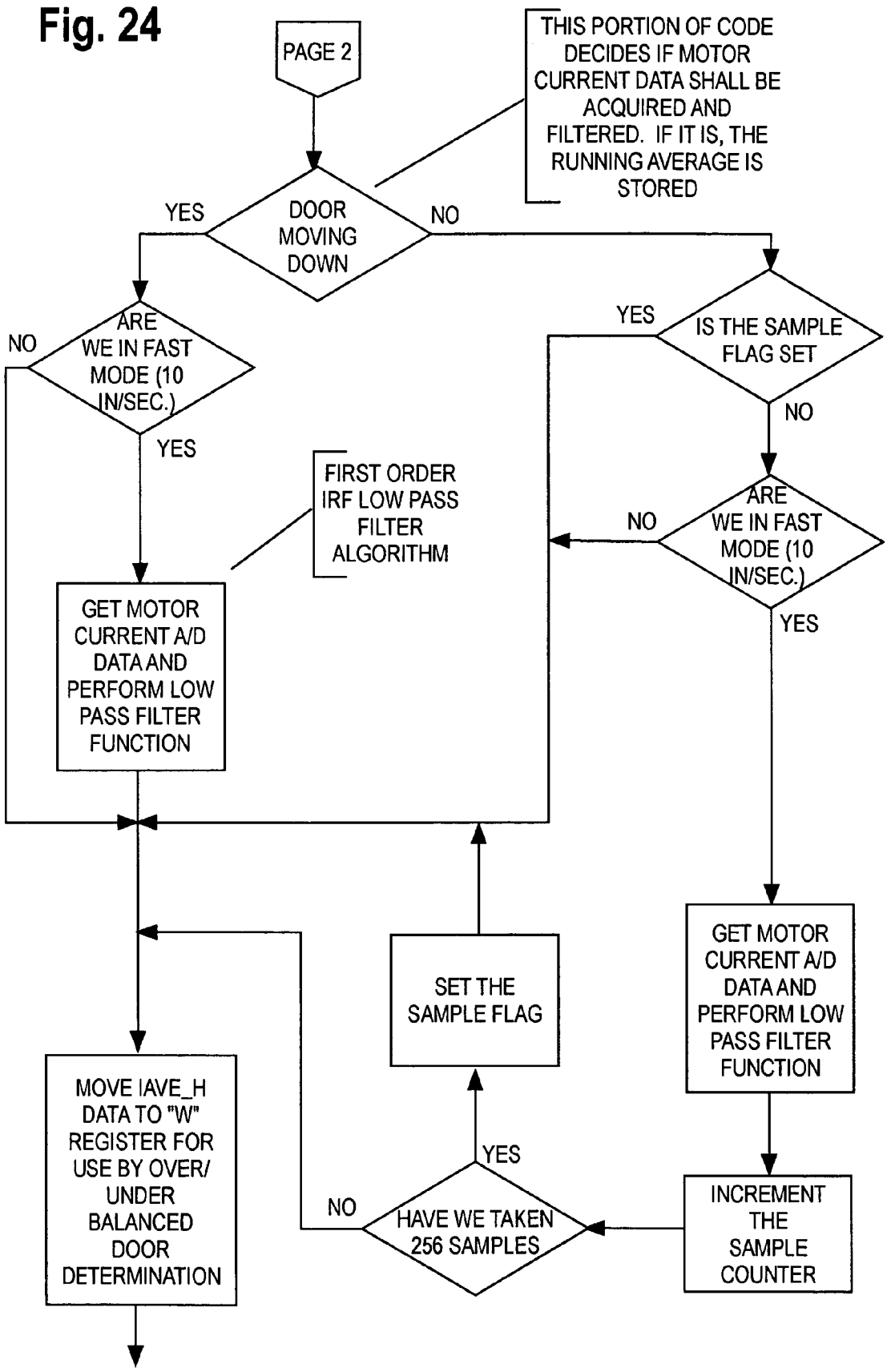

FIGS. 23 and 24 are schematics showing pwm (Pulse Width Modulation—Motor Speed Control) which is the main door speed control loop. This smoothly maintains target door speed.

Figure 25:
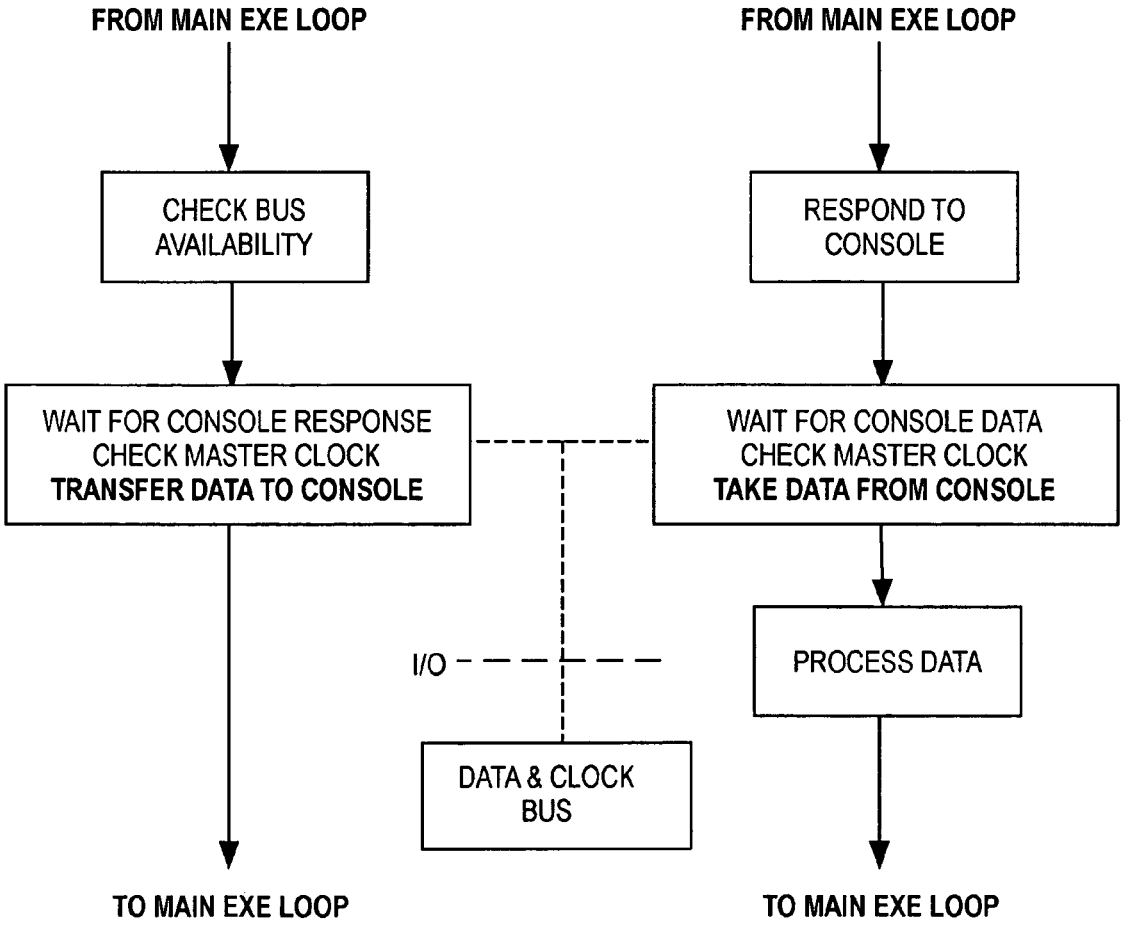
FIG. 25 is a schematic showing the console com routine which controls the motor control unit to wall console data transfer.
Figure 26:
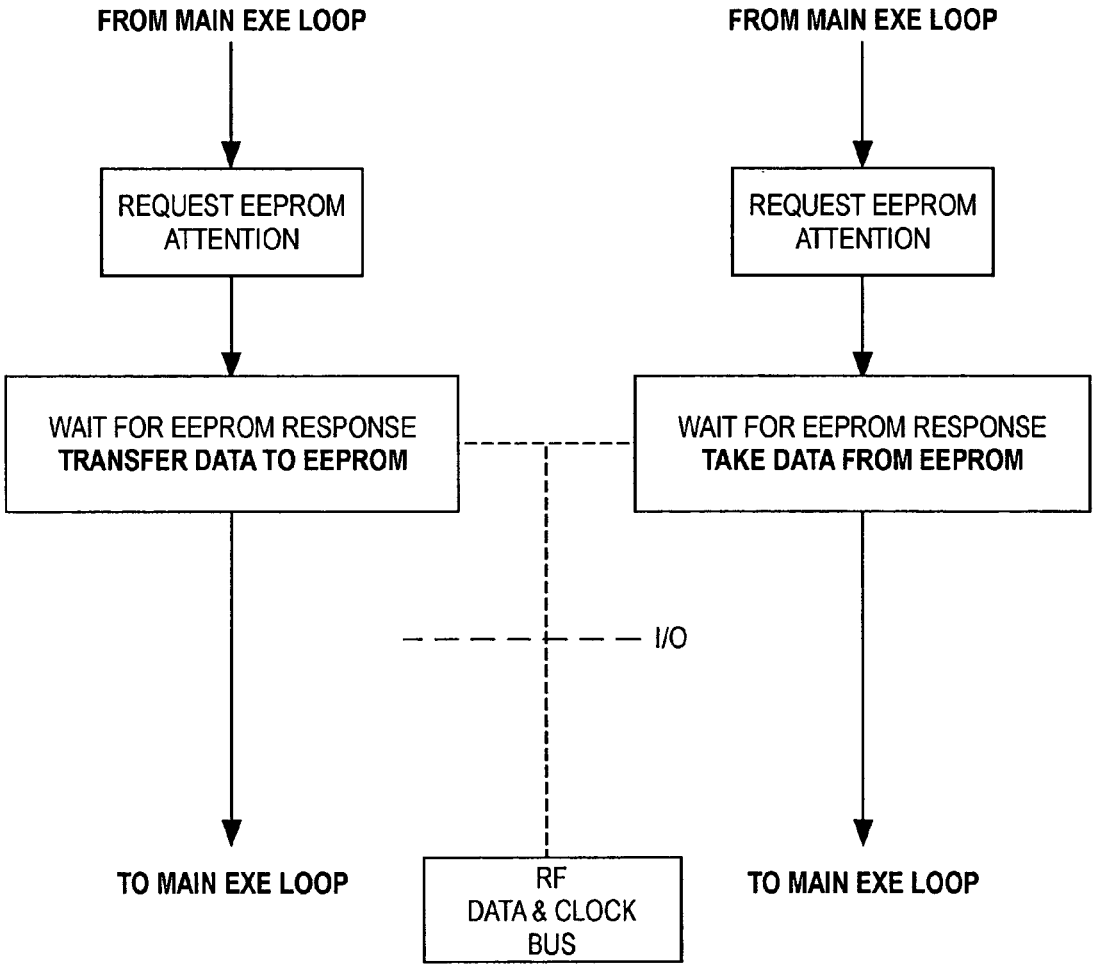
FIG. 26 is a schematic showing RF EEPROM that controls the memory read and write functions.
Figure 27:
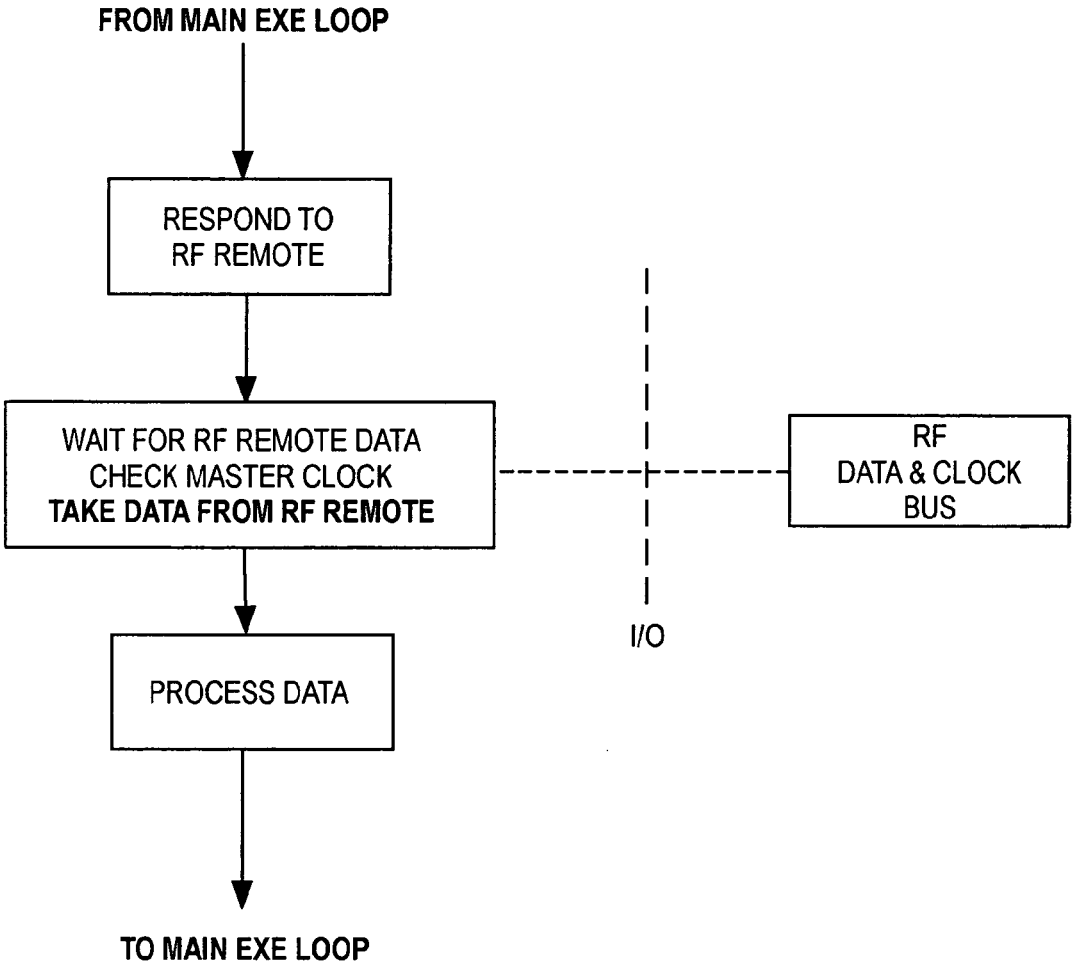
FIG. 27 is a schematic showing the RF corn for controlling the remote control data input from the RF units.
Figure 28:
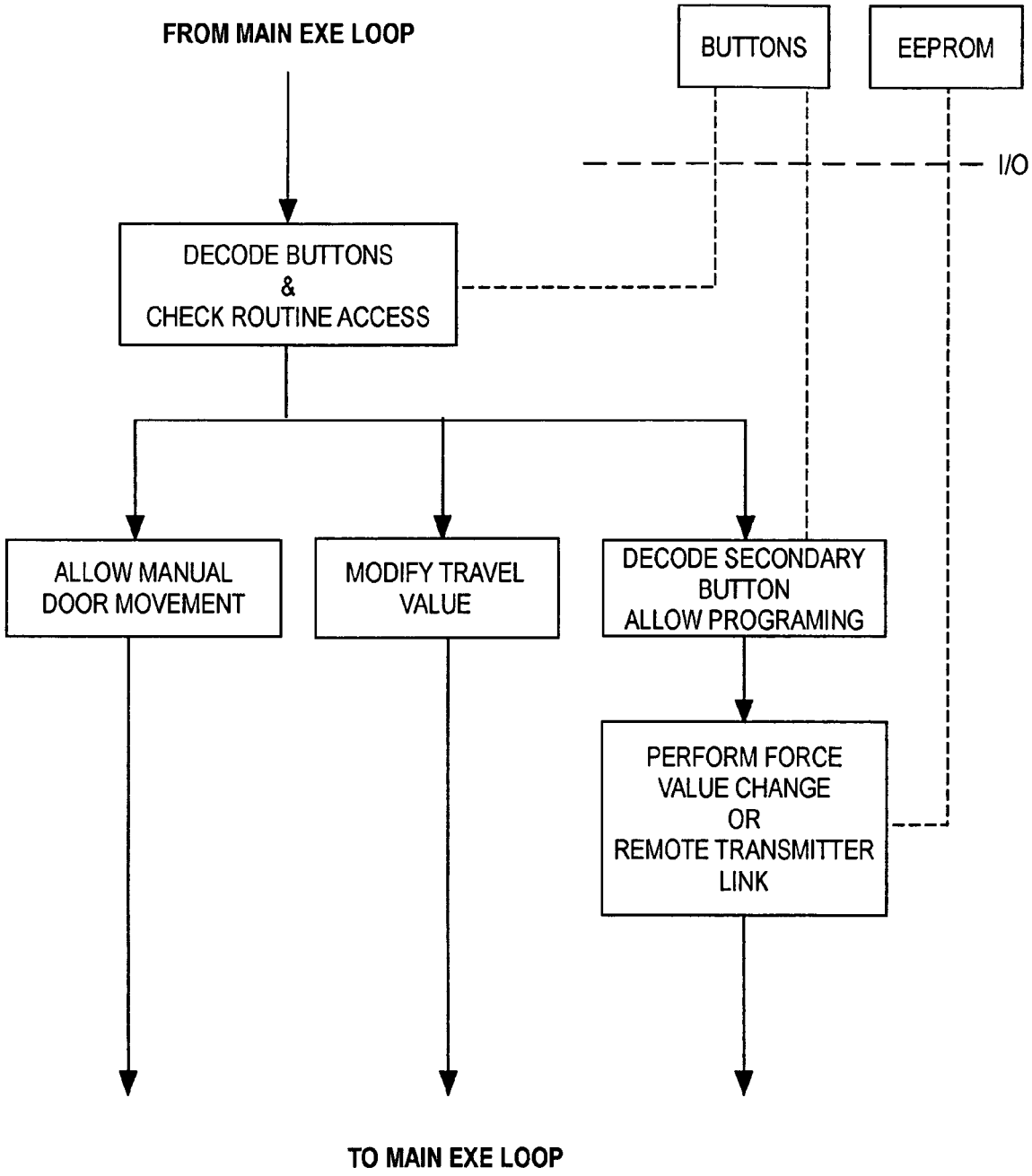
FIG. 28 is a schematic showing the controls for the BUTTON interface for the motor controller.

FIG. 25 is a schematic showing the Concom which is the routine which controls the motor control unit to wall console data transfer. FIG. 26 is a schematic showing RF EEPROM that controls the memory read and write functions. FIG. 27 is a schematic showing the RF corn for controlling the remote control data input from the RF units. FIG. 28 is a schematic showing the controls for the BUTTON interface for the motor controller.

Figure 29:
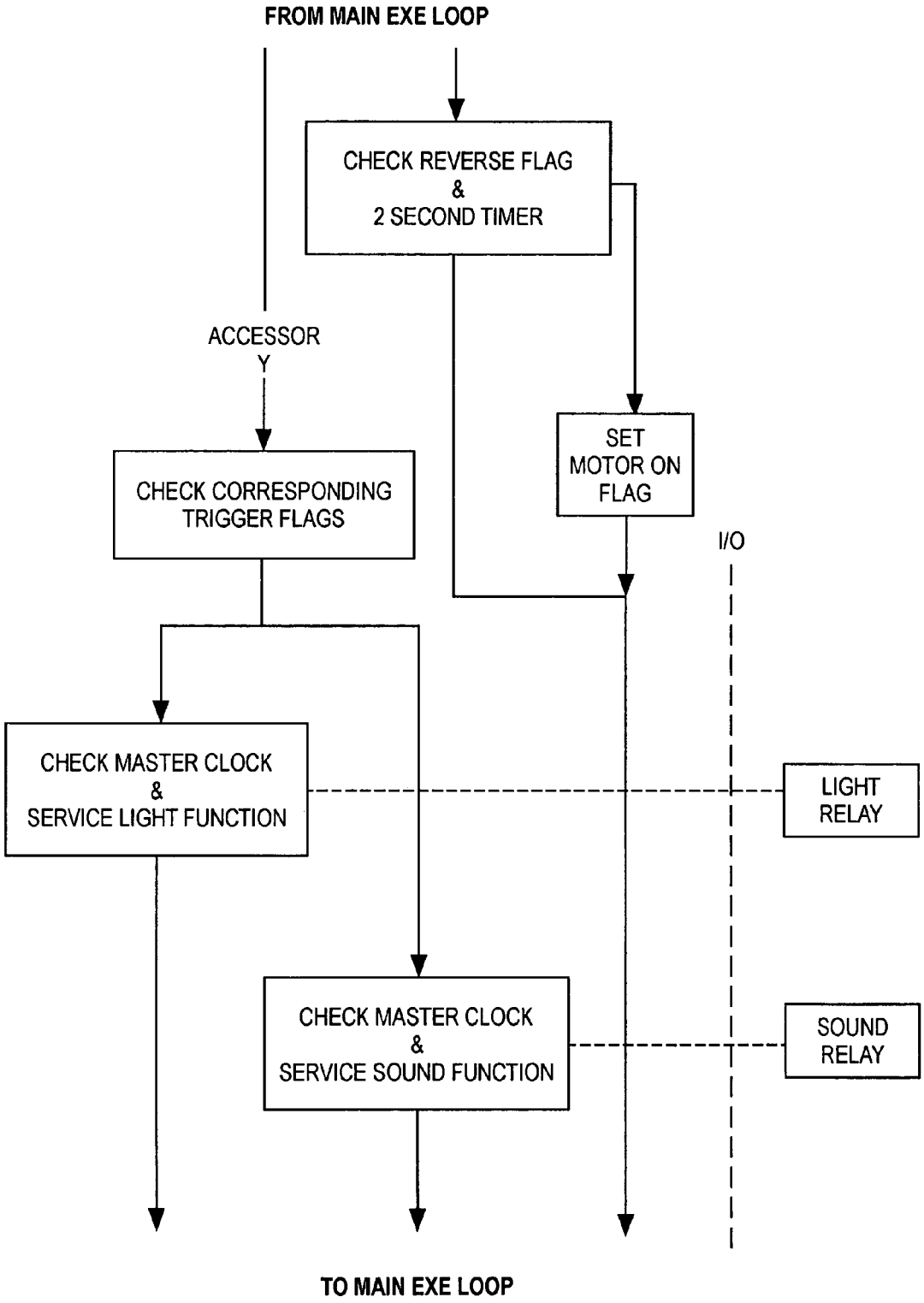
FIG. 29 is a schematic showing the controls for the Light, Sound, Motor Reverse activities.

FIG. 29 is a schematic showing the ACCESS which controls for the Light, Sound, Motor Reverse activities.

Figure 30:
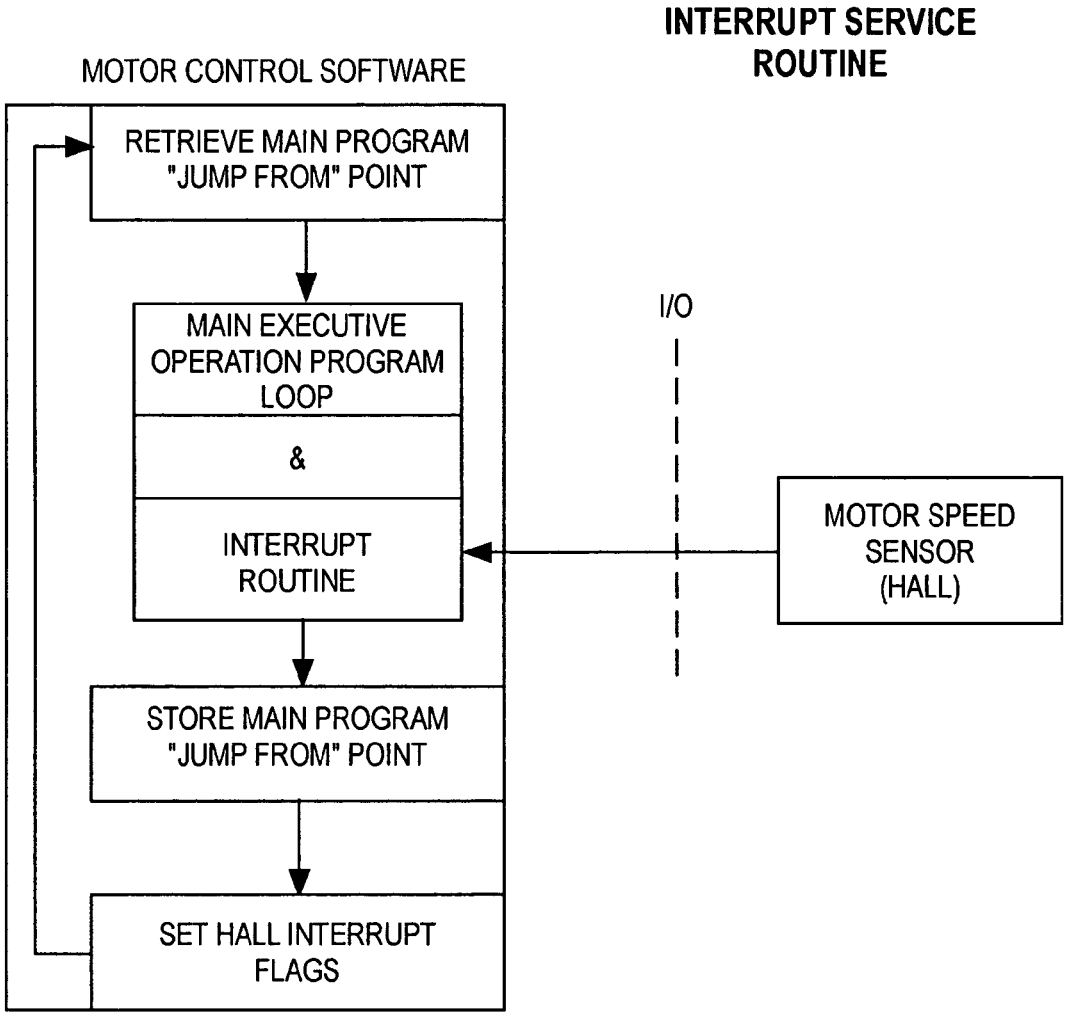
FIG. 30 is a schematic showing the speed sensor Hall interrupt from the motor.
Figure 31:
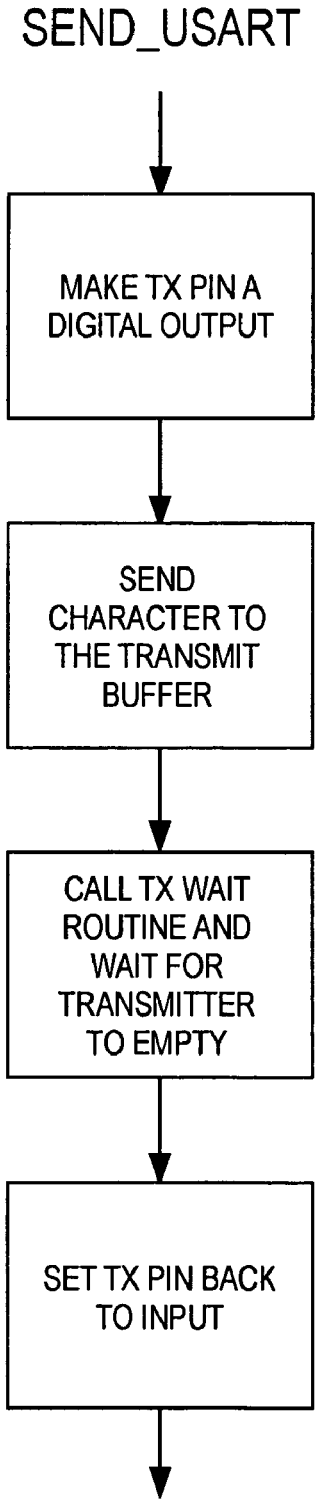
FIG. 31 is a schematic showing the Send_Usart function which handles data output functions from the motor control software for system debugging.
Figure 32:
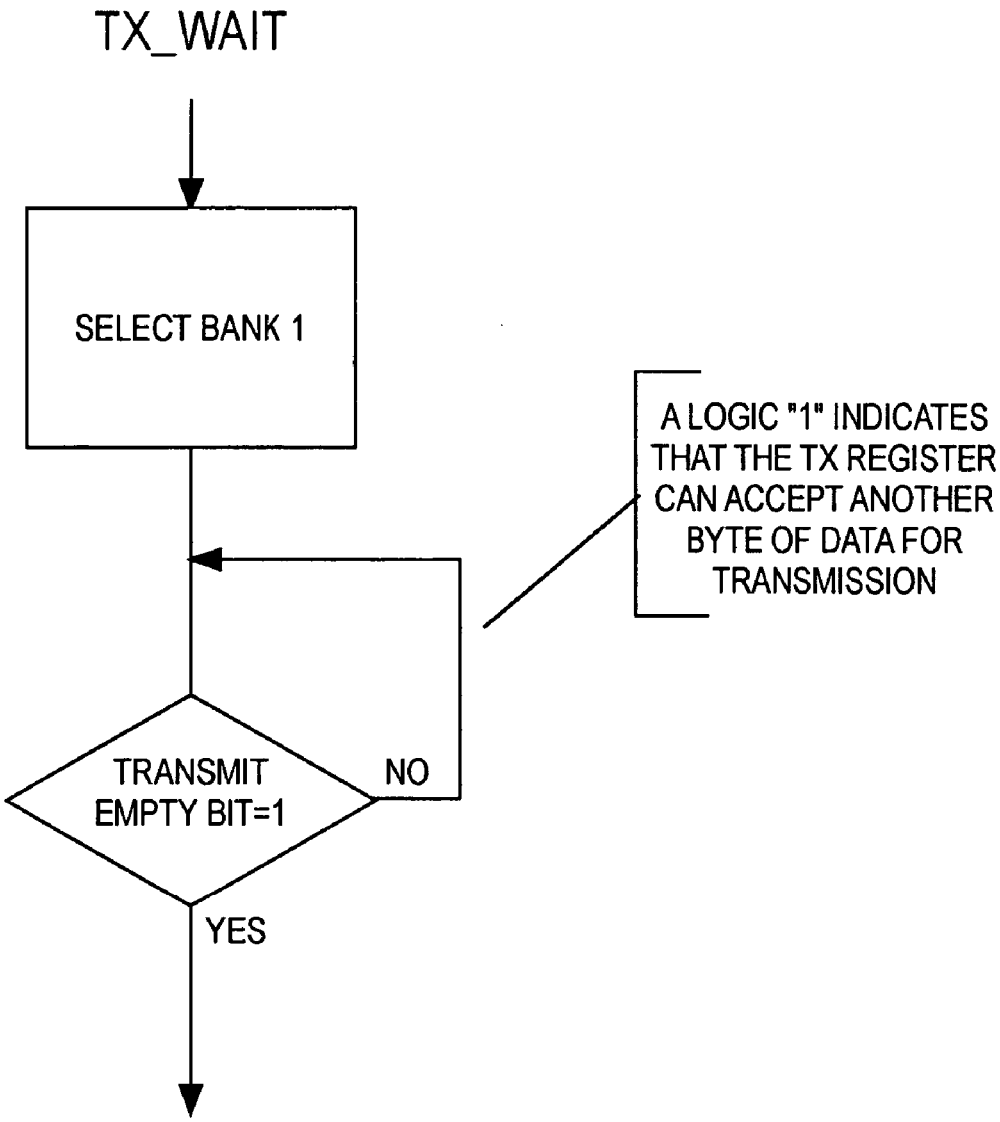
FIG. 32 is a schematic showing the subroutine for Send_Usart.

FIG. 30 is a schematic showing the Hallint which is a speed sensor Hall interrupt from the motor. FIG. 31 is a schematic showing the Send_Usart function which handles data output functions from the motor control software for system debugging. FIG. 32 is a schematic showing the Tx_wait which is a subroutine for Send_Usart.

Figure 33:
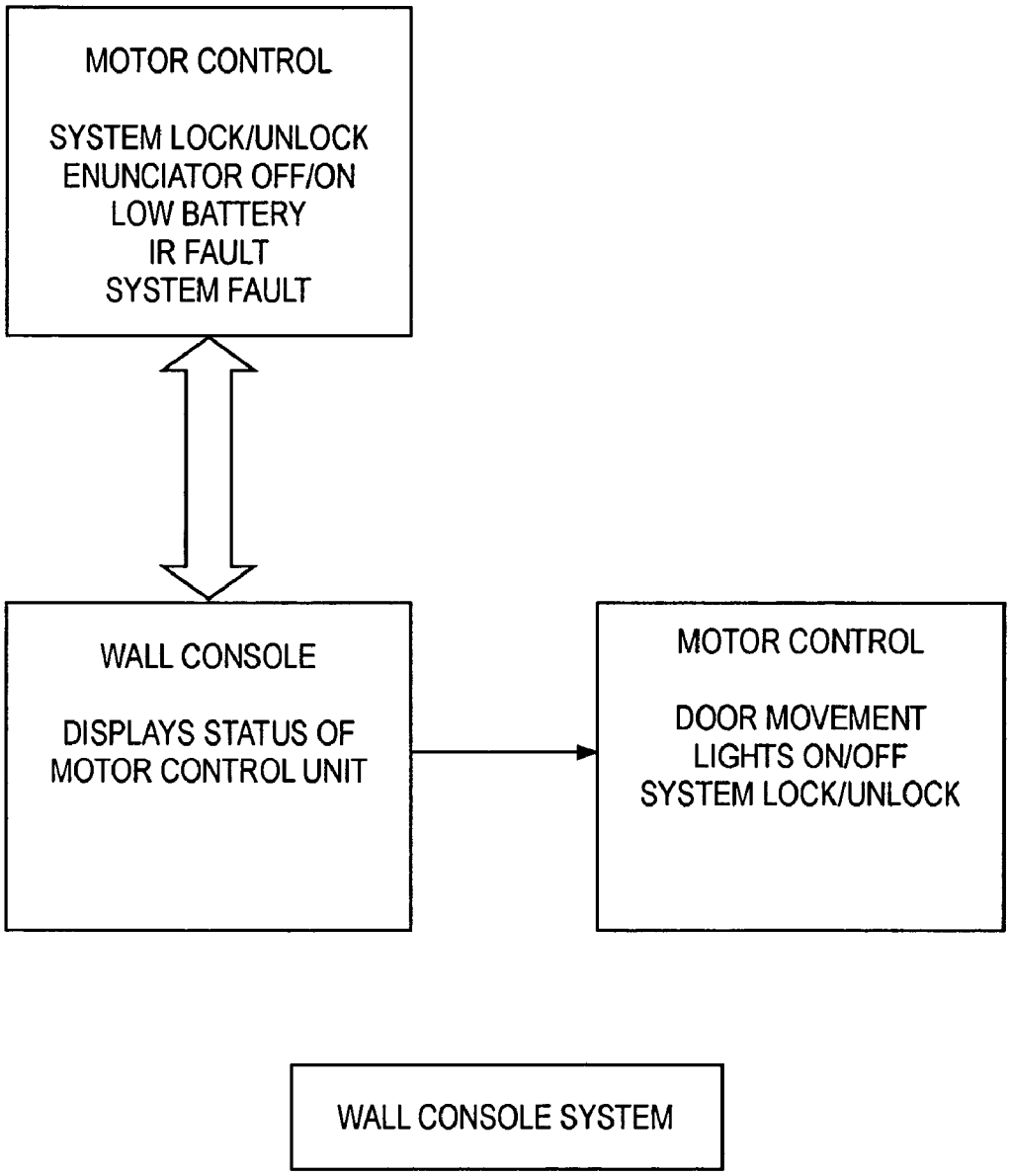
FIG. 33 is a schematic showing the Console for the operation of the motor control unit of the garage door opener.
Figure 34:
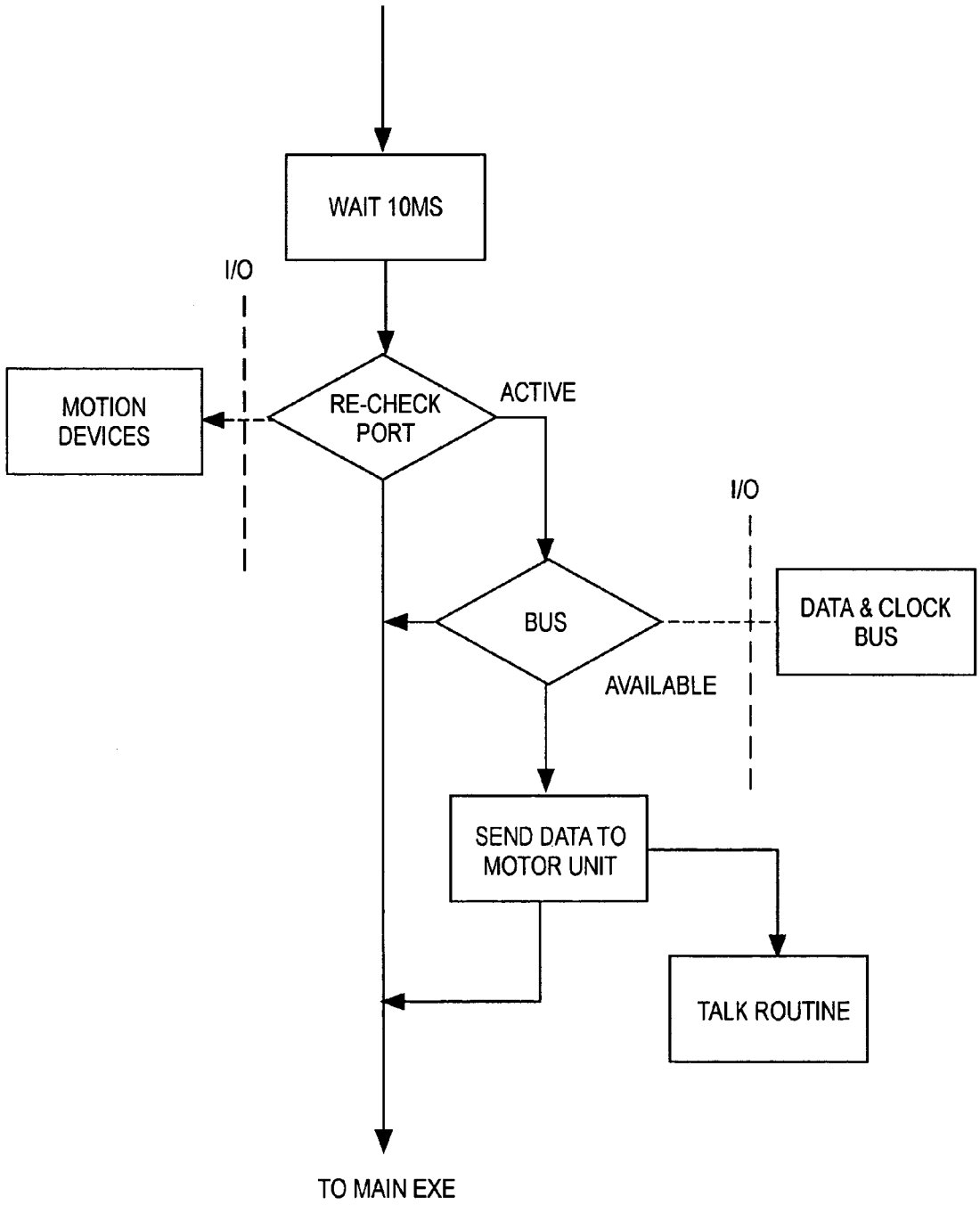
FIG. 34 is a schematic showing the controls for the wall accessory inputs.
Figure 35:
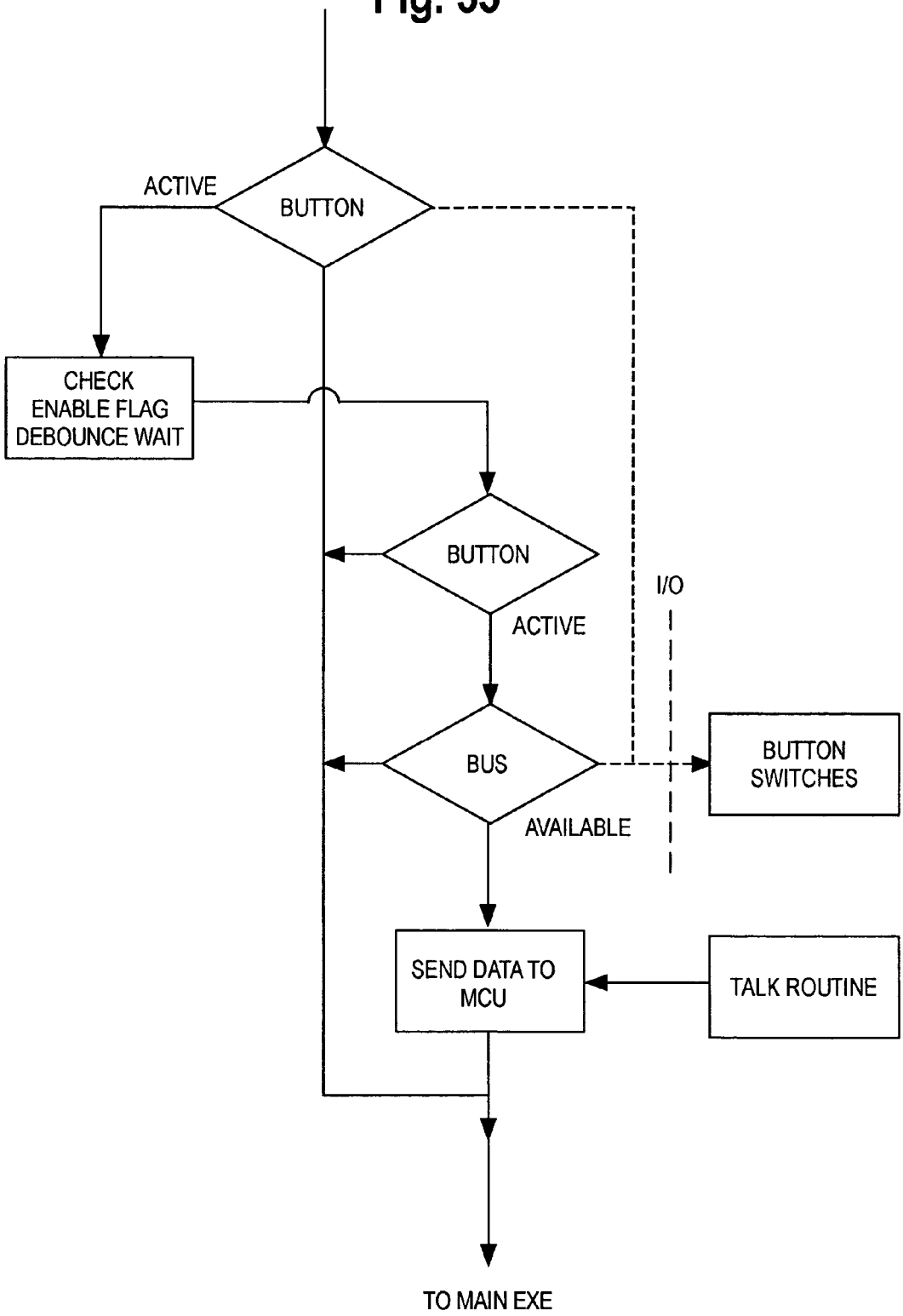
FIG. 35 is a schematic showing the controls for the button interface.
Figure 36:
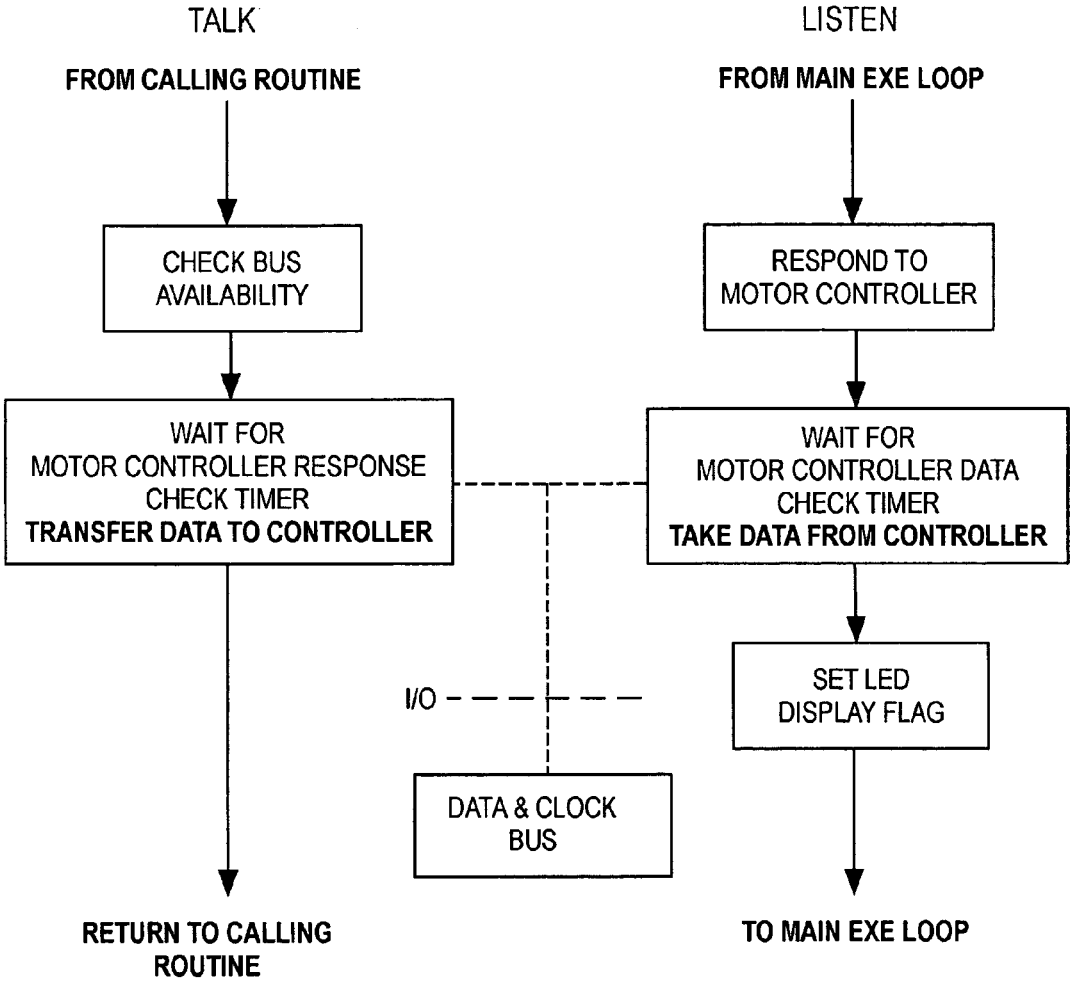
FIG. 36 is a schematic showing the communication to the motor control unit.
Figure 37:
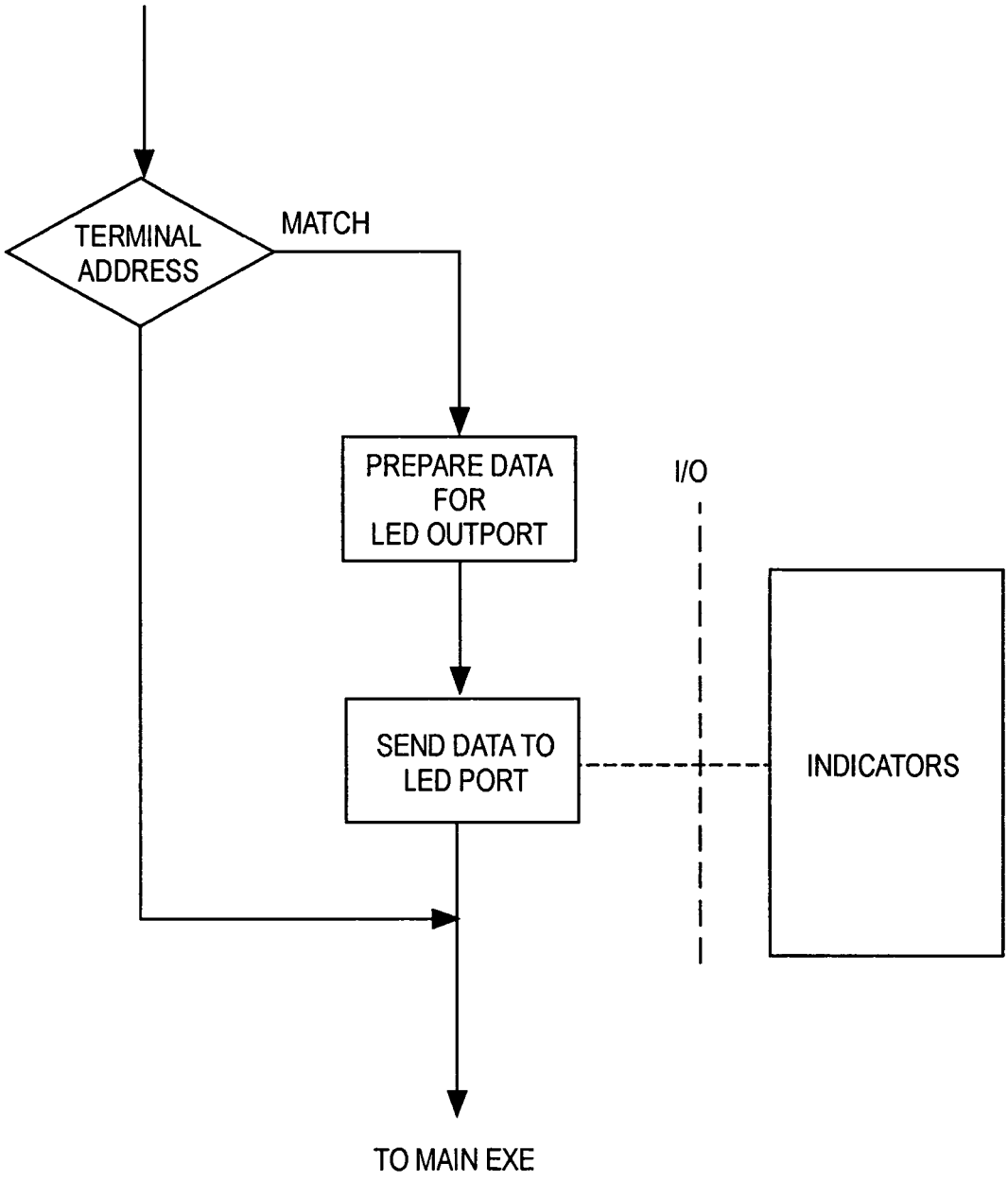
FIG. 37 is a schematic showing the controls for the indicator display.

FIG. 33 is a schematic showing the Console for the operation of the motor control unit of the garage door opener. The Motor Control Unit (MCU) operational program is comprised of one main executive loop routine which controls the operations of the GDO system by handing off various control task to numerous specialized routines. FIG. 34 is a schematic showing Console1 for the controls for the wall accessory inputs. FIG. 35 is a schematic showing the Console2 which controls for the button interface. FIG. 36 is a schematic showing Console4 for the communication to the motor control unit. FIG. 37 is a schematic showing Console3 which is for the controls for the indicator display.

Figure 38:
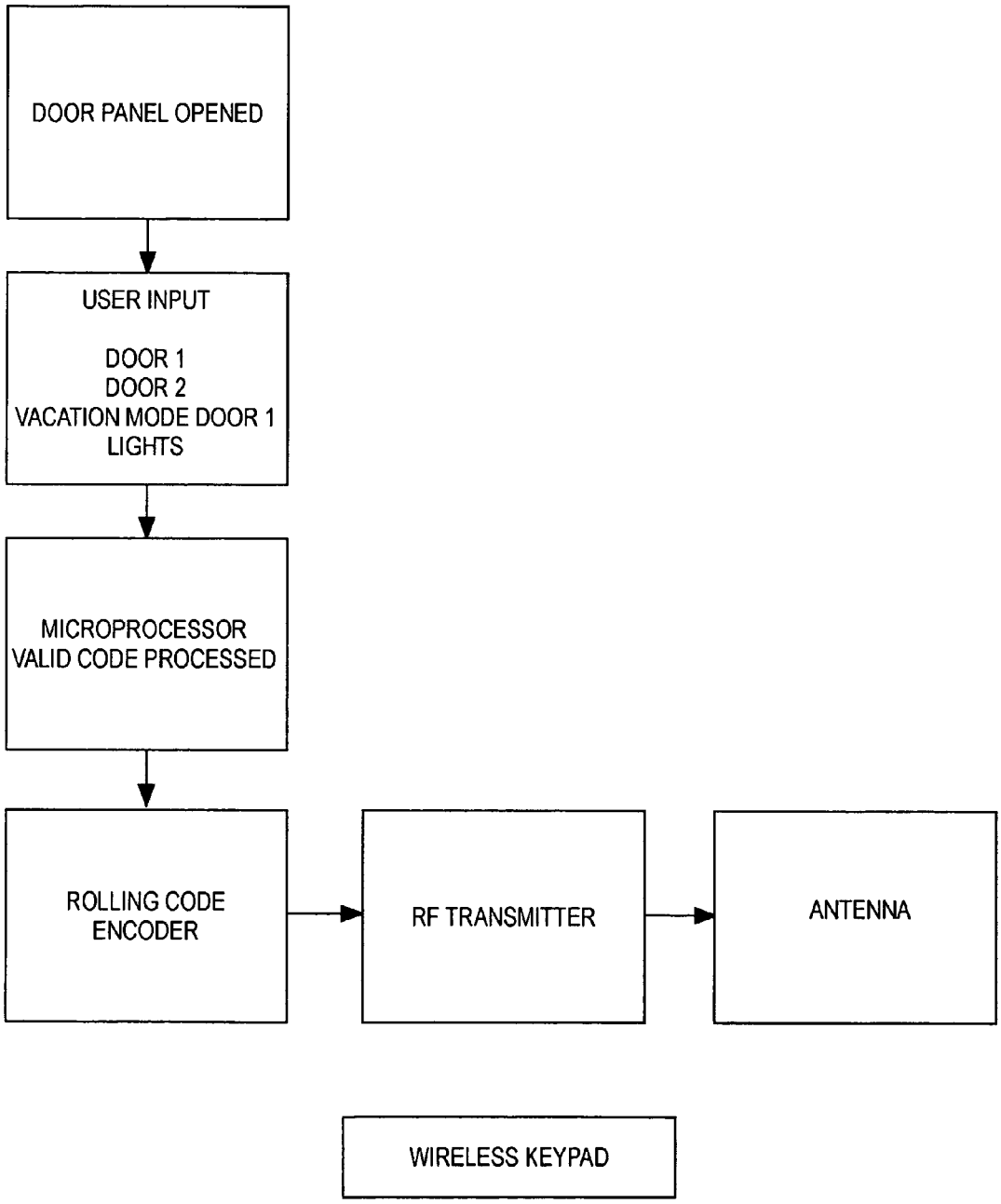
FIG. 38 is a schematic showing the controls for the keypad.
Figure 39:
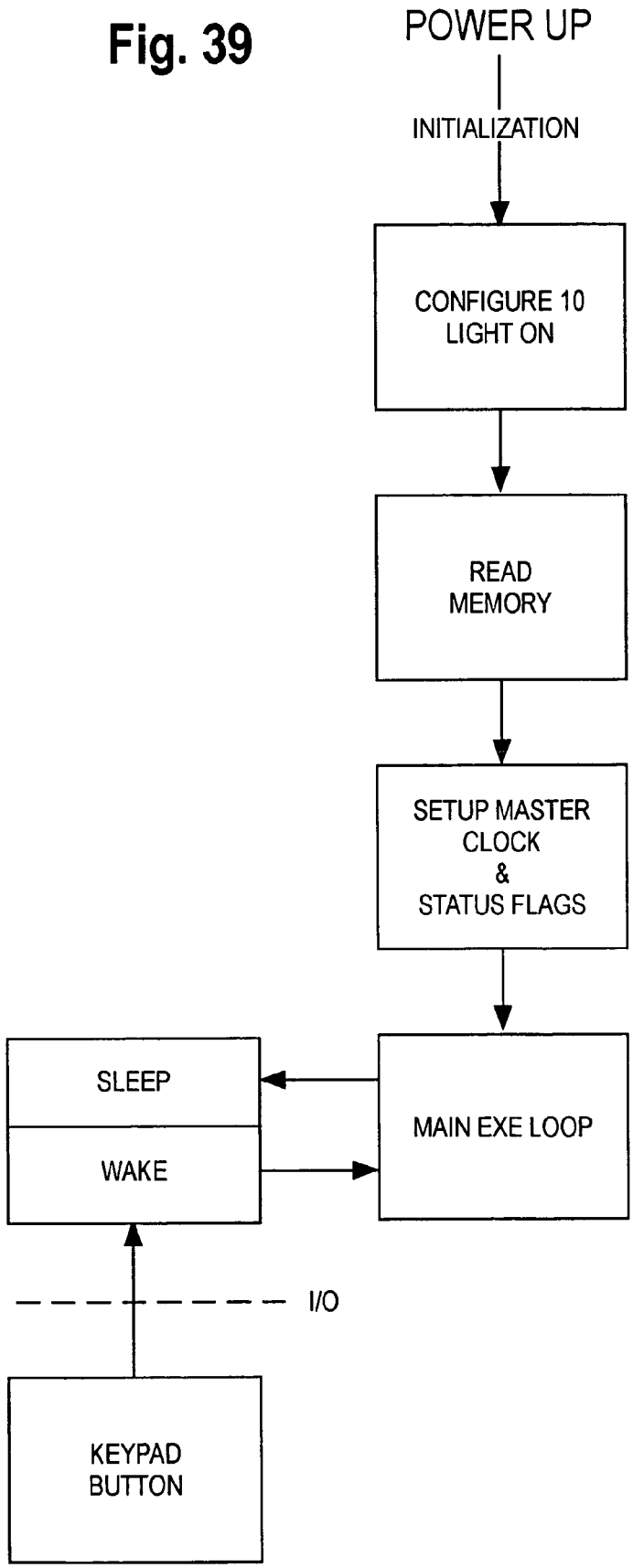
FIG. 39 is a schematic showing the initialization of the Console software.
Figure 40:
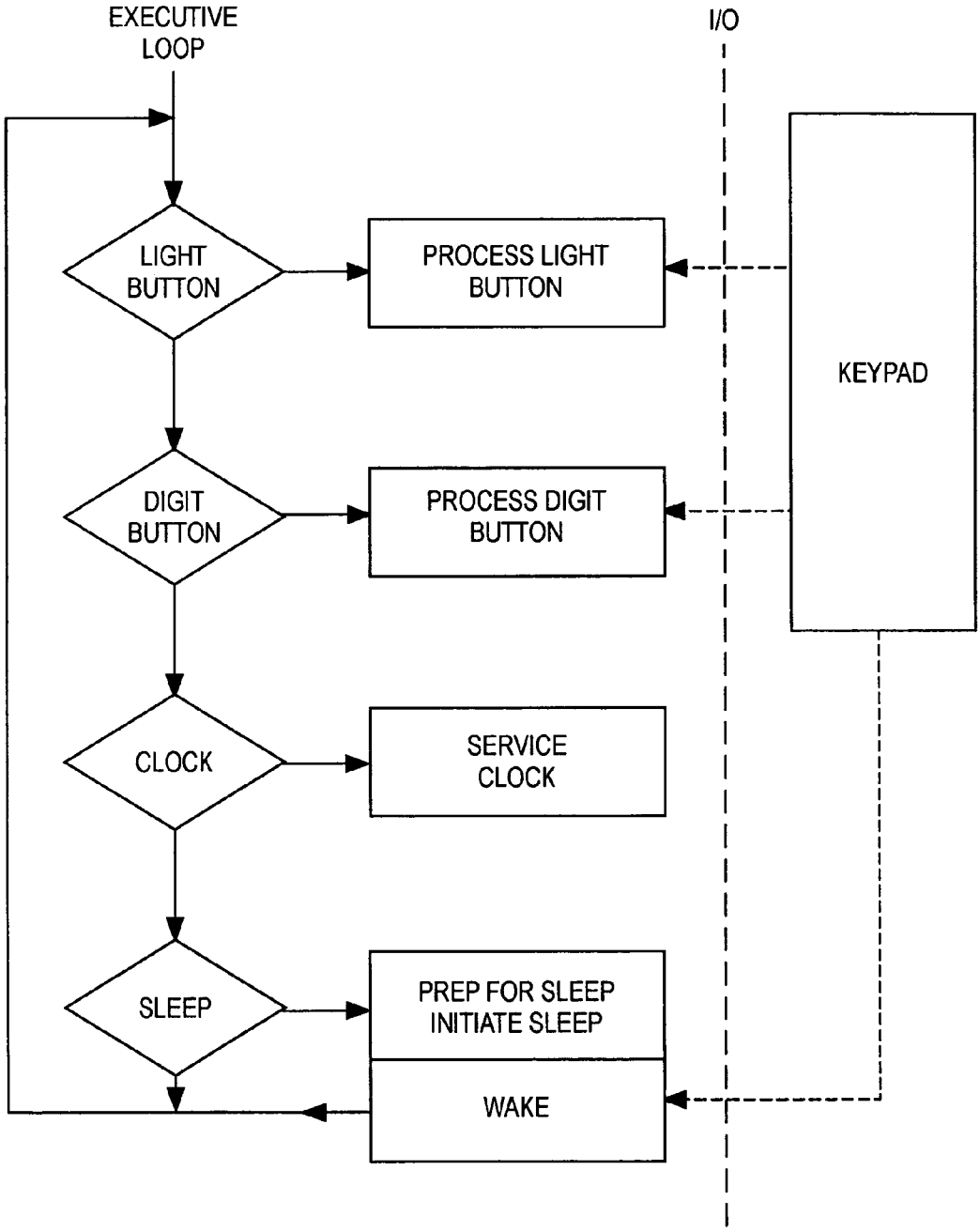
FIG. 40 is a schematic showing the Main.Exe loop that controls the keypad operations.
Figure 41:
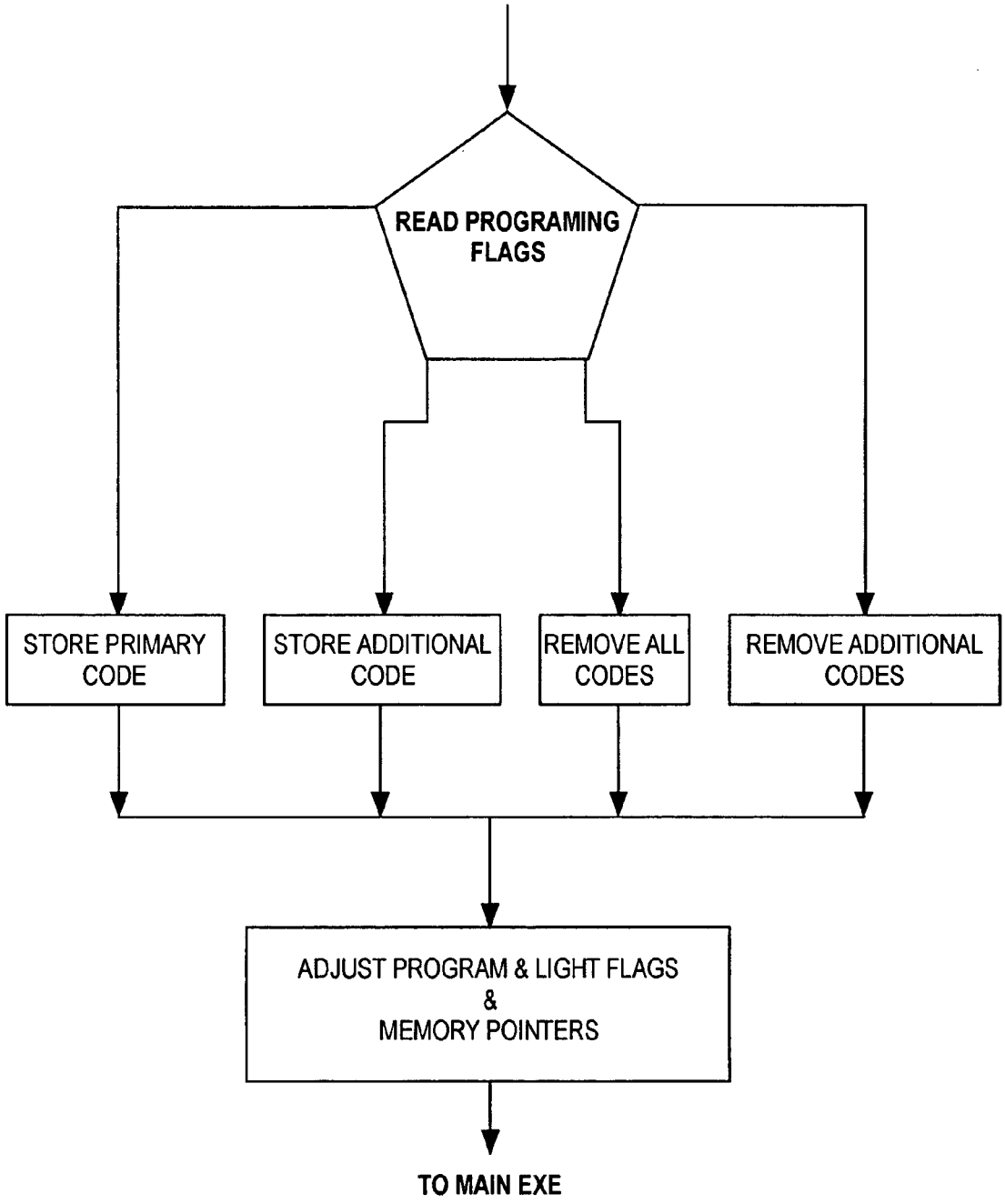
FIG. 41 is a schematic showing the interface routine for programming the keypad passcodes.
Figure 42:
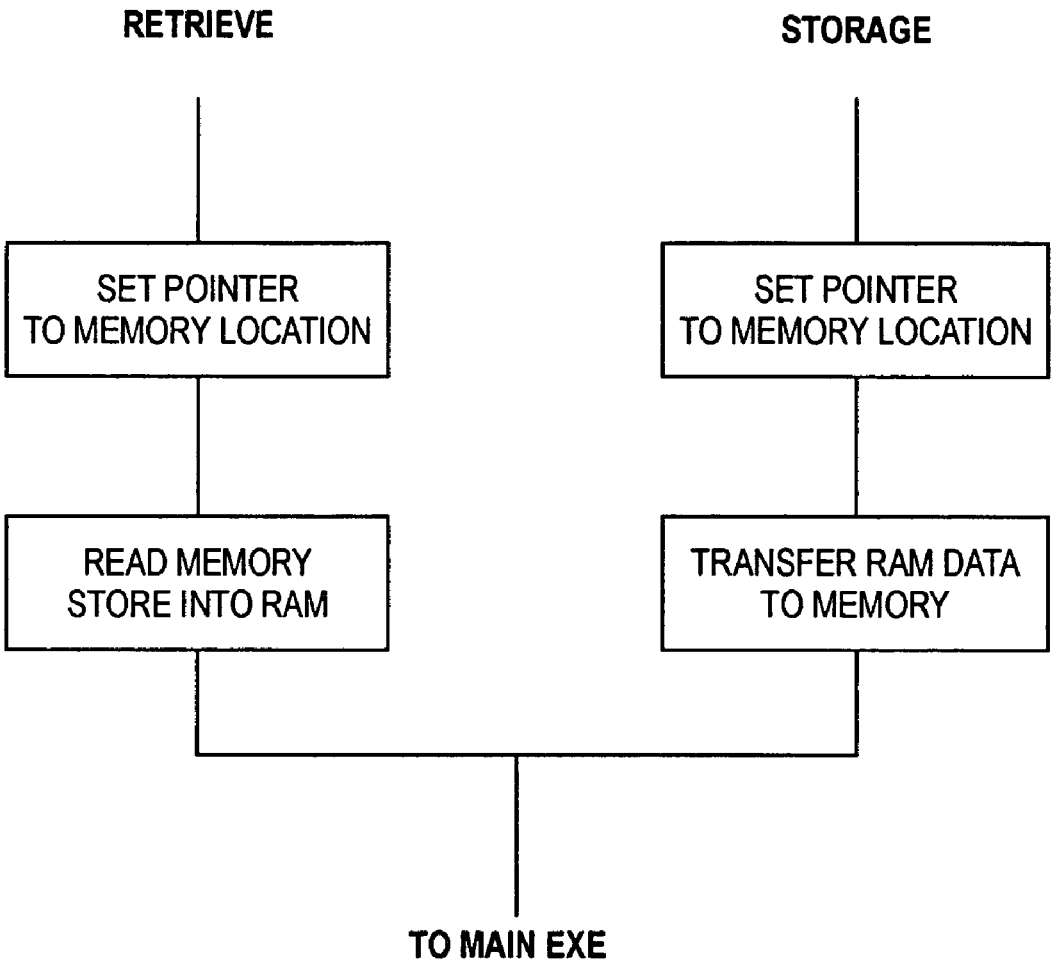
FIG. 42 is a schematic showing the keypad EE memory for the memory read write functions.
Figure 43:
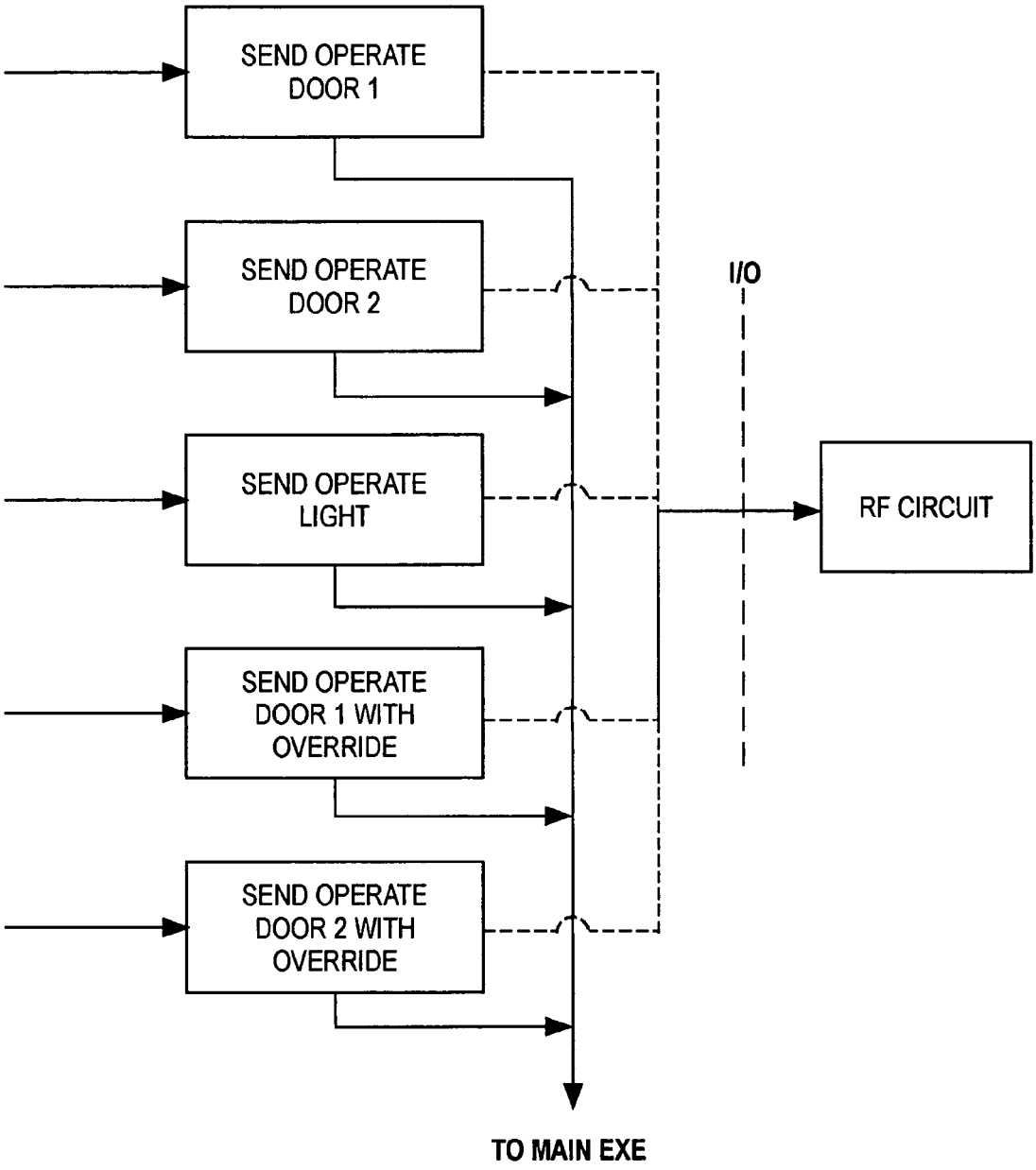
FIG. 43 is a schematic showing the control of data transmission to the RF device.
Figure 44:
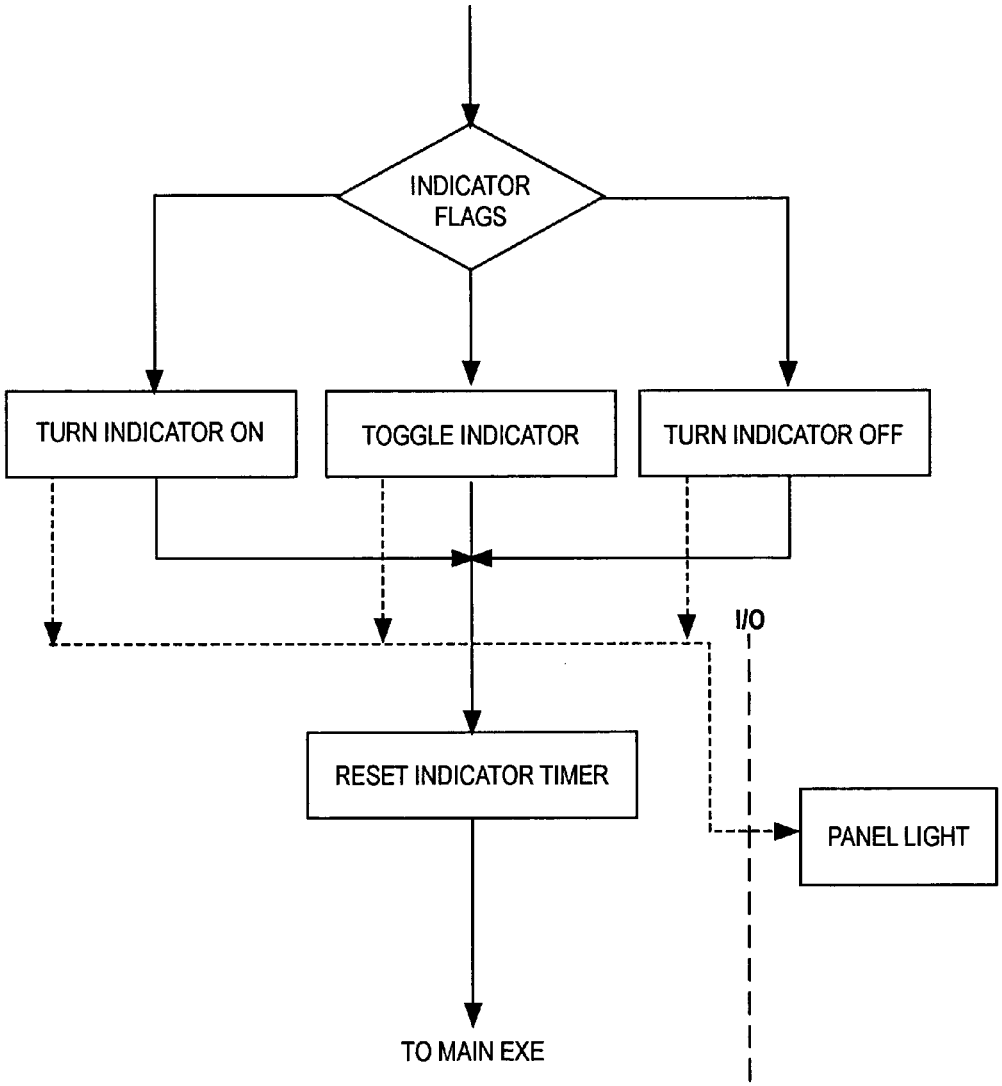
FIG. 44 is a schematic showing the software for controlling an infrared receiver device and an infrared transmitter.

FIG. 38 is a schematic showing the controls for the keypad. The Remote Operational Control Unit (ROCU) operational program is comprised of one main executive loop routine which controls the operations of the keypad by handing off various control task to numerous specialized routines. FIG. 39 is a schematic showing keypad1 for the initialization of the Console software. FIG. 40 is a schematic showing keypad2 which is the Main.Exe loop that controls the keypad operations. FIG. 41 is a schematic showing keypad5, the interface routine for programming the keypad passcodes. FIG. 42 is a schematic showing keypad3, the keypad EE memory for the memory read write functions. FIG. 43 is a schematic showing keypad4, the control of data transmission to the RF device. FIG. 44 shows the software for controlling the keypad display panel lights.

Figure 45:
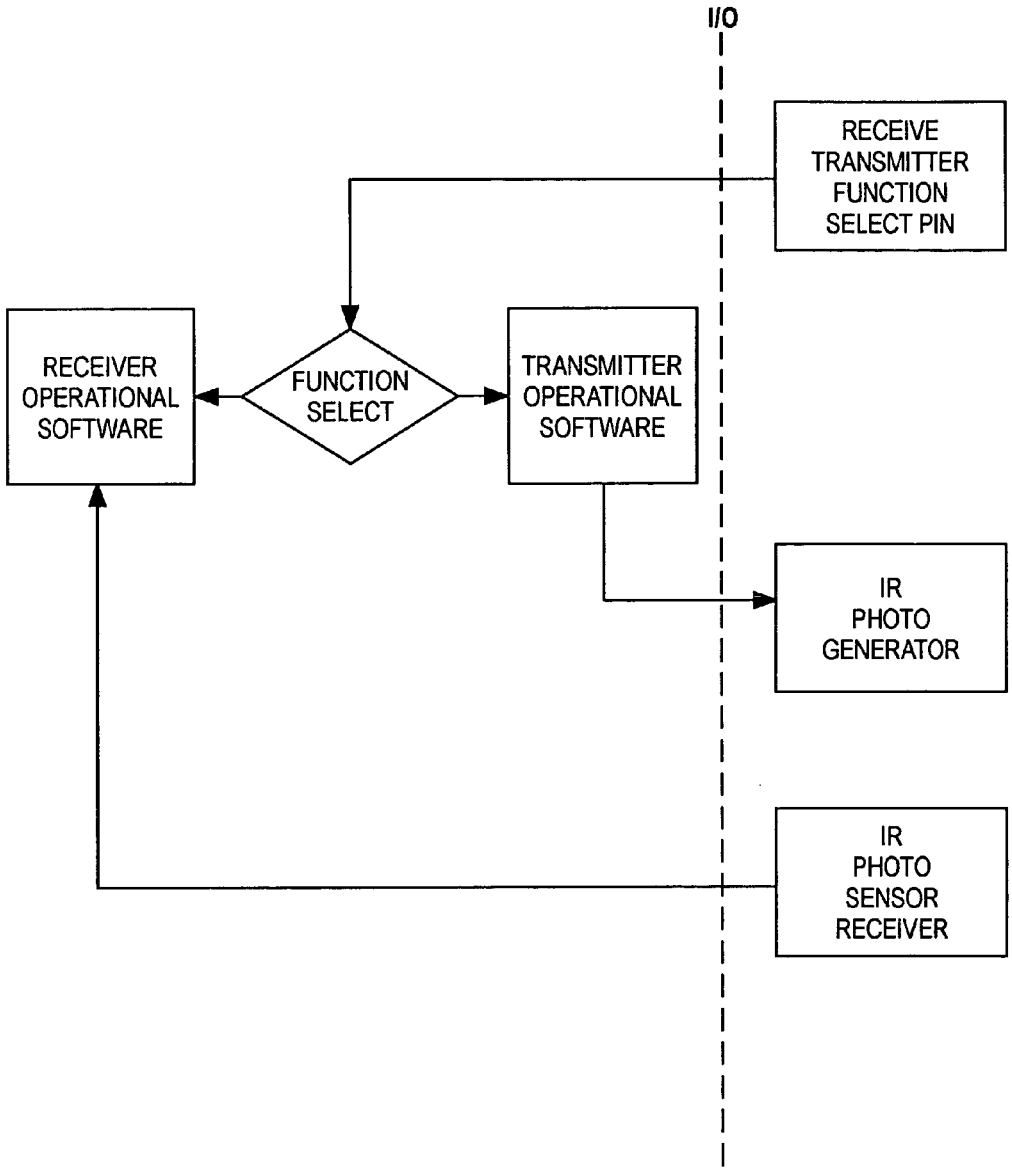
FIG. 45 is a schematic diagram showing IR, the software for controlling an infrared receiver device and an infrared transmitter.

FIG. 45 is a schematic showing IR, the software for controlling an infrared receiver device and an infrared transmitter.

VI. MCU Software Operation (Refer to Diagram "Motor Control Unit", See FIGS. 5 & 6)

The Motor Control Unit (MCU) operational program is preferably comprised of one main executive loop routine which controls the operations of the GDO system by handing off various control task to numerous specialized routines.

The following table is the processor input/output (IO) pin reference.

Input

| Pin# | Active Level (note 1) | Purpose | Attention Request Condition |
|---|---|---|---|
| 10 | LO | Program Button | depressed |
| 11 | LO | Plus Button | depressed |
| 12 | LO | Minus Button | depressed |
| 13 | HI | Terminal Address Switch 1 | open (note 2) |
| 14 | HI | Travel Limit Switch | open (door fully up) |
| 15 | LO | IR Detector Signal | obstruction detected |
| 16 | — | Speed Sensor Device | pulsing |
| 17 | HI | Terminal Address Switch 2 | open (note 2) |
| 18 | Vdc | Monitor Motor Current | na |

(Note 1: Level at which the input is requesting attention from the processor.)
(Note 2: Factory set condition.)

Output

| Pin# | Default Level (note 3) | Purpose | Normal Condition |
|---|---|---|---|
| 18 | LO | Motor Direction control | Forward |
| 19 | LO | Motor Speed control | Off |
| 20 | LO | Light Control | Off |
| 21 | LO | Sound Control | Off |

(Note 3: Level which will cause the Normal Condition.)

Bi-Directional

| Pin# | | Default Condition & Level (note 4) | Purpose |
|---|---|---|---|
| 6 | Output | LO | Wall Console Data communication bus |
| 7 | Input | Hi-Impedance | Wall Console Serial Clock bus |
| 8 | Input | Hi-Impedance | HCS500 Data communication bus |
| 9 | Output | LO | HCS500 device Serial Clock bus |

(Note 4: Level which is set at power up and maintained if no interaction is required.)

1.0 Initialization (Refer to diagram "Init" FIG. 7)

At power up the micro controller will:

1. Clear all user memory and bring all Outputs to a lo voltage state.
2. Read EEprom (Retrieve routine) and hold all values.
3. Check the "initialization" flag returned from the EEprom:
   If set load all values retrieved from EEprom into the system working memory. Or
   If not set load all default operating values in the working memory And active the sound device.
4. Read the Button switches:
   If active reset all operating values in the working memory to the default setting And active the sound device.
5. Set the following flags
   1. light flash
   2. send a clear the console message
   3. door up
6. Clear the master clock.
7. Wait 100 ms for all the other peripheral to power up.
8. Turn the sound device off.
9. Initialize Pulse Width Modulation operating parameter.
10. Proceed to Main Executive 2.0 Main Executive (Refer to Diagram "MainBlock" See FIG. 8)

The Main Executive routine will:

1. Monitor the console data bus and
   If an attention signal is present will check the master clock
   If time allows, will jump to the Console Receive Communication routine.
2. Monitor the RF data bus and
   If an attention signal is present will check the master clock
   If time allows, will jump to the RF Communication routine.
3. Check the Console Transmit flag
   If set check the motor status and
   If the motor is off jump to the Console Send Communication routine.
4. Check the Master Clock and
   If the master clock equals the Alarm setting jump to the Motor On request routine.
5. Check the Motor and
   If off, jump to Motor OverHeat routine.
6. Check the Speed Hall Interrupt Flag and
   If set jump to Motor Monitor routine
   If off check the buttons and
   If any are active, jump to the Button routine.
7. Jump to the Light and Sound Service routine.
8. Check the Motor and
   If off check the Write to EEprom flag and
   If set jump to the EEprom Store routine.
9. Jump to the Reverse Motor routine.
10. Loop back to monitor console data bus.

3.0 Motor Monitor (Refer to FIGS. 9 to 24)

This routine will determine the status of the Motor using the motor ramp flags and proceed to one of three (3) door operational service routines.

A. If at Rampup Door:

Wait for the Hall sensor interrupt and

1. Increase Pulse Width Output to attain 7 in/sec door speed.
2. reset the master clock (usclock) and reset the clock change flag
3. increment the secondary clock (msclock)
4. increment the sound counter
5. calculate startup motor speed for obstruction error monitoring 6. Determine if a motor speed change (to Normal) is required.

B. If at Rampdown Door:
Wait for the Hall sensor interrupt and
1. Decrease Pulse Width Output to attain a stop door condition.
2. Perform all Rampdown functions without error monitoring
3. Determine if a motor speed change (to Stop) is required.

C. If at Normal Door (neither Rampup or Rampdown)
Wait for the Hall sensor interrupt and
1. Synchronize the master clock to the speed sensor pulse edge.
2. Adjust Pulse Width Output to motor drive to attain & maintain 14 in/sec door speed.
3. Store the current door speed
4. Adjust the door positional counter
2. Calculate the door speed tolerance window and
If out of tolerance perform the following:
1. turn off the motor power and clear the motor flags.
2. Set the appropriate error flags
3. Signal a console message using the transmit flag.
4. Set flash light flag on.
5. Turn on the sound device.
3. Determine if a motor speed change (to Rampdown) is required.
4. (Based on the door direction) check any/all the following:
1. The travel limit switch.
2. The Max travel vs. position value.
3. The IR detection status.
4. The pass limit switch counter.
5. The motor off request flag.
And If required by any of the conditions of section 4 perform any/all following:
1. Turn off the motor and clear the motor flags.
2. Set the error and console transmit flags.
3. Set the flash light flag.
4. Set the sound device on.

4.0 Console (Send & Receive) Communication (Refer to Diagram "ConCom", FIG. 25)

These routines will either
A. Send data to the console unit
If a transmission is required the following will take place.
The data bus will be checked for availability and
If available
1. A clock bus attention signal will be trigger on the bus.
2. A 50 ms wait for a response will take place.
(If no response is received this routine is aborted)
3. When the response has been acknowledged
A data transfer will start and proceed to its conclusion.

OR
B. Receive data from the console unit
If an attention signal is pending on the clock bus the following will take place.
1. An attention response signal will be acknowledged on the data bus.
2. A master clock check will take place.
(If no transfer is started before an alarm is triggered this routine is aborted)
3. All data will be received.
4. A processing routine will decode and set/clear the appropriate flags.

5.0 EEprom Store/Retrieve (Refer to Diagram "RF eeprom", FIG. 26)
These routines will either
A. Store data to the EEprom (HCS500) unit.
If a EEprom write is required the following will take place.
1. A clock bus attention signal will be trigger on the bus.
2. A 1.2 ms wait for a response will take place.
(If no response is received this routine is aborted)
3. When the response has been acknowledged
A data transfer will start and proceed to its conclusion.

OR
B. Retrieve data from the EEprom (HCS500) unit.
If a EEprom read is required the following will take place.
1. A bus attention signal will be trigger on the bus.
2. A 1.2 ms wait for a response will take place.
(If no response is received this routine is aborted)
3. When the response has been acknowledged
A data transfer will start and proceed to its conclusion.

6.0 RF (Remote) Communication (Refer to Diagram "RF com", FIG. 27)
This routine will take data from the RF (HCS500) unit.
If an attention signal is pending on the data bus
AND
If the enable flag allows a data transfer the following will take place.
1. An attention response signal will be acknowledged on the clock bus.
2. A master clock check will take place.
(If no transfer is started before an alarm is triggered this routine is aborted)
3. All data will be received.
4. A processing routine will decode and set/clear the appropriate flags.

7.0 Button and Programming (Refer to Diagram "Button", FIG. 28)
This routine will monitor the status of the buttons and proceed as follows:
IF either of the "+" or "−" buttons are depressed the following will take place.
A timer will start to determine the length of the button hold down period.
IF the initialization flag allows and the length of hold down time is greater then ½ seconds the following will take place.
1. power to the motor will be applied based on which button ("+"=down, "−"=up) is depressed.
2. the button is monitor and the moment it's released, power is turned off.
(If the initialization flag is cleared this routine is aborted).
OR
If the length of hold down time is less then ½ seconds, the following will take place.
1. The maximum travel value will be adjusted 1 increment based on which button is depressed.
OR
IF the "program" button is depressed the following will take place.

1. A counter will determine the number of "program" button depressions and based on this number the following table will determine the "+" & "−" button mode functionality.
   1st depression=Up force adjustment
   2nd depression=Down force adjustment
   3rd depression=Transmitter Link or Transmitter Un-Link
   4th depression=Routine Exit
   Upon Exit the sound device will annunciate the system force setting if a adjustment was made to either the Up or Down setting. If the Transmitter link was activated only two (2) beeps will be annunciated.
2. The "+" button will increment the adjustment OR perform a transmitter link.
3. The "−" button will decrement the adjustment OR perform a transmitter un-link.

8.0 Light and Sound (Refer to Diagram "Access", FIG. 29)

This routine will monitor the status of the system light and sound device using the corresponding flags and proceed as follows:

IF the light flag is set (light=on) the following will take place.
1. the master clock will be compared to the light timer and
   If they match the light will be turned off.

IF the light flash flag is set the following will take place.
1. the master clock will be compared to the light timer and
   If they match the light will be toggled to it's opposite state.

IF the sound flag is set the following will take place.
1. the master clock will be compared to the sound timer and
   If they match the sound will be toggled to it's opposite state.

9.0 Reverse Motor

This routine will determine if the motor status needs to be changed and proceed as follows:

IF the reverse flag is set the following will take place.
1. the master clock is monitored to determined a 1 sec elapses time and
2. after 1 seconds the motor on flag is set.

10.0 Out Of Balance (Ref to Diagram "Motor Block", FIG. 9)

This routine will monitor the motor current (I) input and proceed as follows:

During the door travel from the door travel point where a stable current reading is obtained to the door travel point label "ramp down", an average current reading is calculated for each travel pulse interval. This average reading is stored. At door travel stop the stored current value is compared to a system set limit and IF the store value is greater then the set limit and no door fault conditions were flagged the following will take place:
1. the sound device will be activated
2. the sound flash routine will be activated and loaded with six (6)
3. the light flash routine will be activated and loaded with three (3)
3. the "out of balance" flag will be set 11.0 Hall Interrupt (Ref to Diagram "Hallint" FIG. 30)

This routine will signal the interrupt the Main program operational software if a Motor Hall sense pulse is detected. If this pulse is detected the following will take place.
1. The run program counter will be stored
2. The interrupt routine will execute setting the Hall flag and resetting the Hall interrupt flag.
3. Return to the Main program operational software using the stored program counter.

12.0 Debugging Tool (Refer to diagram "Send Usart" and "Tx_wait" See FIGS. 31 and 32)

These routines will output Usart system operating data to a computer terminal upon a signal request to an input of the motor control processor. "Tx_wait" is a subroutine diagram of the routine "Usart"

VII. OCU Software Operation (Refer to Diagram "Console", FIG. 33)

The Operational Control Unit (OCU) operational program is comprised of one main executive loop routine which controls the operations of the wall console by handing off various control task to numerous specialized routines.

The following table is the processor input/output (IO) pin reference.

Input

| Pin# | Active Level (note 1) | Purpose | Attention Request Condition |
|---|---|---|---|
| 10 | LO | Door On/Off Button | depressed |
| 11 | LO | Lock/UnLock Button | depressed |
| 12 | LO | Sound OFF Button | depressed |
| 13 | LO | Light On/Off Button | depressed |
| 16 | LO | Motion Detector | motion detected |
| 17 | HI | Terminal Address Switch | open (note 2) |

(Note 1: Level at which the input is requesting attention from the processor.)
(Note 2: Factory set condition.)

Output

| Pin# | Default Level (note 3) | Purpose | Normal Condition |
|---|---|---|---|
| 18 | LO | Lock indicator | Off |
| 20 | LO | Safety indicator | Off |
| 23 | LO | LoBattery Condition | Off |

(Note 3: Level which will cause the Normal Condition.)

Bi-Directional

| Pin# | | Default Condition & Level (note 4) | Purpose |
|---|---|---|---|
| 6 | Output | LO | Motor Control Data communication bus |
| 7 | Input | Hi-Impedance | Motor Control Serial Clock bus |

(Note 4: Level which is set at power up and maintained if no interaction is required.)

1.0 Initialization

At power up the console will:
1. Clear all user memory and bring all Outputs to a low voltage state.

2. Turn on the "Safety" indicator
3. Clear the master clock.
4. Proceed to Main Executive 2.0 Main Executive The Main Exe routine will (in the following order):

1. Check the master clock and
   If a time-out condition has occurred will jump to Process Clock
2. Monitor the Button (Refer to diagram "console2") status and
   If depressed will check the switch enable flag and if allowed will
   1. wait 12 ms for switch debounce
   2. recheck the button status and if still depressed
   3. call the Talk routine to send the button command to the MCU
   4. clear the switch enable flag.

Or if not active set the switch enable flag
3. Check the LED flag and if set will call the Display routine.
4. Monitor the Motor Control Serial Clock bus status and
   If HI will jump to the Listen routine
5. Monitor the Accessory (Refer to diagram "console1", FIG. 34) Motion status and
   If attention is requested will check the 4 minute enable flag and if allowed will
   1. wait 10 ms for signal debounce
   2. recheck the Motion status and if still active
   3. call the Talk routine to send the accessory command to the MCU
   4. clear the clear enable flag Or if not active set the accessory enable flag
6. Loop back to check master clock.

3.0 Communication (Talk, Listen) (Refer to Diagram "console4", FIG. 36)

These routines will either

A. send (Talk) data to the motor control unit

If a transmission is required the following will take place.

The data bus will be checked for availability and

If available

1. A attention signal will be trigger on the clock bus.
2. A 200 ms wait for a response will take place. (If no response is received this routine is aborted)
3. When a response has been acknowledged on the data bus A data transfer will start and proceed to it's conclusion.

OR

B. receive (Listen) data from the motor control unit

If an attention signal is pending on the clock bus the following will take place.

1. A attention response signal will be acknowledged on the data bus.
2. A 200 ms wait for a response will take place. (If no transfer is started this routine is aborted)
3. all data will be received.
4. the LED display flag will be set.

4.0 Process Clock

The Clock Process routine will:

1. Reset the master clock and increment the secondary clock.
2. Check if the secondary clock equals a present limit and if it is will:
   1. reset the secondary clock and increment the third clock.
   2. check if the third clock equals a present limit and if it is will:
      1. reset the third clock and reset 4 minute flag.

5.0 Display (Refer to diagram "console3", FIG. 37)

If the LED flag is set this routine will apply all stored received motor data to the indicator Output and clear the LED flag.

VII. ROCU Software Operation (Refer to Diagram "Keypad", FIG. 38)

Remote Operational Control Unit (ROCU) operational program is comprised of one main executive loop routine which controls the operations of the keypad by handing off various control task to numerous specialized routines.

The following table is the processor input/output (IO) pin reference.

Output

| Pin# | Default Level (note 1) | Purpose | Normal Condition |
|---|---|---|---|
| 6 | LO | RF data signal 0 | Off |
| 7 | LO | RF data signal 1 | Off |
| 8 | LO | RF data signal 2 | Off |
| 9 | HI | Panel Indicator Light | On |
| 10 | HI | "Light" button | Column 0 write |
| 11 | HI | "3", "6", "9", "R" button | Column 1 write |
| 12 | HI | "2", "5", "8", "0" button | Column 2 write |
| 13 | HI | "1", "4", "7", "L" button | Column 3 write |

(Note 1: Level which will cause the Normal Condition.)

Input

| Pin# | Active Level (note 2) | Purpose | Attention Request Condition |
|---|---|---|---|
| 17 | HI | "R", "0", "L" | Row 0 read |
| 18 | HI | "9", "8", "7" | Row 1 read |
| 1 | HI | "6", "5", "4" | Row 2 read |
| 2 | HI | "Light", "3", "2", "1" | Row 3 read |

(Note 2: Level at which the input is requesting attention from the processor.)

Keypad Matrix Value

| Stored Hex Value | Level@ Column# 3210 | Level@ Row# 3210 | IF | Key Depressed |
|---|---|---|---|---|
| 18 | 0001 | 0001 | | light (this key not stored) |
| 21 | 0010 | 0001 | | R (this key not stored) |
| 22 | 0010 | 0010 | | 9 |
| 24 | 0010 | 0100 | | 6 |
| 28 | 0010 | 1000 | | 3 |
| 41 | 0100 | 0001 | | 0 |
| 42 | 0100 | 0010 | | 8 |
| 44 | 0100 | 0100 | | 5 |
| 48 | 0100 | 1000 | | 2 |
| 81 | 1000 | 0001 | | L (this key not stored) |
| 82 | 1000 | 0010 | | 7 |
| 84 | 1000 | 0100 | | 4 |
| 88 | 1000 | 1000 | | 1 |

3.0 Initialization (Refer to Diagram "Keypad1", FIG. 39)

Power up bit is read and either routine A or B is performed.

A. At POWER UP the keypad will:

1. Configure the IO port.
2. Clear all user memory and bring all Outputs to a lo voltage state.
3. Call the Retrieve routine, read the permanent memory & load ram 4. Set the panel light (refer to as the "indicator") to Blinking mode.
5. Clear the master clock.
6. Proceed to Main Executive At WAKE UP (note 1) the keypad will:
1. Configure the IO port.
2. Clear all user memory and bring all Outputs to a low voltage state.
3. Set the panel light (refer to as the "indicator") as determined by the Indicator flags.
4. Clear the master clock.
5. Proceed to Main Executive NOTE 1: The keypad is programmed to execute a SLEEP mode of operation where as all memory is retained. "WAKE UP" is a return from this SLEEP mode.

2.0 Main Executive (Refer to Diagram "Keypad2", FIG. 40)

The Main Exe routine will (in the following order):
1. Active a Column 0 write and Monitor the "Light" button and if active call the LightSw_ck routine and then perform one of the following depending on the program flags value returned:
   0=Call the Send Operate Light command.
   1=Store all keypad digit entries and set the program flag to 2.
   2=Jump to the Program routine.
2. Active a Column 1, 2, 3 write and Monitor the Numeric Digit and the "R"/"L" buttons and if active perform one of the following depending on the button depressed:
   "R"/"L"=jump to the Digit_plus routine.
   Numeric Digit=jump to the Digit routine.
3. Check the master clock and if the clock equals a predetermined value jump to the Clock routine.
4. Check the Sleep timer and if the timer equals a predetermined value jump to the Bedtime routine.
5. Loop back to active column 0 write.

3.0 Program (Refer to Diagram "Keypad5", FIG. 41)

The Program routine will perform one operation as described in the table below depending on the status of the following flags:

Init=0

Code=1 set the code flag=2 & set the indicator flag=off.

Code=2 compare the 2 sets of digit entries and
- If they match STORE the entry as a primary passcode. Clear all program flags and re-adjust the indicator flag.
- If they do not match clear entries and all flags.

Init=1

Code=1 call the Validation routine to validate the first digit entry and
- If valid set/clear the PS flag depending on weather the entry is a primary passcode.
- If not valid clear entries and all flags.

Code=2 check the PS flag and proceed as follows:
- PS=prim: call the Validation routine to validate the second digit entry and
  - If valid primary passcode, REMOVE All stored passcode entries and clear all program flags and re-adjust the indicator flag.
  - If not primary passcode, STORE ADDITION entry as a passcode.
- PS=sec/ov: call the Validation routine to validate the second digit entry and
  - If valid passcode, REMOVE ADDITION entry from memory.
  - If not valid passcode, clear entries and all flags.

4.0 Digit_plus and Digit

The Digit routine will check the digit counter and if not at max will store the entered digit and increment the digit counter.

The Digit_plus routine will perform as described below depending the button depressed.
- If the button depressed was a non-digit, this routine will jump to the Digit routine.
- If the button depressed was either "R" or "L" then a the digit entry will be check for Validation and
  - If valid a SEND Operate Door 1 or 2 command will be called depending on which button was depressed.
  - If not valid will clear all entries, counters and flags.

5.0 LightSw_ck

This routine will monitor the length of time the light button is depressed.

If the button is depressed for more then 5 seconds the program flag is set to 1.

6.0 EE Memory (Refer to diagram "Keypad3", FIG. 42)

Retrieve

This routine will perform as follows:
1. Set the data to read counter to 25
   8 digits times 3 words (passcodes), plus 1 data valid bit.
2. Adjust the memory pointers.
3. Read and transfer all the data to system ram.
4. Check the data valid bit and
   If valid, set the Init flag and retain the data in system ram.
   If not valid clear the Init flag.

Store

This routine will perform as follows:
1. Determine first open available memory location and set the memory pointer.
2. Set the data to write counter to 8 (8 digits passcodes).
3. Transfer all the data to permanent memory.
4. Write a valid data bit to permanent memory.

7.0 Bedtime (Sleep/Wake)

This routine will prepare the system for low power (Sleep) mode of operation by:
1. Turning off the indicator panel light.
2. Clearing all the program flags.
3. Clearing all the timers and counters.
4. Enabling any input pin to Wake the system.
5. Execute a Sleep system command.

8.0 Clock

This routine will proceed as follows:
1. Reset the master clock and
2. Depending on the status of the indicator flag:
   1=toggle panel light from either on to off OR off to on.
   2=turn panel light off
   3=turn panel light on 9.0 Validation This routine will proceed as follows:
1. Reset all memory pointers to zero.
2. Set the word checking counter to 3.
3. Compare each digit (8) entered to the passcode digits stored in ram memory.
   If a match is found the corresponding word value is set as a return value
   And the routine exits.
4. If no match is found the word counter is advanced and the procedure repeats.

If no match is found after the third word compare, the return flag value is set to zero.

And the routine exits.

10.0 Send Routine (Refer to Diagram "Keypad4", FIG. 43)

This routine will active the RF circuit as follows depending on which command is triggered the calling routine. Refer to the following table.

RF Data Signal Reference Table

| RE Data Value | Level@ Signal# 210 | Send Command |
|---|---|---|
| 0 | 000 | no data transmission |
| 1 | 001 | operate door 1 |
| 2 | 010 | operate door 2 |
| 3 | 011 | operate light |
| 4 | 100 | not valid |
| 5 | 101 | operate door 1 w/lock override |
| 6 | 110 | operate door 2 w/lock override |
| 7 | 111 | not valid |

V. Infrared Detection (IRRT)

1.0 Software Operating Specifications (Ref to Diagram "IR", FIG. 45)

This software package has two (2) separate program loaded in one Microchip # PIC16C509 device. This device has 1K (×12) bytes of user memory.

2.0 Program Routines

| Routine | Purpose |
|---|---|
| Main Initization | select either Receiver or Transmitter operational program |
| RecInit | IR receiver initialization |
| TranInit | IR transmitter initialization |
| Rec | Monitor IR transmitter signal and control output GDO signal |
| Trans | Generate an IR pulse signal |

3.0 Main Initialization

This routine configures the input/output ports and reads the function selcet pin to determine which operation software to execute.

4.0 RecInit

This routine re-configure the input/output ports for IR receiver operation.

5.0 Rec

This routine monitors an IR input signal.

If this signal conforms to the IR acceptable standard then an output signal is transmitted to the GDO motor control unit indicating a proper operating IR transmission. An indicator in also turned on.

6.0 TranInit

This routine re-configures the input/output ports for IR transceiver operation.

7.0 Trans

This routine generates an IR pulse output at a predetermined rate and period.

We claim:

1. A barrier movement operator comprising a motor drive unit having a controller with stored operational software for controlling the movement of a barrier, the controller comprising a communication port connected to an external microprocessor for installing operational software via the communicator port.

2. A barrier movement operator according to claim 1, wherein the external microprocessor is comprised by a personal computer.

3. A barrier movement operator according to claim 1, wherein the external microprocessor is comprised by a personal computing device.

4. A barrier movement operator comprising a first motor drive unit for moving a first barrier, a second motor drive unit for moving a second barrier, each motor drive unit comprising a controller connected to a communication port and a digital data communication medium interconnecting the communications ports of the first and second motor drive units to facilitate digital communication between the first and second motor drive units.

5. A barrier movement operator according to claim 4, wherein the digital data communications medium comprises a digital data bus.

6. A barrier movement operator according to claim 5, comprising a wall console connected to the digital data bus for communication with the first and second motor drive units.

7. A barrier movement operator according to claim 6, comprising an additional wall console connected to the digital data bus.

* * * * *

UNITED STATES PATENT AND TRADEMARK OFFICE

CERTIFICATE OF CORRECTION

PATENT NO. : 7,151,351 B2 
APPLICATION NO. : 10/730742
DATED : December 19, 2006
INVENTOR(S) : John Piechowiak et al.

It is certified that error appears in the above-identified patent and that said Letters Patent is hereby corrected as shown below:

Please insert the following paragraphs before "Programming Car Remote" Column 8, Line 23

-- *LOW BATTERY*: A low battery symbol illuminates when car remote's battery is low. Change Car Remote battery as soon as possible.

*SAFETY FAULT*: A safety fault symbol illuminates when photo eye sensors have been tripped or there is a door jam.

*LOCK*: Illuminates when the system vacation lock is engaged. --

Signed and Sealed this

Twenty-seventh Day of March, 2007

JON W. DUDAS
*Director of the United States Patent and Trademark Office*